US010717622B2

(12) United States Patent
Koch et al.

(10) Patent No.: US 10,717,622 B2
(45) Date of Patent: Jul. 21, 2020

(54) DELIVERY DEVICE AND METHOD FOR OPERATING A DELIVERY DEVICE

(71) Applicant: KOENIG & BAUER AG, Würzburg (DE)

(72) Inventors: Michael Koch, Dresden-Cossebaude (DE); Volker Taschenberger, Coswig (DE); Jens Bellmann, Klingenberg (DE); Dietmar Aust, Weinböhla (DE); Jörg Reber, Dresden (DE); Volker Kessler, Dresden (DE); Tino Morgenstern, Coswig (DE); Steffen Piesch, Niederau-OT Gröbern (DE)

(73) Assignee: KOENIG & BAUER AG, Würzburg (DE)

( * ) Notice: Subject to any disclaimer, the term of this patent is extended or adjusted under 35 U.S.C. 154(b) by 66 days.

(21) Appl. No.: 16/087,706

(22) PCT Filed: May 22, 2017

(86) PCT No.: PCT/EP2017/062254
§ 371 (c)(1),
(2) Date: Sep. 24, 2018

(87) PCT Pub. No.: WO2017/202762
PCT Pub. Date: Nov. 30, 2017

(65) Prior Publication Data

US 2019/0337749 A1 Nov. 7, 2019

(30) Foreign Application Priority Data

May 25, 2016 (DE) ..... 10 2016 209 116

(51) Int. Cl.
*B65H 29/04* (2006.01)
*B41F 21/00* (2006.01)
(Continued)

(52) U.S. Cl.
CPC ..... *B65H 29/041* (2013.01); *B41F 21/00* (2013.01); *B65H 29/042* (2013.01);
(Continued)

(58) Field of Classification Search
CPC .... B65H 29/04; B65H 29/041; B65H 29/042; B65H 29/044; B65H 29/48; B65H 29/60;
(Continued)

(56) References Cited

U.S. PATENT DOCUMENTS 3,933,352 A * 1/1976 Sinn ..... B65H 29/041 271/189
5,351,946 A 10/1994 Kamoda et al.
(Continued)

FOREIGN PATENT DOCUMENTS

DE 4213032 A1 10/1993
DE 69307840 T2 7/1997
(Continued)

OTHER PUBLICATIONS

International Search Report of PCT/EP2017/062254 dated Oct. 12, 2017.

*Primary Examiner* — Prasad V Gokhale
(74) *Attorney, Agent, or Firm* — Mattingly & Malur, PC

(57) ABSTRACT

A delivery device for a sheet-processing machine, comprises at least one deposition station and a conveyer station, by the use of which, upstream-processed sheets of printed material can be picked up in a transfer location, and can be conveyed through the deposition station via a first conveying system, where they can be deposited optionally to form a stack, or can be conveyed beyond that stack. A holding device, which holds down the uppermost sheet of the stack during the transfer of a sheet to be conveyed against an entrainment or a lifting, is provided with one or with a plurality of holding assemblies which are spaced apart from each other trans-
(Continued)

versely to the transport direction. A sheet-guiding element may be provided, which adjoins the deposition station and which is variable in its vertical position with at least its upstream end by the use of an actuating drive.

16 Claims, 45 Drawing Sheets

(51) Int. Cl.

| | |
|---|---|
| ***B65H 29/24*** | (2006.01) |
| ***B65H 29/60*** | (2006.01) |
| ***B65H 31/10*** | (2006.01) |
| ***B65H 31/24*** | (2006.01) |
| ***B65H 31/26*** | (2006.01) |
| ***B65H 31/32*** | (2006.01) |
| ***B65H 29/48*** | (2006.01) |

(52) U.S. Cl.
CPC ..... *B65H 29/247* (2013.01); *B65H 29/48* (2013.01); *B65H 29/60* (2013.01); *B65H 31/10* (2013.01); *B65H 31/24* (2013.01); *B65H 31/26* (2013.01); *B65H 31/32* (2013.01); *B65H 2301/4461* (2013.01); *B65H 2801/21* (2013.01)

(58) Field of Classification Search
CPC ..... B65H 31/10; B65H 31/24; B65H 31/26; B65H 31/32; B65H 2404/721; B65H 2404/722; B65H 2404/725; B65H 2405/3311
See application file for complete search history.

(56) References Cited

U.S. PATENT DOCUMENTS

| | | | | |
|---|---|---|---|---|
| 7,611,144 | B2 | 11/2009 | Kusaka | |
| 7,726,651 | B2 | 6/2010 | Bottger et al. | |
| 7,850,166 | B2 | 12/2010 | Ichimura | |
| 2005/0006840 | A1 | 1/2005 | Kusaka | |
| 2008/0191404 | A1* | 8/2008 | Ichimura ..... | B65H 29/041 271/10.03 |
| 2008/0191414 | A1 | 8/2008 | Bottger et al. | |
| 2013/0192953 | A1* | 8/2013 | Remijnse ..... | B65H 29/041 198/341.01 |
| 2014/0110313 | A1* | 4/2014 | Allen ..... | B65H 31/06 209/584 |

FOREIGN PATENT DOCUMENTS

| | | | |
|---|---|---|---|
| DE | 19631598 | A1 | 2/1998 |
| DE | 19905263 | C1 | 1/2000 |
| DE | 10205213 | A1 | 10/2002 |
| DE | 10329833 | A1 | 2/2005 |
| DE | 10354673 | A1 | 6/2005 |
| DE | 102008006528 | A | 8/2008 |
| DE | 102008020533 | A1 | 10/2009 |
| DE | 102009027633 | A1 | 4/2010 |
| DE | 102010002772 | A1 | 9/2011 |
| DE | 102012206929 | A1 | 10/2012 |
| EP | 0599219 | A1 | 6/1994 |
| EP | 845431 | A2 | 6/1998 |
| EP | 1489031 | A2 | 12/2004 |
| EP | 1493701 | A1 | 1/2005 |
| EP | 1958906 | A2 | 8/2008 |
| JP | 2517276 | B2 | 7/1996 |
| JP | 2006-036511 | A | 2/2006 |
| WO | 2010/026033 | A1 | 3/2010 |

* cited by examiner a)

b)

a)

b)

DELIVERY DEVICE AND METHOD FOR OPERATING A DELIVERY DEVICE

CROSS REFERENCE TO RELATED APPLICATIONS

This application is the U.S. National Phase, under 35 U.S.C. section 371, of PCT/EP2017/062254, filed May 22, 2017; published as WO 2017/202762A1 on Nov. 30, 2017 and claiming priority to DE 10 2016 209 116.6, filed May 25, 2016, the disclosures of which are expressly incorporated herein in their entireties by reference.

FIELD OF THE INVENTION

The present invention relates to a delivery device and to a method for operating a delivery device. The delivery device is usable with a sheet-processing machine and has at least one delivery station and a conveyer system, by the use of which, substrate sheets that are processed upstream can be received at a transfer point, conveyed via a first conveyer section to the delivery section and either delivered there to a pile or conveyed further beyond that pile.

BACKGROUND OF THE INVENTION

In a section of "Handbuch der Printmedien" (Handbook of Print Media) by Helmut Kipphan, Springer Verlag, 2000, that deals with material and data flow, a dual-stream delivery system, depicted in FIG. 8.1-11 (chapter 8.1), is described as a "highly automated variant of a non-stop delivery system". Dual-stream delivery systems are also described as being usable as "waste diverters" for removing defective or misprinted sheets.

JP 25 17276 B2 discloses a delivery device having two delivery stations, with a guide element being provided between the first and second delivery stations. A stop that can be pivoted into and out of the transport path is provided in the end region.

DE 10 2008 006528 A1 discloses a mechanism for ejecting sheets, in which a sheet to be ejected can be channeled downward out of a guide plane that has blower air openings and is located upstream of the main pile. For this purpose, in one embodiment, a separating rake, which otherwise acts as a continuation of the guide surface, is pivoted into the transport path to channel the sheet downward out of the guide plane onto an auxiliary pile. A guide element adjacent to the diversion point is equipped with blower air openings.

DE 10329833 A1 similarly discloses a sheet guiding device that has an element that can be pivoted downward in order to feed sheets to be discharged as waste sheets onto a waste pile. The sheets are transported by means of grippers, which are opened at the delivery point by means of contact with an opening cam. The cam, which is provided above the waste pile, can be pivoted into and out of the transport path of the gripper opening mechanism. Also provided above the waste pile is a blower system, which acts on the top side of the sheets. A guide surface that adjoins the pivotable part of the guide plane, can be operated with positive or negative pressure by means of a fan.

A brochure detailing the "Rapida 106", which is available on the home page of Koenig & Bauer A G at http://www.kba.com/bogenoffset/bogenoffsetmaschinen/product/rapida-106/detail/, shows on pages 26 and 27 a delivery system in which a Venturi sheet guiding system is used.

DE 10 2012 206929 A1 discloses a sheet brake with a suction belt, which brakes sheets by deceleration of the belt. Once the gripper has opened, the speed is decreased from the gripper carriage speed to a deposition speed. The cam for opening the gripper is displaceable. The drives for the brake elements and for adjusting the gripper cam can be implemented via the press controller.

DE 10 2009 027633 A1 discloses a blower air device having at least one blower air bar extending in the transport direction and having fan elements. The blower air bar can be used to selectively influence the blowing action in the middle region of the incoming sheets. Blower air is preferably applied synchronized with the working cycle of the sheets coming from the printing press.

EP 1958906 A2 relates to a sheet guiding mechanism in a pile delivery system comprising two delivery stations. A blower system comprising a plurality of fans is assigned to the first delivery station. For the operating mode in which a sheet will be guided onto the second pile, the fans on the suction side are covered by the insertion of a shielding plate. The deposition of the sheets in the delivery station is controlled by means of a gripper opening cam, which can be moved into or out of the movement path of the gripper opening mechanism.

DE 103 29 833 A1 discloses a delivery device that has means for forming a waste pile and a good sheet pile, wherein a gripper opening cam above the former pile can be pivoted into and out of the movement path of a gripper bar in order to activate and deactivate sheet release.

DE 10 2008 020533 A1 discloses a blower air device located above a stacking chute of a sheet delivery. Adjustable baffle surfaces of an air guide device can be used to deflect the blower air away from the sheet transport path or to aim the blower air toward the sheet. During operation, the air guide device is positioned by means of a control unit in synchronism with the sequence of sheets such that in front of the sheet leading edge in the transport direction, the guide device is in the closed position, and behind of the sheet leading edge, the guide device is in the open position, that is to say air can pass through it.

DE 693 07 840 T2 discloses a delivery system having a delivery station and a switching unit that effects release and includes a switching cam and a cam follower, which is functionally assigned to a holding element. To adjust the release point, the switching cam is disposed on a base plate, which is mounted so as to move in the transport direction in relation to the press frame. To activate and deactivate the sheet release mechanism, the switching cam is pivoted, via a type of toggle lever mechanism, about a pivot axis provided on the base plate.

DE 103 54 673 A1 discloses a delivery system for forming only one pile, in which the point of sheet release is determined by the point of first contact. When a switching cam is in the first position, sheets are released above the pile. When the switching cam is in the second position, in which first contact occurs later, sheets that are designated for test sheet removal are still guided past pile stops and are not released until they reach a test sheet stop. The point of first contact is adjusted by pivoting the switching cam by means of a drive means embodied as a pneumatic cylinder.

DE 102 05 213 A1 relates to a delivery system having a pile delivery, in which flat printed substrates can be conveyed by means of a gripper system to a delivery, where they can be deposited onto a pile. To eject waste paper or test sheets, a sheet is conveyed past the delivery system and transferred to a suction belt conveyor beyond the delivery system. This transfer is highly sensitive to deviations from the optimum relative position of gripper system and suction belt. To compensate for tolerance deviations, or to enable adjustment to different substrate thicknesses, the suction belt can be moved vertically into different grid positions by means of a spindle drive.

DE 199 05 263 C1 discloses a catching device in a delivery system for test sheets, in which the test sheets are held on sheet supports of the catching device by clamping fingers.

DE 196 31 598 A1 discloses a sheet guiding element in a delivery of a printing machine having blower air openings, which is provided in the transport path upstream of the pile space.

Known from EP 1 489 031 A2 is a sheet guidance system for a dual-pule delivery, in which during conveyance of a sheet beyond the first pile space, a guide rail of a guide device is moved from a point downstream to above the pile space to be bypassed. In this way, the most flutter-free possible transport of the sheet to be conveyed past the pile is achieved.

JP 2006 036511 A also discloses a sheet guidance system, in which a guidance aid can be moved from a point downstream to above a pile space to be bypassed.

EP 0 845 431 A2 related to a non-stop delivery device, in which during a pile change, an auxiliary pile board is inserted from the rear above the pile to be removed. To avoid also displacing the topmost layer of the pile upstream, during insertion of the auxiliary pile board an actuating device is active, controlled by sensors, causing a retaining device to secure the topmost sheet on the main pile.

DE 42 13 032 A2 relates to a device for removing sample sheets, in which to prepare for removal of a sample sheet, an auxiliary stop is placed on the currently topmost sheet of the pile, on which the incoming sample sheet comes to rest and which can be removed once support fingers that support the subsequent sheet have been inserted.

SUMMARY OF THE INVENTION

The object of the present invention is to provide a delivery device and a method for operating a delivery device.

The object is achieved according to the invention by the provision of a holding device, having one or more holding assemblies, which are spaced from one another transversely to the transport direction, and which are usable for holding a topmost sheet of the pile down, thus preventing it from being carried away or lifted off, when a sheet to be conveyed beyond the pile is being conveyed past. A sheet guiding element, which adjoins the first delivery station and at least the upstream which can be varied, in terms of its vertical position, by the use of an actuating drive, is provided. During the transfer of a sheet, which is to be conveyed further, the topmost sheet of the pile is held down from the top by operation of the optionally activatable and deactivable holding device. At least the upstream end of the sheet guiding element, adjoining the delivery station downstream, in the conveying path, is varied, in terms of its vertical position, by operation of the actuating drive.

The advantages to be achieved by the invention are, in particular, that especially trouble-free operation and/or the smoothest possible transport, and/or a high-quality delivery are achieved in a system for delivering sheet-type substrates.

It is particularly advantageous that the malfunctions associated with transferring sheets at the elevated speed can be minimized. These malfunctions may include sheets that have already been delivered being carried away by resulting air flows, and striking an adjoining sheet guiding element at high speed, particularly when the fastest possible start is desired, even if the pile board has not yet been moved to its uppermost position.

In a preferred delivery device for a sheet-processing machine having at least one delivery station and a conveyor system, by means of which substrate sheets processed upstream can be received at a transfer point and conveyed via a first conveyor section to the delivery station, where they can either be deposited onto a pile or conveyed further beyond said pile, a holding device, having one or more holding means spaced apart from one another transversely to the transport direction, is therefore provided for holding the topmost sheet on the pile down to prevent it from being carried away and/or lifted off the pile during the transfer of a sheet to be conveyed beyond the pile. In place of this, or in addition to this in one advantageous variant, a sheet guiding element adjoining the delivery station is provided, at least the upstream end of which can be varied in terms of its vertical position by means of an actuating drive.

With a vertically movable, in particular vertically moved sheet guiding element in the transport path downstream of a first sheet delivery, the risk of damage to a sheet to be transferred is decreased substantially. The smoothest possible transfer is achieved.

With a holding device provided on its own or in addition to the vertically movable sheet guiding element, sheets that have already been delivered are prevented from being carried away, especially when the machine is running at high speeds.

In one preferred embodiment of the delivery device having a conveyor system, by means of which a substrate sheet can be received at a transfer point and can be conveyed downstream to a delivery station comprising a pile space, where said sheet can either be delivered by the conveyor system to a pile to be formed or can be conveyed further downstream, and having a sheet guiding element adjoining the delivery station, via which a substrate sheet to be conveyed further downstream beyond the delivery station by the conveyor system can be guided during its transport, at least the upstream end of a sheet guiding element adjoining the delivery station can be varied in terms of its vertical position by means of an actuating drive.

In the operation of such a delivery device, the vertical position of at least the upstream end of the sheet guiding element that adjoins the delivery station is varied by means of an actuating drive.

On its own or in conjunction with at least one aforementioned advantageous variant of a delivery device, a sheet guiding device for a sheet processing machine having at least one delivery station and a conveyor system that includes, e.g. one conveying means, by means of which substrate sheets that have been processed upstream can be conveyed to the delivery station, where they can either be deposited onto a pile or conveyed further beyond said pile, in particular by the same conveying means, wherein in the region of a downstream end of the delivery station, a stop device having one or more stop means, spaced from one another transversely to the transport direction, is provided, which stop means can be moved, with a stop surface pointing in the direction of the approaching substrate sheets, by means of at least one drive means, either into an active position, in which it is (they are) moved into a movement path of the approaching substrate sheets and act(s) as a stop in the region of a stop surface, or into an inactive position, in which it is (they are) positioned outside of the movement path of the substrate sheets, and is (are) not operative. A holding means which is positively carried along when the stop means is moved, and which protrudes beyond the stop surface upstream and/or in the direction of the approaching substrate sheets and/or protrudes beyond the downstream edge of the pile 11 to be formed, at least when the stop means is in an inactive position, is assigned to the one or more movable stop means and, when the stop means is in the inactive position, the holding means holds the topmost substrate sheet back, in the region of its downstream edge, to prevent it from being lifted off and carried away by substrate sheets to be transferred. During operation, when the stop means is moved from its active to its inactive position, a holding means is moved from an inactive position to a holding position, in which it comes to rest above the downstream edge of the topmost sheet on the pile, to hold said sheet back from being lifted off and carried away by substrate sheets that will be conveyed beyond said pile.

Accordingly, in the preferred operation of a delivery device that comprises a conveyor system by means of which a substrate sheet (B) is conveyed downstream to a delivery station, where it is either delivered by the conveyor system to a pile to be formed there or is conveyed further downstream beyond the pile by the conveyor system, during the transfer of a sheet to be conveyed further downstream, the topmost sheet of the pile is held down from the top by a holding device that can be activated and deactivated, and/or the vertical position of at least the upstream end of a sheet guiding element that adjoins the delivery station downstream in the conveyance path is varied by means of an actuating drive.

In the region of a downstream end of the delivery station, a stop device is provided, having one or more stop means spaced from one another transversely to the transport direction, which is (are) moved by means of at least one drive means, with a stop surface pointing in the direction of the approaching substrate sheets, either into an active position, in which it is (they are) moved into a movement path of the approaching substrate sheets and act(s) as a stop in the region of a stop surface, or into an inactive position, in which it is (they are) positioned outside of the movement path of the substrate sheets (B) and is (are) not operative. In an advantageous embodiment, while a sheet is being held down, when the stop means is moved from its active position to its inactive position, a holding means is moved from an inactive position to a holding position, in which it protrudes in an upstream direction above the stop surface, comes to rest above the downstream end of the topmost sheet on the pile, and holds said sheet back from being lifted off and carried away by substrate sheets to be transferred and/or at least impedes such lifting/carrying.

Particularly in cases in which a substrate sheet can be received by the conveyor system at the transfer point and conveyed downstream to the first delivery station comprising the first pile space, where it is either delivered by the conveyor system to the pile to be formed there or is conveyed further by the conveyor system, via the sheet guiding element adjoining the first delivery station downstream, by means of the conveyor system, to a second delivery station comprising a second pile space, the vertical position of at least the upstream end of the sheet guiding element adjoining the first delivery station in the guidance path to the second pile space is varied as needed by means of the actuating drive. This is carried out in particular during the phase in which a pile board has not yet been moved to the desired upper position and/or in which the pile is still at a very low pile height.

The advantageous embodiments, variants, and methods thus far described are of particular advantage, on their own or in combination with one another, in terms of a particularly trouble-free operation, and/or the smoothest possible transport, and/or a high-quality delivery. The features of the described embodiments may be combined with one another and with one or more additional features of the following embodiment examples as advantageous refinements.

BRIEF DESCRIPTION OF THE DRAWINGS

Exemplary embodiments of the invention are illustrated in the set of drawings and will be specified in greater detail in the following.

The drawings show.

DESCRIPTION OF PREFERRED EMBODIMENTS

Figure 1:
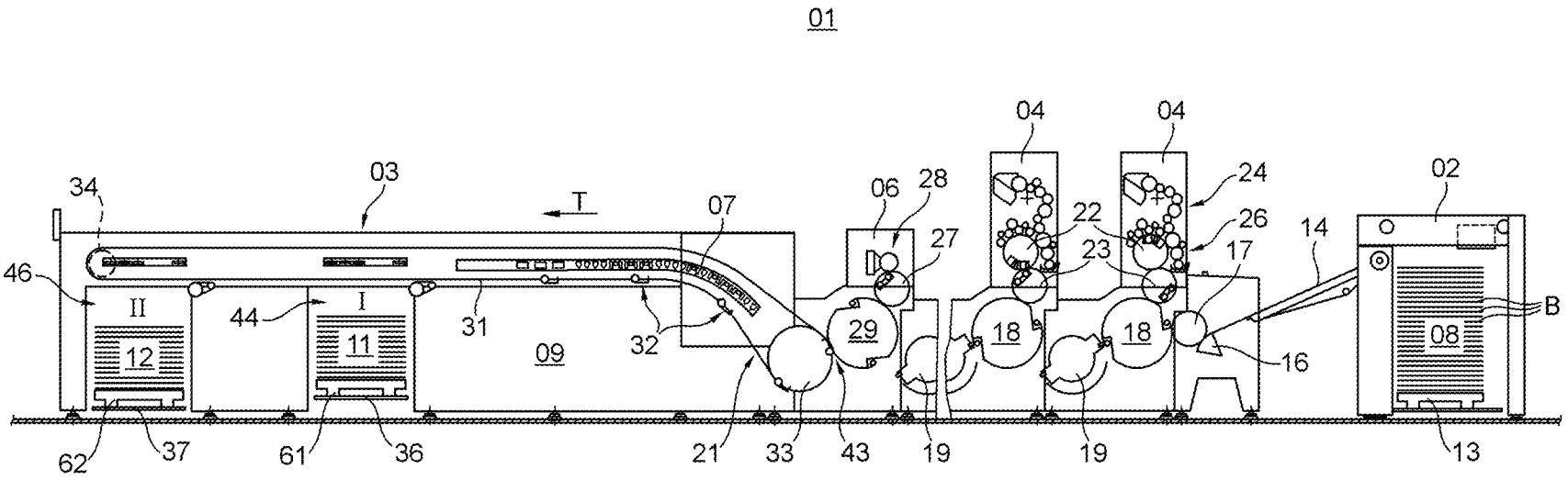
FIG. 1 a schematic side view of a machine for handling and/or processing sheet-type substrates.

A machine 01 for handling and/or processing a sheet-type printing material B as substrate B comprises one or more processing stages 04; 06; 07 for handling and/or processing an infed substrate B between an infeed system 02 and a delivery system 03, in particular in-line, i.e. in the same uninterrupted stream of material. As at least one processing stage, one or more processing stages for imprinting and/or conditioning without contact and/or mechanically handling the substrate, e.g. one or more printing units 04; 06 and/or one or more drying systems 07 and/or one or more cutting and/or die cutting units, not described in greater detail here, can be provided in the substrate path between infeed device 02 and delivery system 03. However, at least one or preferably a plurality of printing units 04; 06 are preferably provided as at least one processing stage 04; 06. In addition, one or more of the aforementioned units, e.g. a drying system 07 disposed downstream of the printing units 04; 06, can be located in the substrate path of the machine 01, which is preferably embodied as a printing press 01 (see, e.g. FIG. 1).

The term "sheet" is understood here, for example, to mean any type of generally flat substrate B in the form of isolated sections of material, which, rather than being guided through all the processing stages 04; 06; 07 of the press 01 simultaneously, as is the case with web-type substrate, have a limited section length, so that said sections pass through and exit a first processing stage 04; 06 before coming into operative contact with a last of the processing stages 04; 06; 07. In particular, these are flat and preferably rectangular substrate sheets B, which may be made, for example, of paperboard, cardboard, plastic, metal or a composite of a plurality of said materials. The term "flat" is understood to mean, for example, that the length and the width of each substrate sheet B corresponds to at least 50 times, advantageously at least 150 times, in particular at least 1,000 times, or even more than 20,000 times the thickness of the sheet.

Input side infeed system 02, also referred to as sheet feeder 02, for example, supplies or is intended to supply sheet-type substrate B, preferably in the form of piles 08, for infeed into the press 01. In or on output-side delivery system 03, also referred to as delivery device 03, substrate B that has been processed in press 01 and has passed through the processing stages 04; 06; 07 provided in the substrate path, is placed in piles 11;12 for pickup, e.g. for removal or for further transport. Delivery system 03, also referred to as delivery device 03 or product delivery device 03, is preferably embodied here as a multi-pile delivery 03, in particular as a dual-pile delivery 03, and for this purpose comprises at least two delivery stations, also referred to here as deliveries I; II or pile deliveries I; II, arranged one behind the other in the transport path.

Sheet feeder 02, or feeder 02, which is disposed upstream of the first processing stage 04, 06, picks up a sheet pile 08 that has been placed on a pile pallet 13, for example, as a substrate container. The sheet feeder preferably comprises sheet separating elements and sheet transport elements (not shown in detail), embodied, for example, as separating suckers and as transport suckers. To avoid stopping the press 01 during sheet pile changes, i.e. while the feeder 02 is being reloaded with a new sheet pile, feeder 02 is preferably equipped with a non-stop system (not shown here). This non-stop system is equipped, e.g. with an auxiliary pile carrier, embodied, in particular, as a rake, a roller rack, or a pallet, which can be transported into the pile input area of feeder 02 and is disposed on a slide-in unit.

Feeder 02 is followed downstream, for example, by a conveyor section 14 embodied, e.g. as a belt feed table, in particular as a suction-belt feed table.

In the substrate path downstream of sheet feeder 02, an alignment system 16 referred to, for example, as infeed 16 or sheet infeed 16, is disposed upstream of the first processing stage 04; 06. Sheet infeed 16 preferably comprises a feed table, wherein during the operating cycle of the substrate sheets that will be fed in, stops, referred to, e.g. as front lay marks, in particular forward stops, are guided into the travel path of said sheets for the alignment thereof. Substrate sheets B, the front edge and where applicable also a side edge of which have been aligned, are then fed to a conveying means 17 also referred to, e.g. as feed drum 17, more particularly as transfer drum 17.

Feed drum 17 transfers the substrate sheets B coming from conveyor line 14, directly or where applicable via one or more additional transfer drums, to a conveying means 18 of the first processing stage 04, which is used for the transfer and/or as an abutment and is preferably embodied as transfer cylinder 18.

The at least one printing unit 04; 06, which is part of printing press 01, more particularly of sheet-fed printing press 01, is preferably embodied as a printing unit 04; 06 that imprints substrate B in a rotary printing process. Printing unit or units 04; 06 can imprint each substrate B, at least on one side, one or more times with a printing fluid, e.g. a printing ink or a coating, applied by the printing unit 04, 06. An advantageous embodiment of printing press 01 described here comprises a plurality of printing units 04 of the same type, in particular offset printing units 04, by means of which each substrate B can be imprinted with printing ink. In an advantageous refinement illustrated, e.g. in FIG. 1, at least one printing unit 06 of an additional type may be provided. This unit can be embodied, for example, as a printing unit 06 that applies a coating to at least one side of substrate B as it passes through, also referred to as a coating printing unit 06, for example. The latter printing unit 06 may be embodied in the manner of a printing unit 06 that operates using a letterpress process, e.g. as a letterpress printing unit 06, more particularly as a flexo printing unit 06.

In place of the printing units 04 embodied, e.g. as offset printing units 04, and/or the letterpress printing unit 06, or in addition to one or more printing units 04 embodied as offset printing units 04 and/or the letterpress printing unit 06, one or more printing units that operate using printing processes other than these, e.g. one or more printing units that operate using a gravure printing process and/or one or more printing units that operate using a screen printing process, and/or one or more printing units that operate using a non-impact process, e.g. a digital printing process, in particular the inkjet printing process, may also be provided in the substrate path to be traversed inline between infeed device 02 and delivery system 03.

In the advantageous embodiment of one or preferably of multiple printing units 04 as offset printing units 04, each printing unit 04 comprises, e.g. in the region of a printing unit superstructure, one printing unit cylinder 22 embodied in particular as a forme cylinder 22, e.g. as a plate cylinder 22, and one printing unit cylinder 23 embodied in particular as a transfer cylinder 23, e.g. as a blanket cylinder 23. Printing unit 04 further comprises, e.g. in the region of a printing unit substructure, a printing unit cylinder 18 embodied as a printing cylinder 18 or impression cylinder 18, which can also act as a transfer cylinder, performing the function of the aforementioned conveying means 18. In addition, printing unit 04 can comprise, e.g. in the region of the printing unit substructure, an aforementioned conveying drum 19, also referred to as transfer drum 19. To supply pressurized fluid to forme cylinder 22, said cylinder cooperates upstream with a corresponding application system 24, e.g. an inking unit 24, and if the offset printing unit 04 operates using the wet offset method, also with a dampening unit 26.

In an advantageous refinement of printing press 01 having a coating printing unit 06 configured, e.g. as a flexo printing unit 06, said printing unit comprises, for example, a printing unit cylinder 27 embodied as a coating forme cylinder 27, on which a transfer means embodied, e.g. as a coating blanket or coating plate is mounted, e.g. clamped, via a mounting system, e.g. a clamping and/or chucking system. To apply the coating to the coating blanket, for example in the form of a rubber blanket, or to the coating plate, an application system 28, preferably embodied here as a chamber blade system 28 and preferably comprising an inking unit roller, in particular an anilox roller, which has a saucer structure on its lateral surface, and a chamber blade, is used. Coating forme cylinder 27 cooperates with a printing unit cylinder 29, disposed downstream with respect to the fluid flow and embodied as printing cylinder 29 or impression cylinder 29, which at the same time can act as a transfer cylinder, performing the function of the aforementioned conveying means 29.

Once processing or printing in one or more processing stages 04; 07 has been completed, the processed sheet B is conveyed downstream to delivery system 03, optionally via one or more intermediately disposed conveying means 19, e.g. embodied as transfer drums 19, and/or other transport routes situated downstream. For this purpose, the processed substrate sheet B is delivered to a conveying means 31 of a conveyor system 21 that conveys sheet B to one of the delivery stations I; II. This conveyor system 21, which extends to at least just beyond the delivery stations I; II, is understood here as a part of delivery system 03 or delivery device 03 and is conceptually included therein. Preferably, sheets B to be conveyed further downstream beyond the first delivery station I, in particular to the second delivery station II, are conveyed further without any change in the conveying means 31 or the conveyor system 21, i.e. without being intermediately released and picked up again.

On the path between the last processing stage 04; 06 that prints onto substrate B and the sole or preferably the first of a plurality of delivery stations I; II in the transport direction, a transport section 09, e.g. an extended delivery 09, which is expressly provided or is preferably considered structurally to be part of delivery system 03 may be provided, which lengthens the transport path and thus also the transport time that is required for drying, for example. On this extended delivery, one or more drying systems 07, e.g. one or more dryers 07, embodied, for example, as radiation dryers 07, preferably as IR or UV dryers, may be provided.

Thus, downstream of the last printing stage 04; 06, and where applicable, downstream of one or more further processing stages and/or conveyor lines, delivery to the conveyor system 21 occurs, e.g. also referred to as sheet conveyor system 21, which conveys the processed substrate sheets B to delivery device 03 or to one of the delivery stations I; II, e.g. deliveries I; II, that make up the delivery device 03. Said conveyor system is preferably embodied as a drawing conveyor system 21 with a revolving drawing means 31 as conveying means 31 and with a plurality of holding devices 32 arranged on and along the drawing means 31. Holding devices 32, which are embodied, in particular, as switchable, can pick up substrate sheets B coming from the at least one processing stage 04; 06, where they have been processed, in particular printed, on at least one side, and can transport these in the active or holding state to one of the delivery stations I; II, where they can release the sheets again. In principle, switching means 141 of a switching device 141, 142 for bringing about a change between an active and an inactive or released switching state can be implemented in any desired manner, by electronic or mechanical means. For example, actuators that are carried along with conveyor system 21 or holding device 32 and are used for switching holding device 32 could be actuable electronically via corresponding control means. In an embodiment that is preferred here, the switching is carried out by means of an appropriately configured mechanism, e.g. an appropriately configured mechanical switching means 141. Where appropriate, this switching device or the switching means can be adjusted and/or activated via electronically actuable and/or switchable drive means 146; 147.

Figure 30:
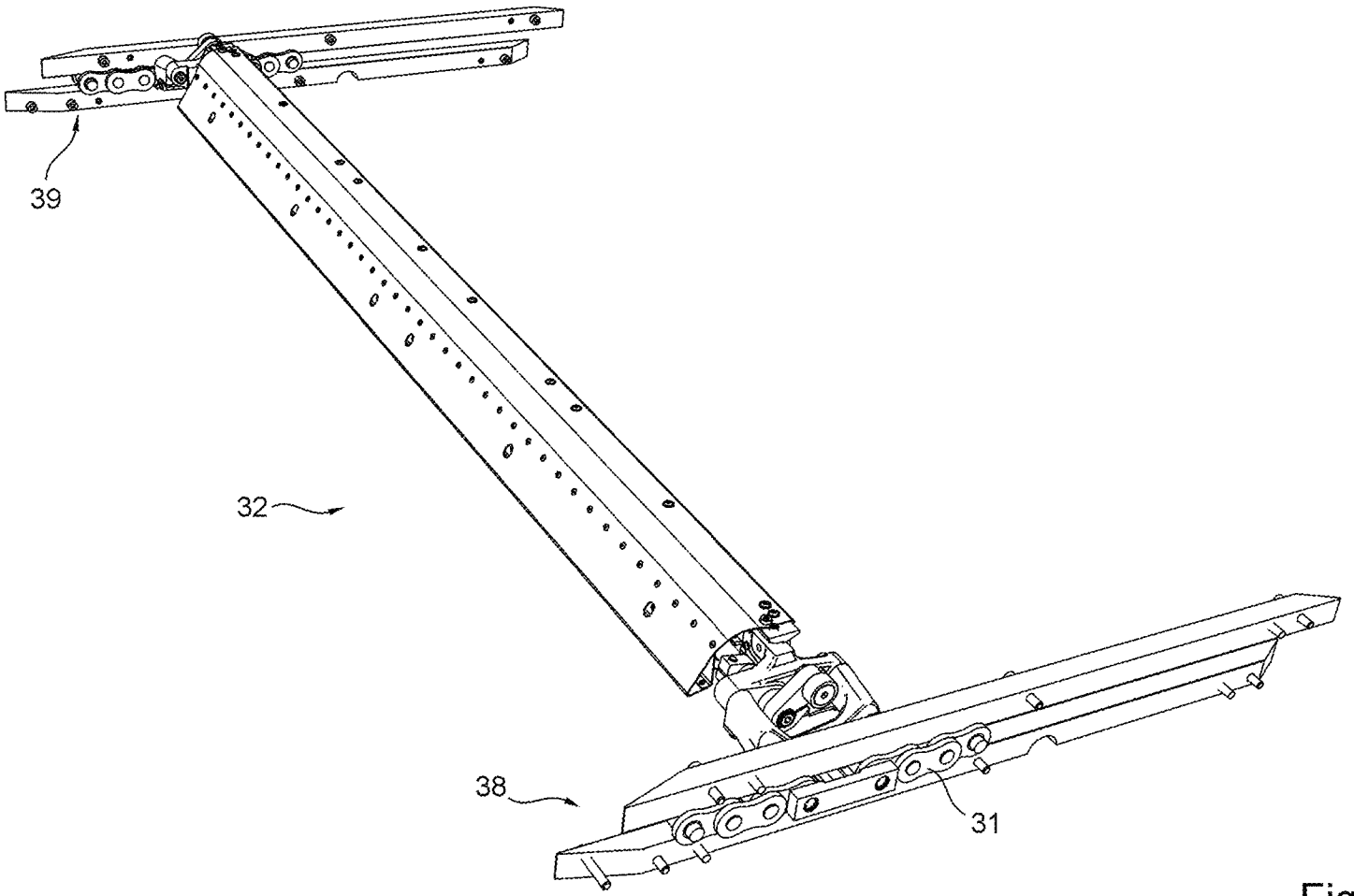
FIG. 30 an oblique view of a gripper carriage guided in guide rails.
Figure 31:
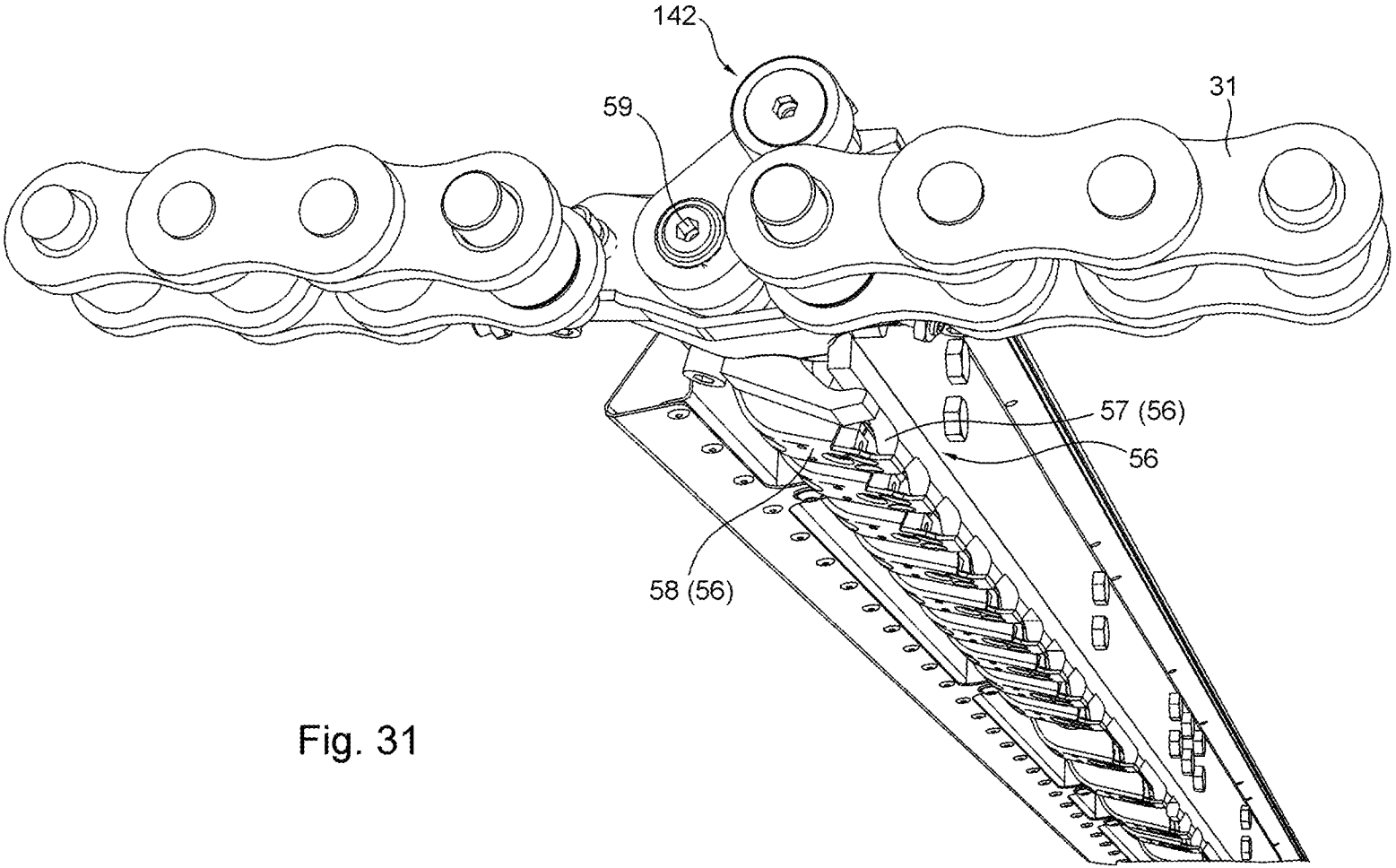
FIG. 31 an oblique view of a laterally open gripper carriage connection.
Figure 32:
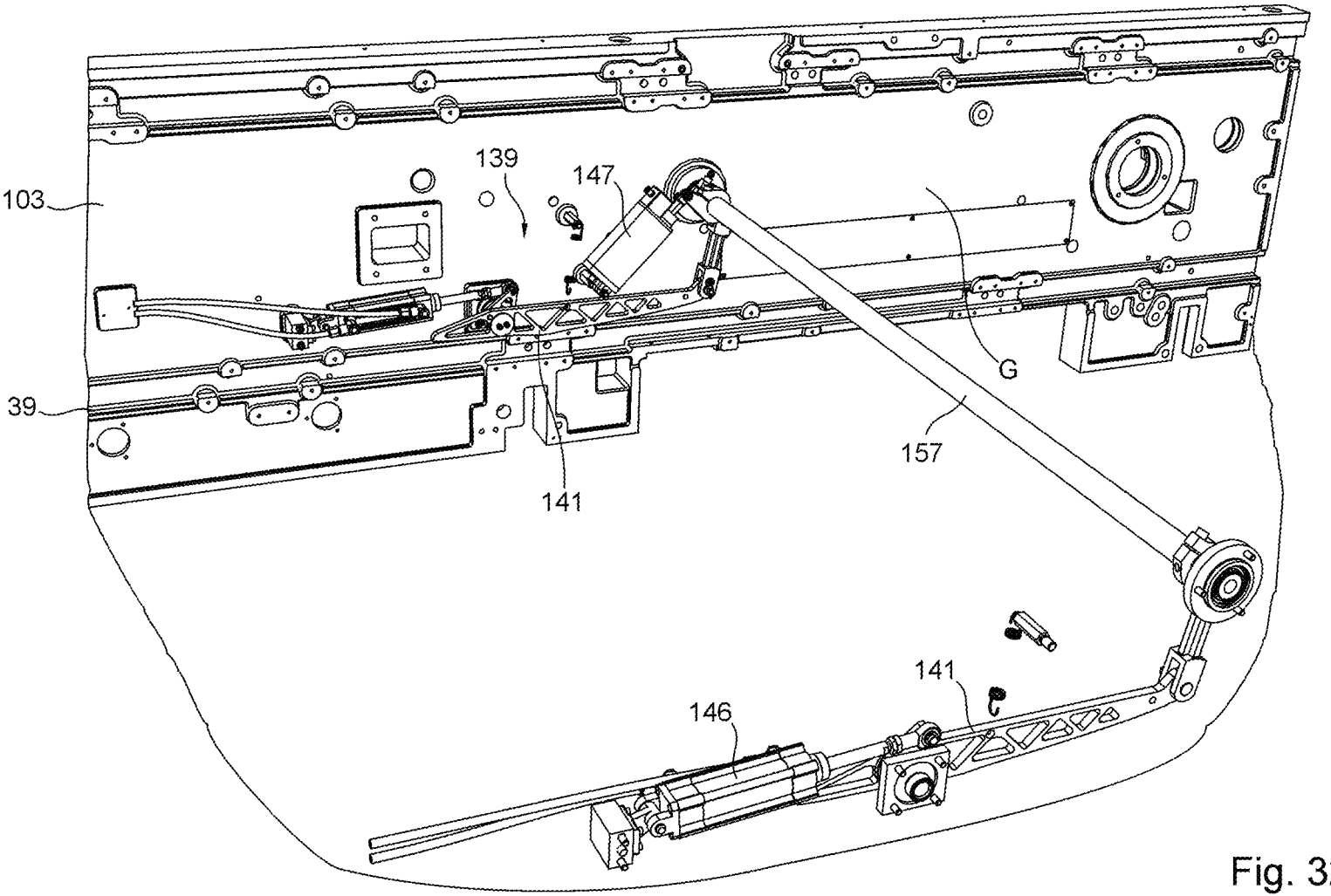
FIG. 32 an oblique view of a switching device that controls the deposition of substrate sheets.
Figure 33:
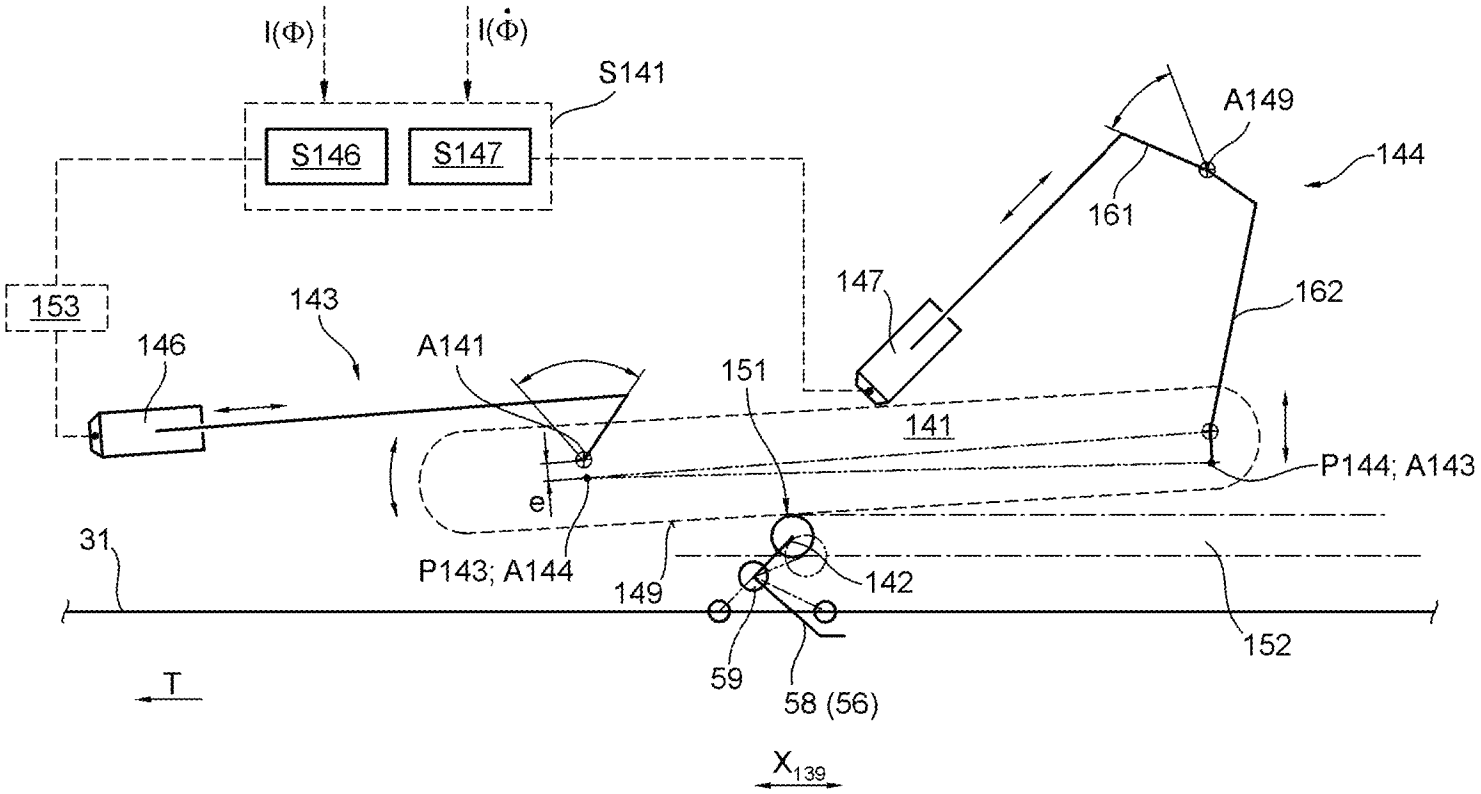
FIG. 33 a diagram illustrating the basic functionality of a switching device that controls the deposition of substrate sheets.
Figure 34:
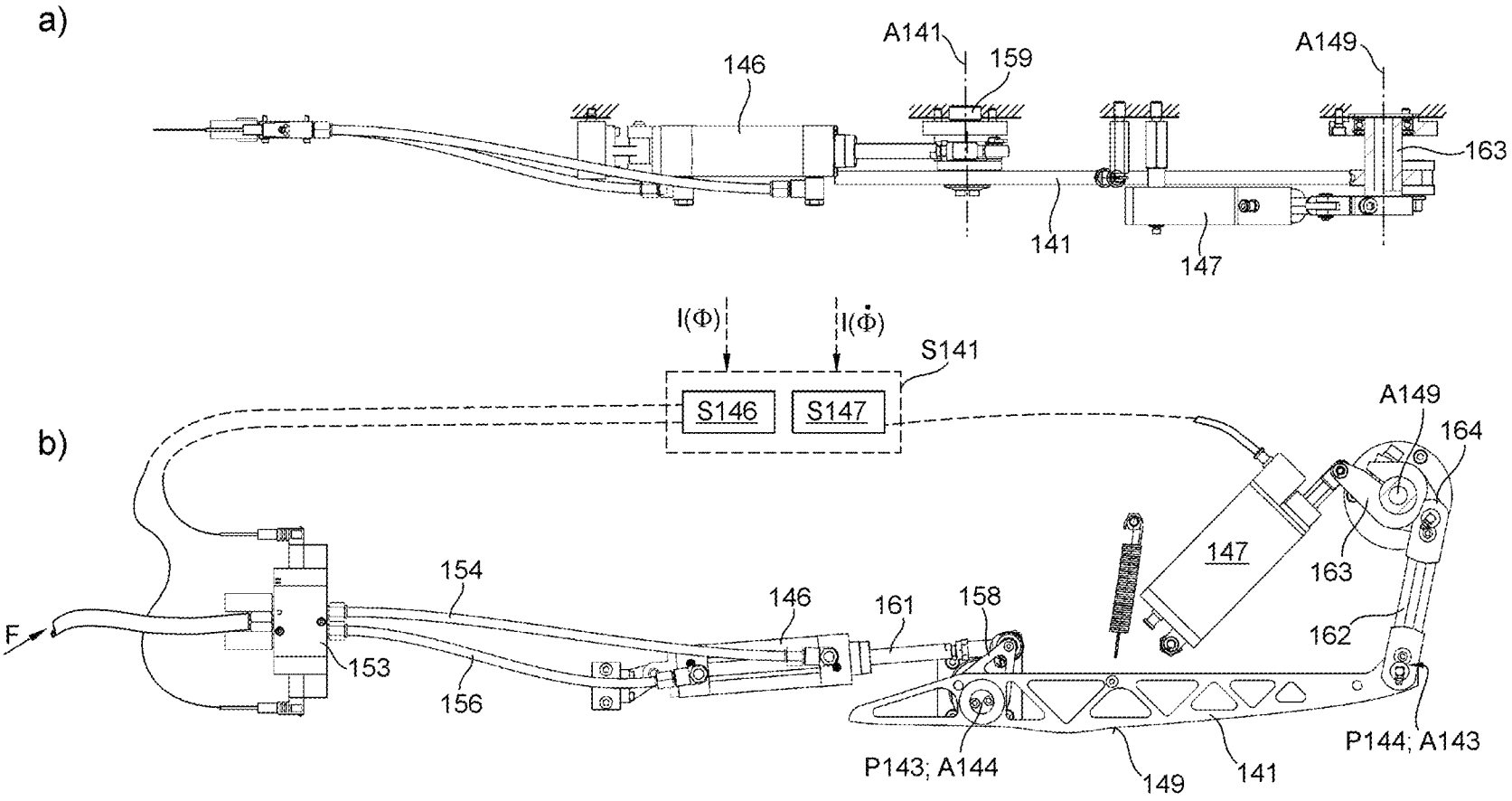
FIG. 34 an advantageous embodiment of a switching device that controls the deposition of substrate sheets, from a) a plan view and b) a side view.
Figure 35:
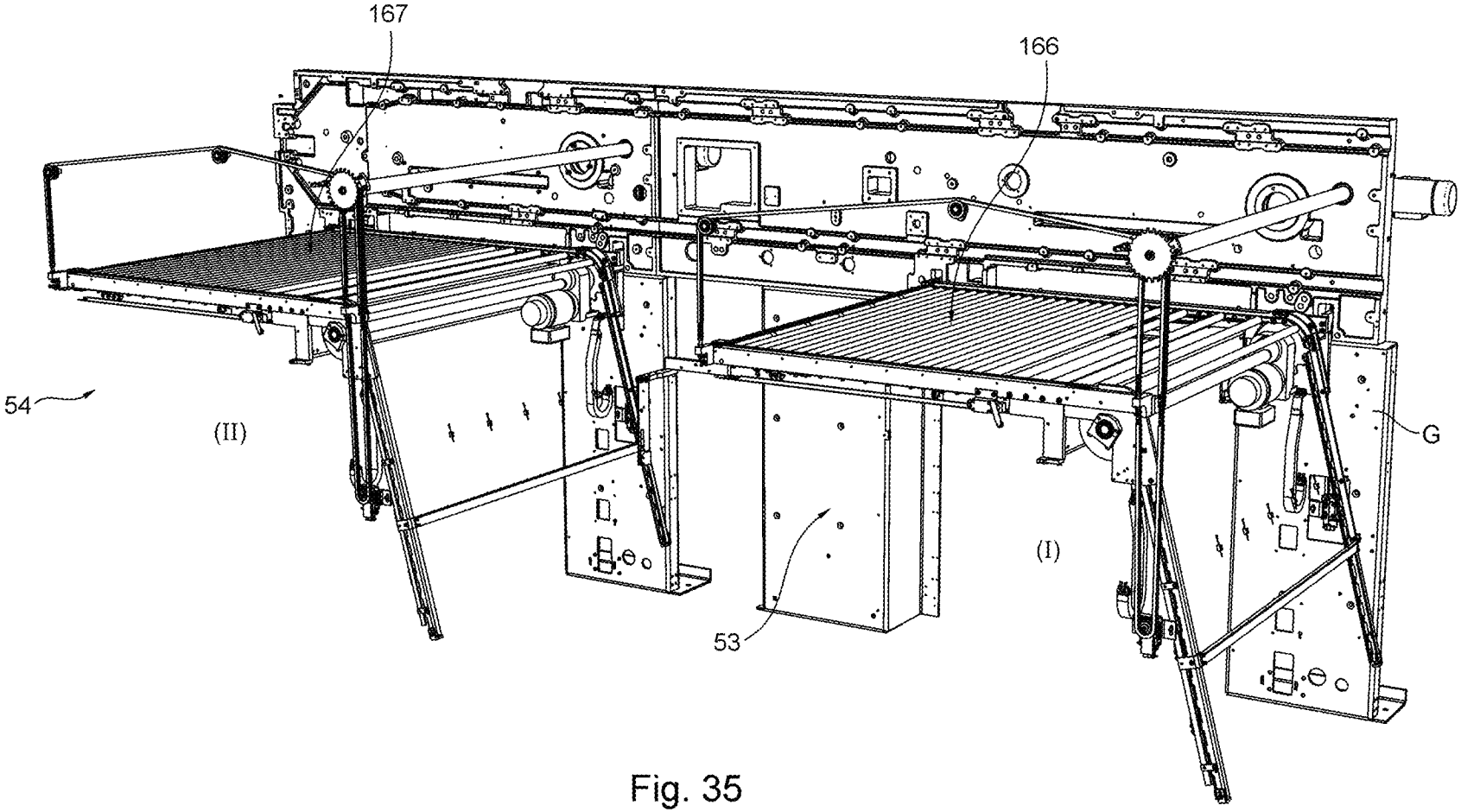
FIG. 35 an open, oblique view of a delivery device comprising two delivery stations, each having a non-stop pile changing system.

Conveyor system 21, embodied here as chain conveyor system 21, preferably comprises a chain 31 as revolving drawing means 31, which can be guided and driven via drive and/or guide wheels 33; 34, embodied, e.g. as sprockets 33; 34. Holding devices 32 are embodied in this case as gripper carriages 32, which are preferably mounted on both sides on respective chains 31, which are guided laterally in guide rails 38; 39 (see, e.g. FIG. 2). Gripper carriages 32 guide the sheets B in sheet transport direction T to the delivery stations I; II and/or above the respective delivery pile 11; 12. Delivery pile 11; 12 can be or is formed indirectly or directly on a vertically movable device 36; 37, e.g. support device 36; 37, i.e. directly on support device 36; 37 or on a loading means 61; 62 that is held by support device 36; 37. Support device 36; 37 can be a stacking board 36; 37 known as a pile board 36; 37. The optionally provided loading means may be in the form of a pallet 61; 62, for example, or some other kind of base for transport. Gripper carriages 32 preferably include one or more holding elements 56, e.g. grippers 56, in particular leading-edge clamping grippers 56, which are composed of gripper fingers 58 that cooperate with gripper pads 57, and which are arranged spaced from one another along a gripper shaft 59, by which they can be controlled (see, e.g. reference below to FIG. 30 and FIG. 31).

Conveyor system 21 can convey sheets B along a first conveyor line section 41, or conveyor section 41, between a transfer point 43, where sheets B are picked up by conveyor system 21 from the conveyor line upstream, and a first delivery point, i.e. a pile space 44 of the first delivery station I, where sheet B may be deposited in the area of the first delivery station I; II. This first conveyor section 41 is followed by a second conveyor section 42, via which a sheet B that is not deposited in the area of the first delivery station I; II can be further to a second delivery point, i.e. to a pile space 46 of the second delivery station II. If an additional delivery station is provided downstream, the second delivery station II is configured such that a sheet B that is conveyed via the second conveyor line section 42 can optionally be deposited in the area of the second delivery station II. Preferably, however, delivery of sheet B in the area of the last—in this case the second—delivery station II is forced during production operation by appropriately configured means. This may involve delivery to the corresponding last pile 12 or delivery into a removal line, at the end of which a sheet B may be removed for sampling.

For the smooth and/or safe transport of sheets B conveyed by conveyor system 21 and held by gripper carriages 32, an advantageous embodiment of delivery device 03 comprises a sheet guiding device 47 for guiding the sheets B. For this purpose, in at least one of conveyor line sections 41; 42, preferably in both the input-side conveyor line section 41; 42 and the conveyor line section lying between the delivery stations I; II, on at least one conveyor line subsection, a sheet guiding element 47.1; 47.2; 47.3; 47.4; 47.5; 47.6; 47.7; 47.8 that serves as a guide for the sheet B to be transported is provided. Preferably, one or more of such sheet guiding elements 47.1; 47.2; 47.3; 47.4; 47.5; 47.6; 47.7; 47.8 are provided in each of the two conveyor line sections 41; 42.

In each of the two conveyor line sections 41; 42, a device 48; 49 for braking the substrate sheet B, e.g., a deceleration device, or more particularly, a braking system 48; 49, is preferably disposed upstream of the respective delivery station I; II. In an especially advantageous embodiment, particularly in terms of the realization of higher production speeds, a system 51; 52, in particular which operates or can operate using blower air, and which assists in pile formation, is assigned to all the delivery stations I; II or at least to the or each of the delivery stations other than the last delivery station downstream, i.e. in this case at least the first delivery station I, said system preferably comprising means that are or can be operated using blower air for forcing down and/or holding down, in a controlled manner, substrate sheets B that will be or already have been deposited on the pile 11; 12 in question. Said system can be embodied, in particular, as a blower frame 51; 52 and/or can be located above the transport path for the substrate sheets B to be conveyed, and/or the horizontal extension of said system, with respect to the active means thereof, can overlap, at least partially, more particularly mostly, with the horizontal extension of the pile 11; 12 to be formed. In place of or in addition to said system, a system 53; 54 that enables an interruption-free pile change, or a non-stop pile changing system 53; 54, may be assigned to all of the delivery I; II, or to at least one delivery station or the delivery station other than the last delivery station downstream, in this case at least the first delivery station I. In principle, in a first alternative embodiment, one system 53 of this type could be assigned to two delivery stations I; II that are adjacent to one another in the transport path, with said system being arranged, for example, in the region between the two delivery stations I; II and performing its function on both sides. Preferably, however, pile changing systems 53; 54 that, in particular, are operated independently of one another and will be described in greater detail below are provided (see, e.g. FIG. 2).

The aforementioned systems 36; 37; 48; 49; 51; 52; 53; 54, e.g. one or more systems 36; 37 for supporting the pile 11, 12 and/or one or more braking systems 48; 49 and/or one or more systems 51; 52 for assisting with pile formation, e.g. blower systems 51; 52, and/or one or more systems 53; 54 that enable non-stop pile changes, can be provided on their own or in combination with one or more systems 48; 49; 51; 52; 53; 54 that have another function, and/or can each be configured in one of the embodiments described in greater detail below.

The pile 11; 12 of substrate sheets B that is formed in each delivery station I; II and is formed directly or indirectly on the support system 36; 37 can be removed, for example upon completion or when otherwise initiated, and can be transported, e.g. to a further processing stage or to a warehouse.

Figure 4:
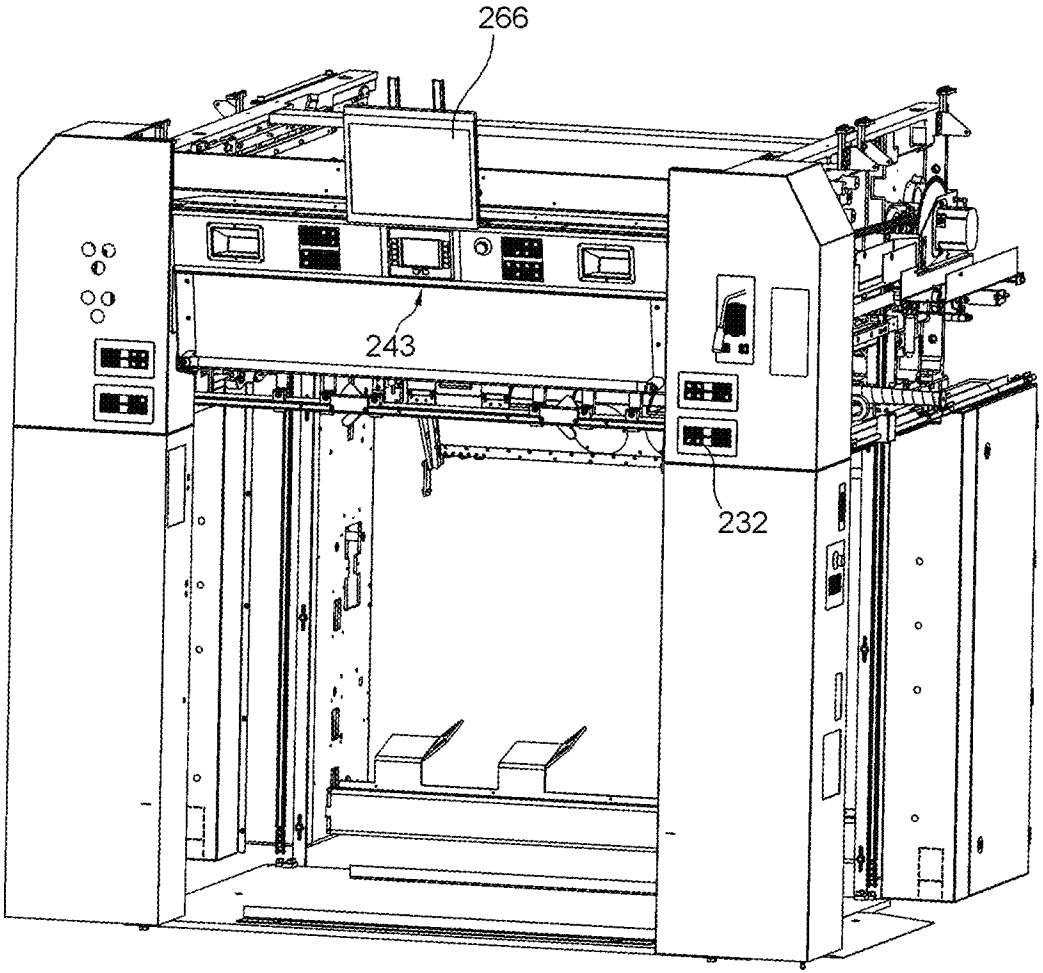
FIG. 4 a rear end-face view of the delivery device.

At one end of delivery system 03, at least one display device 266 specified in greater detail below, e.g. a monitor 266, in particular a flat-screen monitor measuring at least 15-inches on the image diagonal, and/or at least one user interface 232; 253 specified in greater detail below, e.g. at least one control field 232; 253, can be provided (see, e.g. FIG. 2 or FIG. 4).

As an alternative to the above, or preferably in addition to a control and/or monitoring console located on the end face and comprising at least one monitor 266 and/or at least one user interface 232; 253, at least one user interface 66; 67, e.g. control field 66; 67, can be provided for each delivery station I; II and can be configured such that on said user interface, press operators can control and/or initiate specific basic functions relating, for example, to a movement of the designated support system 36; 37 and/or a non-stop change. User interface 66; 67 is preferably disposed on a longitudinal side of delivery system 03 in such a way as to allow the interface to be operated, while at the same time enabling a view into the affected delivery station I; II (see, e.g. FIG. 2).

Provided in the following is a description of embodiments and variants of the advantageous configuration of the delivery system 03 and/or the integration thereof, advantageous configurations of individual functional groups, and advantageous embodiments of specific details. Each of the embodiments is advantageous on its own, or—unless obviously contradicted—in any combination for the embodiment of a delivery system 03 and/or the connection thereof to a processing line of a printing press 01 and/or to a pile transport system 56.

Figure 5:
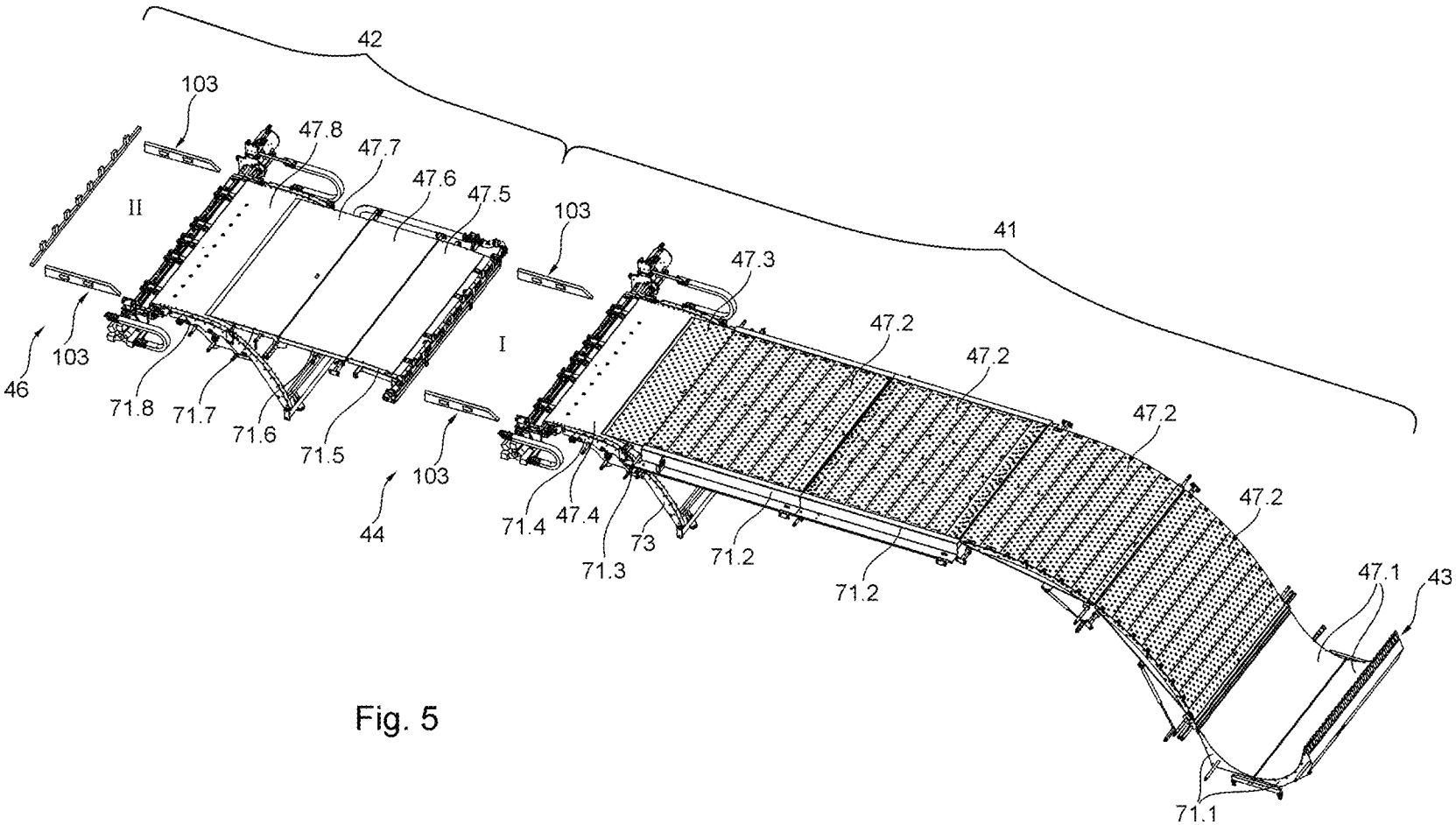
FIG. 5 a perspective view of a sheet guiding device which is part of the delivery device.
Figure 6:
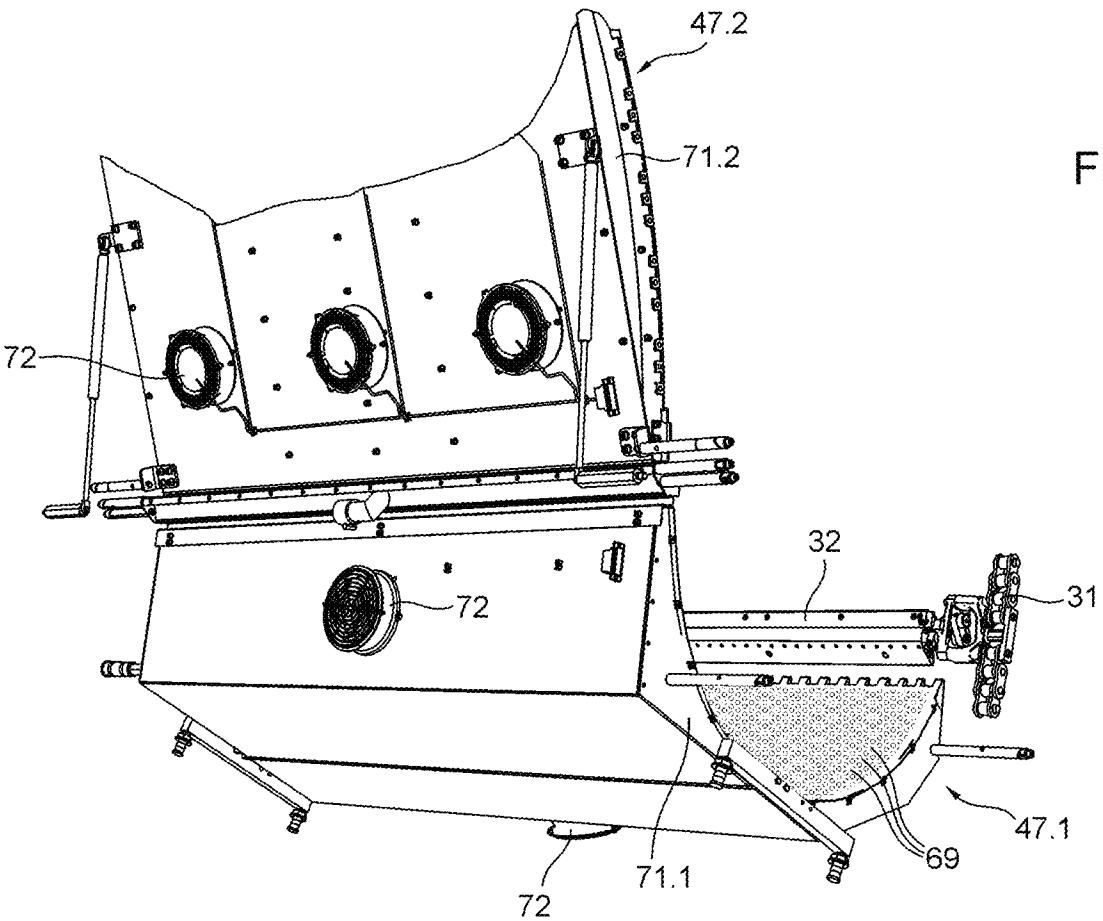
FIG. 6 an upstream intake region of the sheet guiding device.

In a preferred embodiment of sheet guiding device 47, in the first and/or second conveyor path section 41; 42, one or more sheet guiding elements 47.1; 47.2; 47.3; 47.4; 47.5; 47.6; 47.7; 47.8 are provided, which are preferably embodied as sheet guide plates 47.1; 47.2; 47.3; 47.4; 47.5; 47.6; 47.7; 47.8 that face gripper carriages 32 (see, e.g. FIG. 5). In a technically less complex embodiment, these elements have a friction-reducing surface, for example coated with chromium or plastic, on the side facing the gripper carriage 32.

Alternatively or in addition to this, however, these elements include air passage openings 68; 69 on the optionally coated side that faces gripper carriage 32. Sheet guide plates 47.1; 47.2; 47.3; 47.4; 47.5; 47.6; 47.7; 47.8 preferably extend transversely to the transport direction, at least over a width that corresponds to the maximum width of the substrate. On the side of sheet guide plates 47.1; 47.2; 47.3; 47.4; 47.5; 47.6; 47.7; 47.8, or a portion thereof, that faces away from gripper carriage 32, one or more air modules 71.1; 71.2; 71.3; 71.4; 71.5; 71.6; 71.7; 71.8 are provided, into which air passage openings 68; 69 lead. Air modules 71.1; 71.2; 71.3; 71.4; 71.5; 71.6; 71.7; 71.8 that are assigned to a plurality of sheet guide plates 47.1; 47.2; 47.3; 47.4; 47.5; 47.6; 47.7; 47.8, and/or sheet guide plates 47.1; 47.2; 47.3; 47.4; 47.5; 47.6; 47.7; 47.8 that are assigned to a plurality of air modules 71.1; 71.2; 71.3; 71.4; 71.5; 71.6; 71.7; 71.8, and/or sheet guide plates 47.1; 47.2; 47.3; 47.4; 47.5; 47.6; 47.7; 47.8 and air modules 71.1; 71.2; 71.3; 71.4; 71.5; 71.6; 71.7; 71.8 that are in a one-to-one relationship with one another may be provided. Some or all of sheet guide plates 47.1; 47.2; 47.3; 47.4; 47.5; 47.6; 47.7; 47.8 may involve and be embodied as merely having an additional function.

In a first embodiment, the air passage openings 68 of one, some, or all of sheet guide plates 47.1; 47.2; 47.3; 47.4; 47.5; 47.6; 47.7; 47.8 are embodied and operated as suction openings 52, in which the air module 71.1; 71.2; 71.3; 71.4; 7 in question is intended to be, is, or can be pressurized at a pressure that is below the ambient pressure, i.e. a negative pressure. The suction air suctions sheet B onto the associated sheet guide plate 47.1; 47.2; 47.3; 47.4; 47.5; 47.6; 47.7; 47.8 as it is being transported by gripper carriage 32. A flutter-free and accurately guided transport of sheet B is thereby achieved.

In a second embodiment of one, some, or all of sheet guiding elements 47.1; 47.2; 47.3; 47.4; 47.5; 47.6; 47.7; 47.8, the air passage openings 69 are embodied or operated as blower air openings 69, in which the air module 71.1; 71.2; 71.3; 71.4; 71.5; 71.6; 71.7; 71.8 in question is intended to be, is, or can be pressurized at a pressure that is above the ambient pressure, i.e. a positive pressure. The blower air forms a supporting air cushion between the sheet guide plate 47.1; 47.2; 47.3; 47.4; 47.5; 47.6; 47.7; 47.8 in question and the sheet B being conveyed by gripper carriage 32. In a particularly advantageous variant of this embodiment, the air passage openings 69 that act or can be operated as blower air openings 69 are configured as nozzles 69, in particular as Venturi nozzles 69. The air passage openings 69 configured as Venturi nozzles 69 are structured and arranged in the potentially relevant sheet guide plate 47.1; 47.2; 47.3; 47.4; 47.5; 47.6; 47.7; 47.8 such that their contouring generates or can generate a flow of air exiting the opening which, when projected into the sheet guide plate surface, has a jet component that is not equal to zero. Preferably, a flow of air in which the jet component projected into the plane of the sheet guide plate surface is greater than the component extending perpendicular thereto is or can be generated. In the case of a divergent jet, its direction is understood, e.g., as the direction that results as the central jet at the geometric center of the jet cross-section at the level of the opening, i.e. the nozzle cross-section. In the Venturi nozzle 69 variant, the flow of air suctions substrate B toward the relevant sheet guide plate 47.1; 47.2; 47.3; 47.4; 47.5; 47.6; 47.7; 47.8 in a contact-free manner, forming an air cushion, thereby ensuring flutter-free transport. The flow component that is projected into the sheet guide plate surface and is averaged over all directions preferably points toward the side edges of sheet B, at least with a component that is not equal to zero. Another component can point in the same direction as transport direction T. In other words, in this case the flow of air exiting the openings 69, as viewed in the sheet guide plate surface, points—to a greater or lesser extent—with at least one component that is not equal to zero in the same direction as transport direction T. At certain points along the sheet path, it may be necessary to use Venturi nozzles that likewise have a speed component toward the side edges and that have an additional speed component that is directed opposite the direction of sheet travel or the transport direction T.

When conveying paper-like substrate sheets B that have a grammage of less than 200 g/m$^2$, for example, in particular less than 150 g/m$^2$, all the air-operated sheet guide plates 47.1; 47.2; 47.3; 47.4; 47.5; 47.6; 47.7; 47.8 are preferably those of the second embodiment, comprising the blower air openings 69, in particular Venturi nozzles 69. In contrast, when conveying cardboard- or paperboard-like substrate sheets B that have a grammage of greater than 150 g/m$^2$, for example, in particular greater than 200 g/m$^2$, at least some of the sheet guide plates 47.1; 47.2; 47.3; 47.4; 47.5; 47.6; 47.7; 47.8 are configured as those of the first embodiment, having suction air openings 68. For example, sheet guide plates 47.1; 47.2; 47.3; 47.4; 47.5; 47.6; 47.7; 47.8 that are or can be operated using suction air as well as sheet guide plates that are or can be operated using blower air are provided in the transport path of cardboard- or paperboard-type substrate sheets B, particularly in the first conveyor section 41.

For both embodiments of the air-operated sheet guide plates 47.1; 47.2; 47.3; 47.4; 47.5; 47.6; 47.7; 47.8, in principle at least one air conveying means 72 for supplying the negative or positive pressure, e.g. a fan 72 or a blower 72, can be provided, spaced and separated from the relevant air module 71.1; 71.2; 71.3; 71.4; 71.5; 71.6; 71.7; 71.8, and can be connected to the appropriate air module 71.5; 71.6; 71.7; 71.8. In a preferred embodiment shown here, one or more fans 49 are assigned spatially in situ to air module 71.1; 71.2; 71.3; 71.4; 71.5; 71.6; 71.7; 71.8, and are located, for example, in the region of a wall of air module 71.1; 71.2; 71.3; 71.4; 71.5; 71.6; 71.7; 71.8. For the first and second embodiments, the device may be designed specifically for forming the negative pressure or for forming the positive pressure. In one advantageous embodiment, the device can optionally be operated in both directions, i.e. to generate negative pressure in the air module 71.1; 71.2; 71.3; 71.4; 71.5; 71.6; 71.7; 71.8 and to generate positive pressure in the air module 71.1; 71.2; 71.3; 71.4; 71.5; 71.6; 71.7; 71.8. This allows the sheet guiding element 47.1; 47.2; 47.3; 47.4; 47.5; 47.6; 47.7; 47.8 to be operated using suction air or using blower air, e.g. depending on the application requirements.

In an advantageous variant of this embodiment, one or more of the sheet guiding elements 47.1; 47.2; 47.3; 47.4 of first conveyor section 41 are configured to be operated or operable as blowing elements, while at the same time one or more of the sheet guiding elements 47.1; 47.2; 47.3; 47.4 are configured to be operated or operable as suction elements.

In an advantageous embodiment shown, e.g. in FIG. 5, the first conveyor line section 41 comprises, on the input side, i.e. in a section adjoining transfer point 43, at least one sheet guiding element 47.1 that includes blower air openings 69 that are operated or operable as blowing elements, in particular blower air openings 69 embodied as Venturi nozzles 69. Adjoining this single-part or multi-part section are one or more sheet guiding elements 47.2; 47.3 that are or can be operated as suction elements or which include suction air openings 68.

Preferably, at least a last sheet guiding element 47.4 disposed upstream of the first braking system 48 is embodied as a blowing element, in particular blowing via Venturi nozzles 69, or as having blower air openings 69. In the case of a delivery system that comprises at least two delivery stations I; II, this preferably also applies to at least a last sheet guiding element 47.8 disposed upstream of the second or respective braking system 49.

In principle, regardless of whether it is embodied as blowing, suctioning, or without air passage, but preferably in conjunction with the blowing embodiment, the last of a plurality of sheet guiding elements 47.1; 47.2; 47.3; 47.4 disposed upstream of the first delivery station I is embodied and/or arranged as variable in terms of its length that acts as a guide in the transport direction. In that case, the position of the downstream end of sheet guiding element 47.4 as viewed in the transport direction, in particular the length thereof that acts as a guide between its downstream end and the end of the sheet guiding element 47.1; 47.2; 47.3 that is directly upstream in the transport path is variable. The ability to vary the length that is used for guidance in the transport direction T or the downstream position of the end allows the end of sheet guidance on the first conveyor line section 41 to be adapted to the sheet length or format length $L_B$ of the transported sheets B, as viewed in the transport direction, and thus to the length of the pile 11; 12 to be formed, as measured in the transport direction.

In place of or preferably in addition to this, the last of a plurality of sheet guiding elements 47.5; 47.6; 47.7 disposed upstream of the second delivery station II in the second conveyor section 42 can be embodied and/or arranged as variable in terms of its length that acts as a guide in the transport direction. The above description relating to the sheet guiding elements 47.4 disposed upstream of the first delivery station I can be applied here accordingly.

The variable-operative-length sheet guiding element 47.4; 47.8 is movable, for example in the transport direction, relative to the sheet guiding elements 47.3; 47.7 that precede it upstream and can be arranged above or preferably below the latter. Said element can preferably be embodied as reversibly bendable and/or flexible in at least one longitudinal section, so that it can be moved—guided appropriately in lateral guides 73, e.g. extending in an arcuate shape at least in one section—a longer or shorter distance from a position below the sheet guiding elements 47.3; 47.7 that precede it upstream and into the transport path. In the air-operated embodiment, the air module 71.4; 71.8 that is attached underneath is likewise flexible in terms of its shape, at least in the bendable or deformable longitudinal section, for example it is made of elastic materials, such as rubber. At least one downstream end of the variable-operative-length sheet guiding element 47.4; 47.8, along with the braking system 48; 49 that is disposed directly downstream or is assigned directly thereto, is preferably disposed in or on a frame G of delivery system 03 that supports sheet guiding device 47, so as to be movable in and opposite transport direction T, each on its own or preferably together, within a significant adjustment range, e.g. within an adjustment range of at least 10 mm, more particularly at least 50 mm. Unless otherwise explicitly stated or apparent, frame G of delivery system 03 is also understood as a frame section G of an optionally multi-part, interconnected or non-interconnected frame G of delivery system 03. More particularly, these are understood as frame sections G or frames G that are operationally stationary with respect to the platform.

Upstream of such a variable-operative-length sheet guiding element 47.4; 47.8, a sheet guiding element 47.3; 47.7 that forms a transition to the variable-operative-length sheet guiding element 47.4; 47.8, e.g. a transition guide element 47.3; 47.7, may be located, which can be embodied as having its own air module 71.3; 71.7 or can share an air module 71.2; 71.6 with the sheet guiding element 47.2; 47.6 upstream. Said element can come to a point at its downstream end, and its shape can be matched to the profile of the variable-operative-length sheet guiding element 47.4; 47.8 that extends outward from beneath it.

Figure 7:
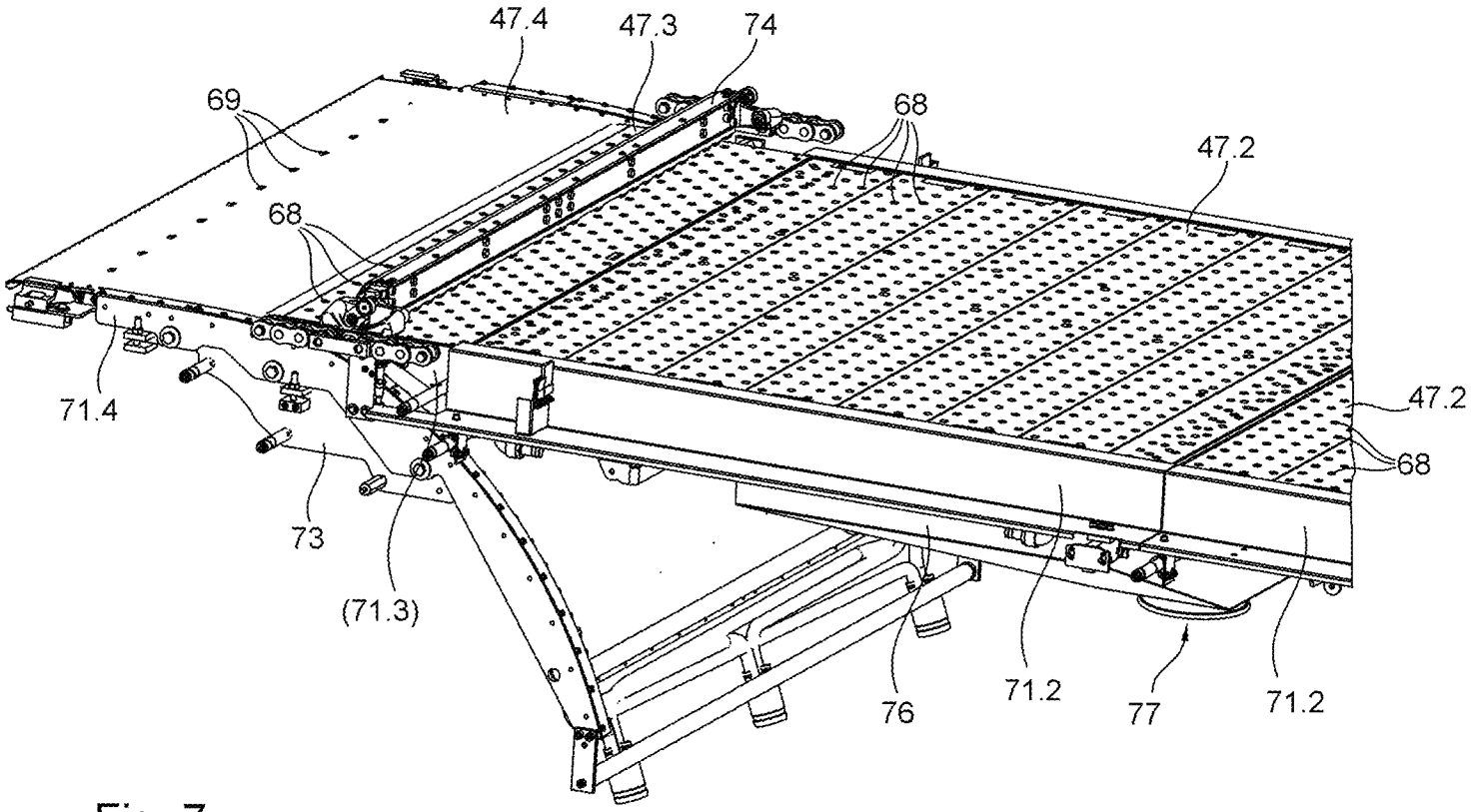
FIG. 7 an end section of the sheet guiding device disposed upstream of a delivery station.

In the transport path of sheets B, in particular in the first conveyor section 41, an application system 74 for applying powder to the sheets B (see, e.g. FIG. 7), e.g. powdering system 74, may be provided. For an embodiment that includes the powdering system 74, in an advantageous refinement, the air module 71.2 (71.3), operated in particular as a suction element, of the sheet guiding element 47.3 that is opposite the application system 74 across the transport path can lead into a vacuum module 76, which tapers downward in the manner of a funnel, for example, and at the lowest point has an outlet 77 for residual powder that has been suctioned off. The powder can be removed from the outlet via a line, not described in greater detail, via a filter, for example.

In the embodiment of a delivery system 03 that comprises a plurality of delivery stations I; II one behind the other, the conveyor line of a sheet B that is not delivered to the first delivery station I is continued along the second conveyor section 42, via e.g. one or more sheet guide plates, likewise as preferably air-operated sheet guide plates 41.5; 41.6; 41.7, 47.8, and preferably via a braking system 49, up to the second delivery station II. In an advantageous embodiment, at least the first or the only, but more particularly all of the sheet guide plates 41.5; 41.6; 41.7, 47.8 provided in the second conveyor section 42 are operated with blower air, or are embodied with blower air openings 69, in particular Venturi nozzles 69.

In a particularly preferred embodiment, a sheet guiding element 78 is assigned to or disposed upstream of the first or sole sheet guide plate 47.5 that follows the first delivery station I, in the region of its upstream, i.e. input-side end, wherein said sheet guiding element immediately follows the delivery station I downstream, and as an approach section 78, can be embodied either as part of the sheet guide plate 47.5 that operates particularly using blower air, or in the form of a separate component group as a sheet guiding element 78 upstream. At its upstream end, approach section 78 has an approach ramp, preferably with a rounded edge 84, in particular upper edge 84.

Figure 16:
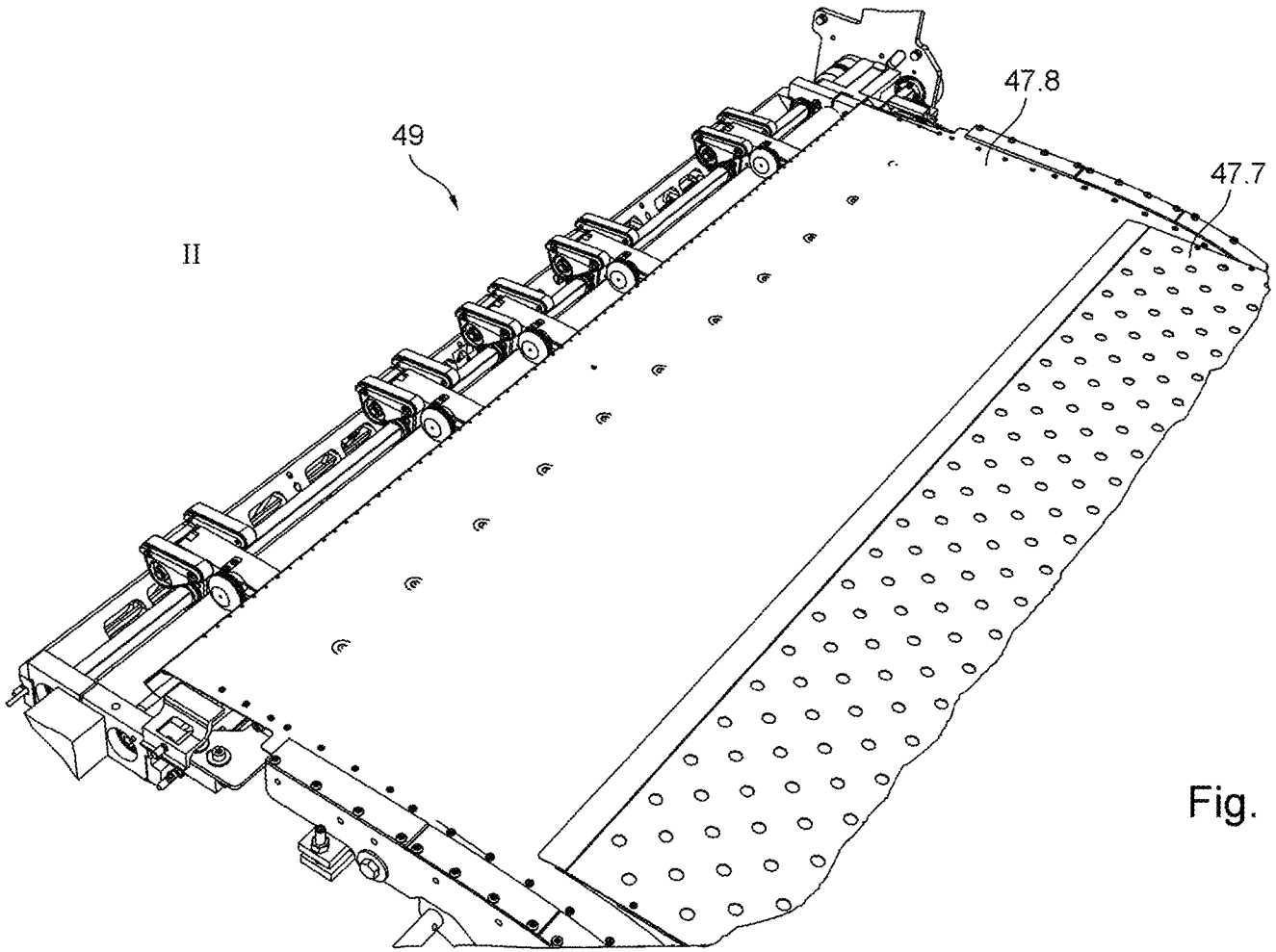
FIG. 16 a braking system disposed upstream of a first delivery station.
Figure 17:
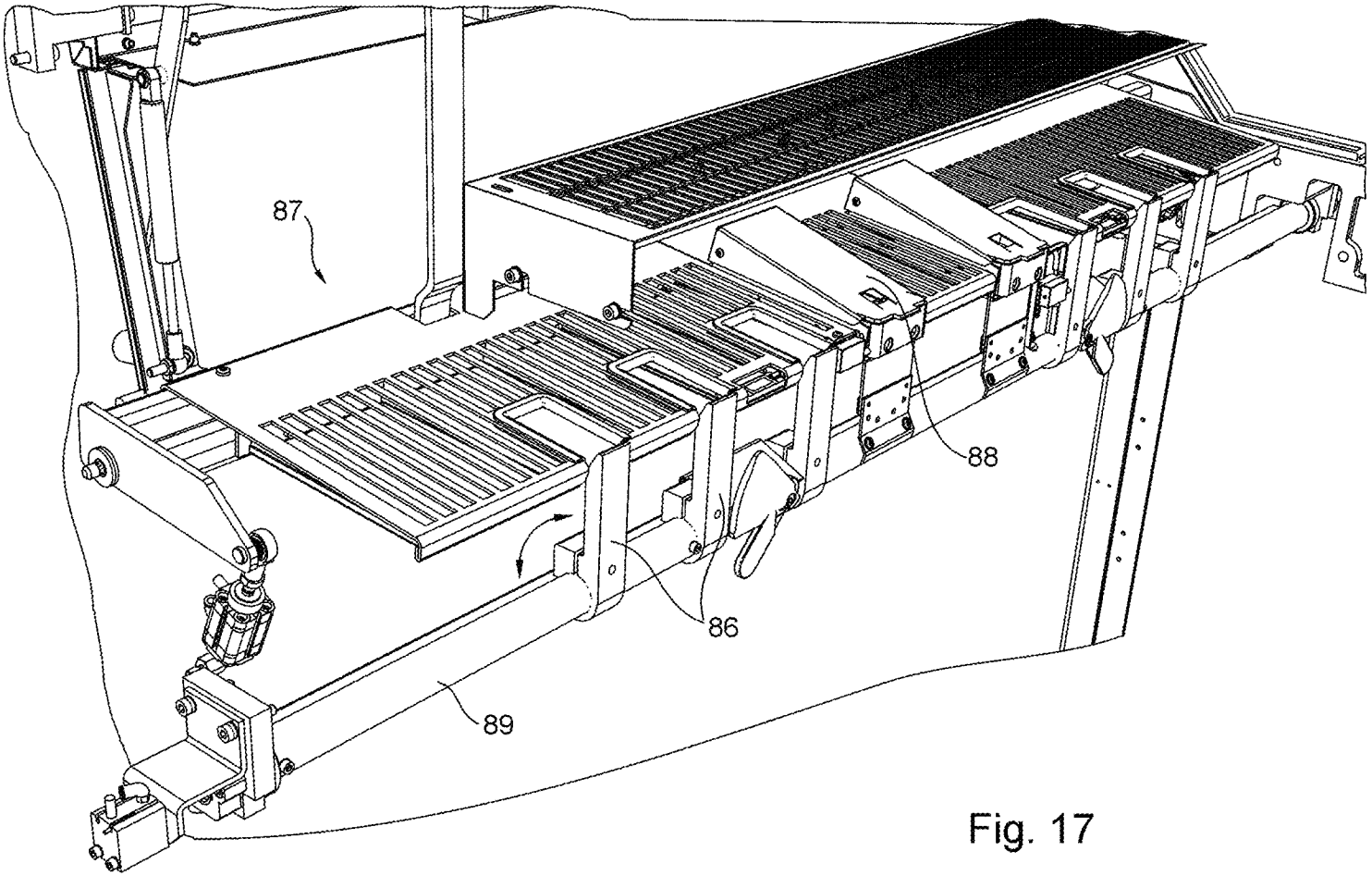
FIG. 17 a stop device and sheet removal device disposed downstream of a delivery station.

As described above, the last of a plurality of sheet guiding elements 47.5; 47.6; 47.7 that are disposed upstream of the second delivery station II in the second conveyor section 42 can be embodied and/or disposed as variable in terms of its length that is used as a guide in the transport direction (see, e.g. FIG. 16). The above description applies, mutatis mutandis.

On the downstream side of the second or last delivery station II, a stop device that comprises a stop means 86 is likewise provided, against which the downstream side pile edge of the pile 12 to be formed is formed. Stop means 86 can be moved from an active position bordering the transport path to an inactive position out of the transport path, more particularly said means can be pivoted outward via a shaft 89 to open up the path, e.g. for a test sheet. In addition, a sheet removal device 87 can be provided, by means of which, to initiate test sheet removal, a discharge element 88, e.g. also called a test sheet finger 88, can be introduced into the transport path.

Figure 18:
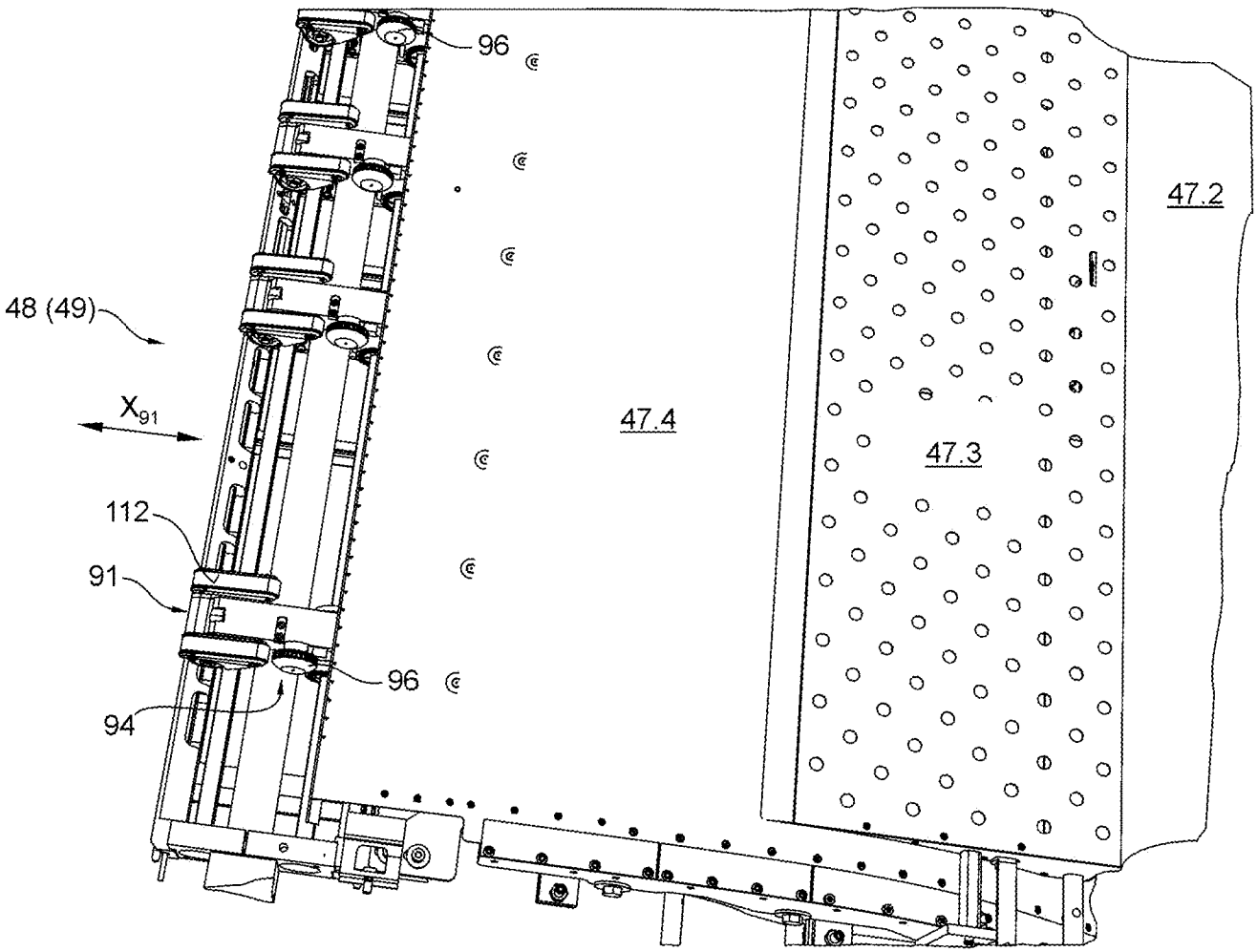
FIG. 18 a braking system disposed upstream of a second delivery station.
Figure 19:
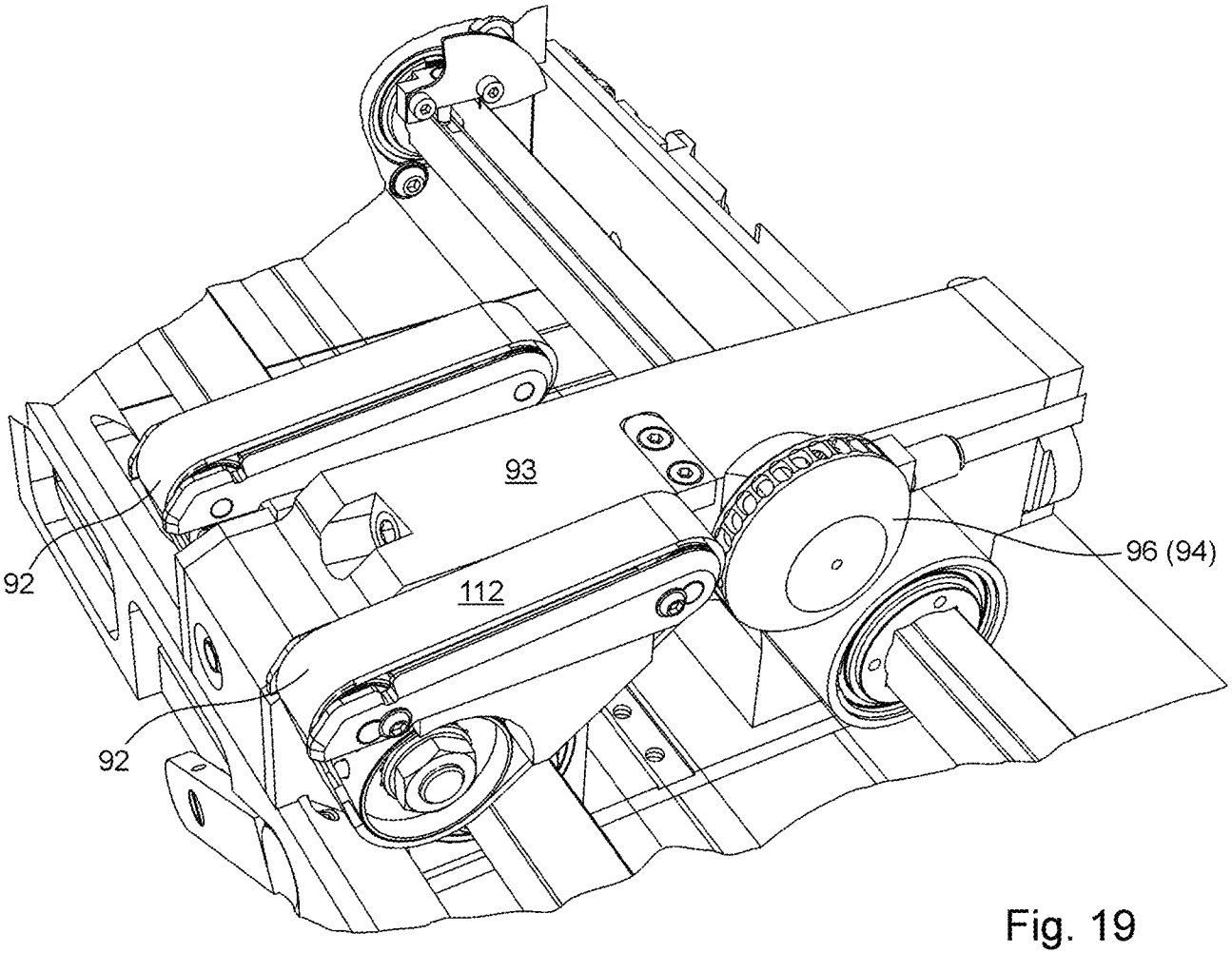
FIG. 19 an enlarged view of components of a braking system.
Figure 20:
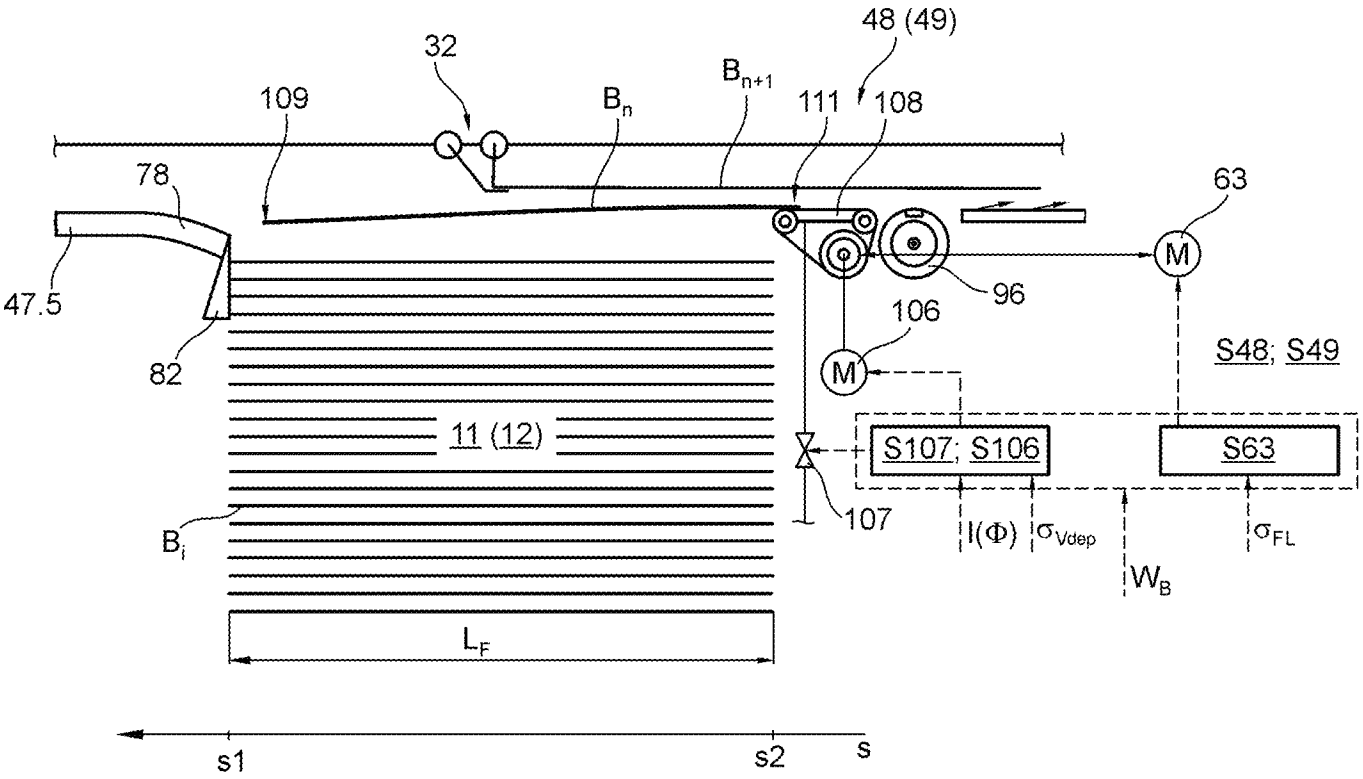
FIG. 20 a schematic view from the side of a sheet braking system with pile and controller.

In a preferred embodiment of the braking system 48; 49 provided in the transport path of the first and/or second conveyor section 41, 42, said system comprises a plurality of braking devices 91 spaced from one another, in particular at least three, advantageously at least five, in particular precisely five, preferably side by side in the axial direction, which are or can be brought into operative contact with the substrate B in axial aligned areas that are spaced from one another (see, e.g. FIG. 18). Some or all of these braking devices 91 are preferably movable in the axial direction, and at least one outer braking station or even both outer braking stations 91 can be moved laterally out of the movement path of the sheets B. Each braking device 91 embodied, e.g. as a suction station 91, comprises at least one positively driven holding means 92, configured e.g. as suction element 92, which in principle can be embodied as a suction roller, but is preferably embodied as a suction belt 92 that travels over a suction module (see, e.g. FIG. 19 and FIG. 20). During operation, the operative surface 112, e.g. the upper side 112, of suction element 92 that faces sheet B is driven in the transport direction by means of a drive 106, e.g. a motor 106, in particular an electric motor 106 that is controllable at least with respect to its rotational speed, the speed being varied dynamically for the controlled braking of the sheets B. In one advantageous embodiment, some or all of braking devices 91 have two suction belts 92 side by side on the two sides of the same mount 93, which is mounted, e.g. to be axially movable.

For the axial or lateral movement of one, some, or all of braking devices 91, a drive system having at least one drive means 95 can be provided. This enables the braking devices 91 in question to be positioned by a plurality of drives individually or in groups, or in a less complex embodiment, together by means of one drive means 95, via appropriate drive connections. For example, they may be operatively connected, symmetrically to the center of the sheet travel path, to a spindle having counter-rotating threaded portions and/or different thread pitches and may be drivable and/or driven by means of a common drive means 95 embodied as drive motor 95. A cross-tensioning device 96 can also be movable or moved along with braking device 91.

In one advantageous embodiment, a device 94, in particular a cross-tightening device 94, for pulling sheets B tight in the transverse direction is disposed upstream of suction elements 92 in the transport path. Said device comprises, e.g. two cross-tensioning devices 96, which can be used to apply a force that has at least one transverse component in opposite directions to each of sheets B. The number of cross-tensioning devices 96 provided can be the same as the number of braking devices 91. The cross-tensioning devices 96 are preferably embodied as suction wheels that can be pressurized with negative pressure.

Braking system 48; 49 is preferably disposed immediately upstream of delivery station I; II in the transport path and/or is integrated into the end region of the guidance section that is formed by one or more of said sheet guiding elements 47.1; 47.2; 47.3; 47.4; 47.5; 47.6; 47.7; 47.8 or is provided immediately following said guidance section in the conveyor line.

In the preferred embodiment, the braking stations 91 of braking system 48; 49 that comprise holding means 92 are disposed in or on the frame G that supports sheet guiding device 47 in delivery system 03, so as to be movable, collectively or together with the downstream end of the variable-operative-length sheet guiding element 47.4; 47.8, in and opposite the transport direction T within a significant adjustment range, e.g. within an adjustment range of at least 10 mm, in particular at least 50 mm. The at least one braking station 91 is moved along transport direction T, for example, by means of a drive means 63, e.g. a drive motor 63 preferably embodied as an electric motor 63 (see diagram, e.g. in FIG. 20).

In a particularly preferred embodiment, control means S106; S107 are assigned to braking system 48; 49, by means of which the functional elements of said braking system, e.g. one or more drives 106 and/or one or more switching means 107 associated with holding means 92, are or can be controlled or will be controlled synchronously and/or in correlation with a press phase position and/or substrate phase position Φ and based upon the delivery station I; II designated for the substrate sheet B in question. Actuating one or more of these functional elements appropriately supports the precise pile formation in the proper delivery station I; II, while at the same time supporting a transfer of sheets B to be deposited downstream in which quality is maintained.

Alternatively or in addition to this, drive means 63 that are used for moving the at least one braking station 91 of braking system 48; 49 along transport direction T are assigned control means S63, with which the position of sheet brake 48; 49, more specifically the position of the at least one braking station 91 that is part of sheet brake 48; 49, can be adjusted to the format length $L_B$ of the sheet B currently being deposited. Optimal positioning supports a precise and damage-free pile formation in the respective delivery station I; II.

Control means S63; S106; S107, which are used to control movement in the transport direction T, the movement of holding means 92, and the switching means 107, may be provided in separate control units, or all together or in groups in a common control unit. Said control means may be part of a higher-level press controller or may be provided in a decentralized location and, if necessary, connected to such a press controller.

Figure 21:
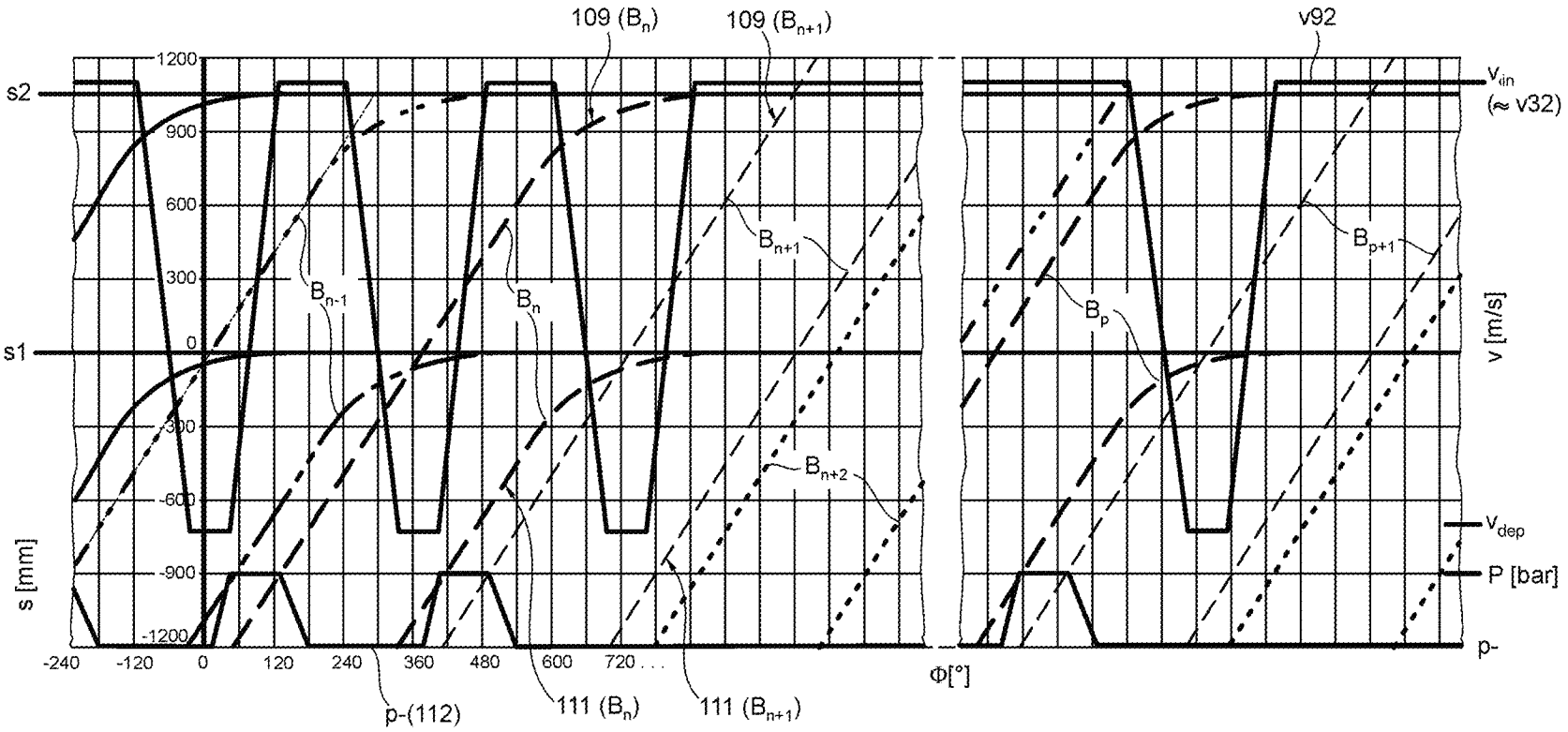
FIG. 21 a diagram illustrating the operation of a braking system.

Depending upon whether the sheets $B_n$ entering the area of braking system 48; 49 will be deposited in the delivery station I; II immediately downstream or will be guided beyond said station, drive 106 and/or switching means 107 of one or more holding means 92 of braking system 48; 49 are intended to be or are operated in two different operating modes m1; m2 (see, e.g. FIG. 21). The operating modes m1; m2 may differ from one another in terms of their speed profile for holding means 92 and/or in terms of their profile for activating/deactivating holding means 92. Operation in one of operating modes m1; m2 is continued in each case at least for the duration of one cycle length; the cycle length is based, for example, on the press phase position and/or substrate phase position and can correspond, e.g. to the length of the phase between the entry of the leading end of one sheet $B_i$ and the entry of the leading end 109 of the subsequent sheet $B_{i+1}$ into braking system 48; 49, and/or to the length of the phase between the exit of the trailing end of one sheet 1 and the exit of the trailing end 111 of the subsequent sheet $B_{i+1}$ from braking system 48; 49.

The decision as to whether the sheet $B_n$ entering the zone around braking system 48; 49 will be deposited in the delivery station I; II immediately following said system or will be conveyed beyond said delivery station can be made by the press operator manually or automatically. Automated decisions can be made based upon a measurement or a preset sequence of copies. For example, waste copies can be deposited manually or in a specified number to the appropriate pile 11; 12. If multiple good sheet piles will be formed, the decision regarding sheet delivery can be made by assigning the printed sheets to the individual piles 11; 12.

If delivery system 03 is configured as a dual-pile delivery device 03, the drive 106 and/or switching means 107 of one or more holding means 92 of braking system 48; 49 are or will be operated in the two different operating modes m1; m2 depending upon whether the currently approaching substrate sheet B will be fed to the first pile 11, e.g. waste pile 11, or to the other pile 12, e.g. good sheet pile 12, or to sheet removal device 87.

In the advantageous embodiment of delivery system 03 that includes a plurality of piles 11; 12 or delivery stations I; II, in particular two, a braking system 48; 49 is disposed upstream of each delivery station I; II. The drive 106 of said braking unit can be or is operated in such a way that the operative surface 112 of holding means 92 that interacts with sheet B is and/or can be operated, for at least a portion of the period of contact between holding means 92 and sheet B, at a deposition speed $v_{dep}$ that is lower than the currently prevailing conveyance speed v32 determined by conveyor system 21, e.g. at a speed of holding devices 32 or a gripper carriage speed v32 that is reduced, e.g. by at least 50%. In a preferred embodiment, drive 106 of said braking system can be operated dynamically in such a way that the operative surface 112 of holding means 92 that interacts with sheet B is continuously variable, at least between the currently prevailing conveyance speed v32 determined by conveyor system 21, e.g. the speed of holding devices 32 or the gripper carriage speed v32, and a lower deposition speed $v_{dep}$, e.g. reduced by at least 50%.

A substrate sheet $B_n$ to be delivered is picked up, in particular pneumatically sucked up, on the intake side of braking system 48; 49 by a holding means 92 of braking system 48; 49, and said holding means is then moved in transport direction T at or nearly at, i.e. at more than 95% of, conveying speed v32, i.e. without or nearly without any relative movement between holding device 32 of conveyor system 21 and holding means 92 of braking system 48, 49. Once holding device 32 has opened, i.e. after the gripper has opened, for example, the speed v92 of holding means 92 is reduced by adjusting the rotational speed to the lower deposition speed $v_{dep}$, and as a result, sheet B is braked and ultimately deposited onto pile 11.

The reduction in speed or deceleration—in particular for the first braking system 48 and the second braking system 49—that takes place in the appropriate operating mode m1 for the purpose of deposition is preferably carried out along a predefined curve, the profile of which in an advantageous embodiment is adjustable and/or can be parameterized via corresponding input.

The curve or the profile thereof can be dependent on the current production speed, i.e. on the input-side conveying speed v32 and/or on the nature of the substrate B and can vary automatically on this basis.

To correct a faulty deposition and/or to adapt to a new format length $L_B$, as may be necessary, e.g. with a production change, the curve and/or the profile thereof can be modified by press operators by varying corresponding parameters that define the curve. In such cases, at least the level of the aforementioned deposition speed $v_{dep}$, i.e. the lower final speed after the speed reduction, can be modified by press operators.

Alternatively or preferably in addition to this, press operators can adjust the position of braking system 48; 49 in transport direction T, in particular the position of holding means 92.

A substrate sheet $B_{n+1}$ that will not be delivered, i.e. that will be conveyed past, is likewise picked up, in particular pneumatically sucked up, on the intake side of braking system 48; 49 by a holding means 92 of braking system 48; 49, and said holding means is then moved in transport direction T at approximately conveying speed v32, i.e. with a maximum deviation of, e.g. ±10%, or preferably at most ±5%, in particular at most ±3%, i.e. virtually without relative movement between holding means 32 of conveyor system 21 and holding means 92 of braking system 48, 49. This condition is maintained, however, during the continued transport of the sheet $B_{n+1}$ in question until the trailing end 111 of sheet $B_n$ leaves or has left braking device 48; 49. Sheet B, which is still being held by holding device 32 of conveyor system 21, is conveyed further downstream beyond the delivery stations I; II disposed directly downstream of braking system 48; 49 to a further delivery station I; II or to a sheet removal device 87. To avoid wave formation, the aforementioned possible deviation is, e.g. no more than −10%, preferably no more than −5%, in particular no more than −3%.

Thus, a braking system 48; 49 that can be operated and/or is or is intended to be operated in two different operating modes is assigned to or disposed upstream of the delivery station I; II, in particular at least the first delivery station I. The operating mode used is based upon the intended transport destination for the approaching sheet B.

In the first operating mode m1, e.g. a deposition mode m1, in which one or more sheets B from the first pile 11, e.g. waste pile 11, will be deposited, the rotational speed of drive 106 changes at least once for each sheet to be deposited from a rotational speed that results in a first speed $v_{in}$ which, as the speed of the approaching sheet, for example, corresponds substantially—i.e. with a maximum deviation of ±10%—to the aforementioned conveying speed v32, to a rotational speed that brings about the deposition speed $v_{dep}$, and back to substantially the conveying speed v32. If a plurality of successive sheets $B_n$ will be delivered one after the other, this first operating mode m1 is repeated a corresponding number of times, and as a result, braking system 48, 49, i.e. holding means 92, changes speed v92 from conveying speed v32 to deposition speed $v_{dep}$ and back, in sync with the arriving and delivered sheets $B_n$.

With a change to deposition speed $v_{dep}$, while holding means 92 is in operative contact with sheet B being conveyed, the speed v92 of said holding means is preferably decreased to a speed $v_{dep}$, which is e.g. at most 50%, advantageously less than 20%, preferably less than 10% of conveying speed v32. In a stationary operating situation, the higher speed v92 of holding means 92, which corresponds substantially to conveying speed v32, is above, e.g. at least 4 m/s, for example in the range of 4 to 9 m/s, in particular in the range of 5 to 8 m/s. In contrast, deposition speed $v_{dep}$ is, e.g. at most 2 m/s, for example in the range of 0.5 to 2 m/s, in particular in the range of 0.7 to 1.4 m/s.

The deceleration, i.e. the lowering of the speed v92 of holding means 92 from the speed v92 that corresponds substantially to conveying speed v32 to the deposition speed $v_{dep}$, is not carried out in sheet path s, for example, until a phase is reached in which the leading edge 109 of the sheet $B_{n+1}$; $B_P$ to be deposited is less than one-half a sheet length from alignment s2 with the downstream rear edge of the pile, or in which the leading edge 111 of the sheet $B_{n+1}$; $B_P$ to be deposited is less than one-half a sheet length from alignment s1 with the upstream leading edge of the pile.

In the second operating mode m2, e.g. a guiding m2, in which one or more sheets B will be guided past the first pile 11, e.g. waste pile 11, or past the delivery stations I, drive 106 is operated, throughout at least the entire phase of contact between braking system 48, 49, i.e. holding means 92, and the sheet B that will be guided beyond pile 11 or delivery station I, at a rotational speed that results in a speed v92 that corresponds substantially to conveying speed v32. If conveying speed v32 is a constant speed, it likewise remains constant at least during the aforementioned contact phase. This second operating mode m2 is essentially independent of the presence or the specific embodiment of a first operating mode but is particularly advantageous when employed in conjunction with the embodiment of a first operating mode set forth herein.

In a preferred embodiment of braking system 48; 49, holding means 92 that can be activated and deactivated in a clocked manner via corresponding switching means 107 are provided. For clocking, switching means 107 is in signal connection with control means S107, for example, which is embodied and configured to activate and deactivate holding means 92, synchronously and/or in correlation with a press phase position and/or substrate phase position Φ. If two operating modes m1; m2 are provided, these modes differ not only in terms of their phase position-based speed profile, for example, but also in terms of the switching profile that is used for switching, i.e. activating and deactivating, the holding means 92.

In the first operating mode m1, holding means 92 is deactivated during all or at least part of the positive acceleration phase from deposition speed $v_{dep}$ to conveying speed v32. In the embodiment as suction elements 92, suctioning is shut off at least temporarily during this phase, i.e. the application of a negative pressure $p^-$ to suction element 92 is interrupted.

In the second operating mode m2, the activation of holding means 92 is maintained at least throughout the entire phase of contact between braking system 48, 49, i.e. holding means 92, and the sheet B that will be conveyed beyond pile 11 or delivery station I. Preferably, the suction or negative pressure $p^-$ is maintained throughout the entire cycle. In the embodiment as suction elements 92, the suction remains switched on, i.e. the negative pressure $p^-$ at suction element 92 is maintained, at least during this contact phase. Preferably, the suction or negative pressure $p^-$ remains switched on throughout the entire cycle from the entry into the zone of braking system 48; 49, in particular into the operative zone of holding means 92, by the sheet $B_n$ that will be conveyed past until the entry into the zone of braking system 48; 49, in particular into the operative zone of holding means 92, by the subsequent sheet $B_{n+1}$. If a plurality of successive sheets $B_{n+1}$; $B_{n+2}$ will be conveyed past, one after the other, the suction or negative pressure $p^-$ can remain switched on for the duration of the relevant cycles.

Continuing the suction throughout the entire cycle, especially throughout the cycles of multiple sheets that will be conveyed past, ensures that, in the second operating mode m2, i.e. the conveyance mode m2, the sheet will detect the sheet $B_{n+1}$ to be conveyed past and, essentially without any relative movement, will extend it over the pile 11, 12 that is to be bypassed. The sheet $B_{n+1}$ that is to be conveyed past is thereby prevented from "collapsing into" the delivery shaft of the pile 11 that is to be bypassed, or such collapsing is at least decreased, thereby allowing sheets to bypass stations without a loss of quality. This is particularly relevant for production processes that involve high conveying speeds.

Leaving the suction air permanently switched on in the second operating mode m2 promotes the earliest possible lifting up and holding of the trailing edge of sheet B.

For the two operating modes m1; m2, two different sets of rules for generating setpoint values for the speed v92 of holding means 92 are stored in control means S48; S49, for example. The rules include a dependency on the conveying speed v32, for example, and may also be dependent on additional determining factors and can be parameterized by press operators.

The rules each comprise various assignment rules between the current conveying speed v32 and a setpoint value or setpoint profile for the speed v92 of holding means 92. For the assignment rule of the second operating mode m2, as a correlation at least for the duration of contact with the sheet B, the slope of holding means speed v92 is correlated proportionally with conveying speed v32, and for the assignment rule of the first operating mode m1, for at least part of the duration of contact with the sheet B, at least one ramp with a descending slope of holding means speed v92 relative to conveying speed v32 is provided.

When delivery system 03 is in operation, for example during a makeready phase, multiple sheets $B_i$ (i=1 . . . n), e.g. n (n∈ℕ), are stacked as waste onto a first pile 11 in the area of the first delivery station I, in particular using the sheet brake 48 operated in the first operating mode m1. At least one sheet $B_{n+1}$ that follows the n sheets is guided, e.g. as a test sheet or as a good sheet, beyond the first delivery station I or the first pile 11, in particular using the sheet brake 48 operated in the second operating mode m2 and is delivered downstream to a further delivery station II or a sheet removal device 87. Once a predetermined number of makeready sheets have been fed as waste sheets to the first delivery station I, for example, and/or once a test sheet has been assessed as good, for example, the system is automatically or manually switched to production operation, in which sheets $B_i$ are regularly deposited on the good sheet pile 12. During production operation, however, for various reasons it may be necessary for one or more sheets $B_P$ to be fed to the first or waste pile 11, in particular using the sheet brake 48 operated in the first operating mode m1. These may be changeover sheets that are produced during a pile change, for example, or faulty or damaged sheets. A sheet $B_P$ of this type that must be ejected during a production run can be released manually or by a sensor.

For controlling the at least one drive 106 that drives holding means 92 and/or the at least one switching means 107 that activates holding means 92, drive 106 and/or switching means 107 is in signal connection with control means S106; S107, which is in turn in signal connection, for example, with a signal generator, e.g. a sensor or a drive master, from which it receives information I(Φ) relating to and/or representing the press phase position and/or substrate phase position. Control means S106; S107 comprise a control circuit and/or an algorithm, which is configured to effect the control of drive 106 and/or switching means 107 specified for the operating modes m1; m2.

The above description referring to the implementation of braking system 48; 49 also applies here to the process in which good sheets $B_{n+1}$ are to be or are intended to be deposited in the first or the second delivery station I; II, and waste sheets $B_n$; $B_P$ are to be or are intended to be deposited in the respectively other delivery station II; I. Waste sheets $B_n$; $B_P$ in this case may include makeready sheets, defective rejected sheets, and sheets identified manually by press operators, for example. The waste sheets are or are intended to be deposited, for example, on a pile 11 in the area of the first delivery station I, and good sheets are or are intended to be deposited in the area of the second delivery station II. However, the above-described procedure and/or control of braking system 41; 42 may also be provided or configured for use with a reverse assignment of waste paper and good sheets, as well as in conjunction with the formation of a plurality of different substrate piles, none of which are for waste paper.

The aforementioned setting of the position of braking system 48; 49 in transport direction T, in particular position $X_{91}$, as viewed in transport direction T, of the braking devices 91 that interact via holding means 92 with sheets B, which in this case represents the variable to be adjusted, i.e. the setting variable $X_{91}$, for example, is carried out, for example, using a correcting variable that represents the desired height or a change to be effected, which are or can be forwarded to the control means S63 in question, and which is reflected, for example, in a corresponding actuation of drive means 63.

Figure 39:
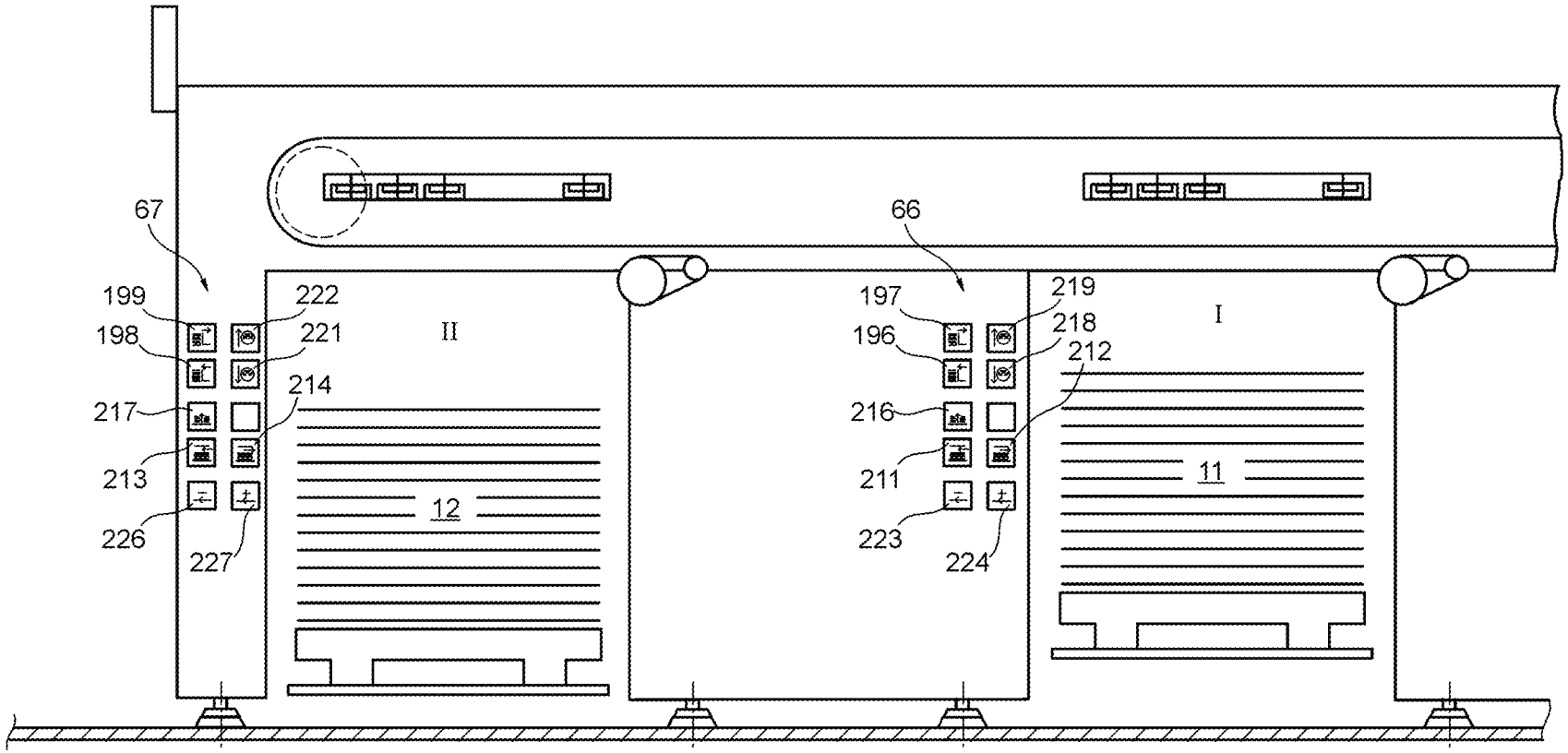
FIG. 39 a schematic side view of a delivery device having two delivery stations with control means or user interfaces that comprise the control means assigned to each.

The correcting variable that relates to the position of braking system 48; 49 or that of holding means 92 can be specified as a positioning command directly by the press operator, in particular it can be provided by means of signals $\sigma_{FL}$ from one or more control means 196; 197; 198; 199, hereinafter also called switching elements 196; 197; 198; 199, or e.g. buttons 196; 197; 198; 199 (see, e.g. FIG. 39), which can be manipulated by the press operator, and which are in signal communication with the control means S63 for controlling the relevant drive means 63 of the sheet brake 48; 49. The signals $\sigma_{FL}$ generated by said manipulation can represent a desired position directly, or can represent a directional adjustment interval. The at least one switching element 196; 197; 198; 199 may be part of a user interface 66; 67 located to the side of the appropriate delivery station I; II and configured for this purpose.

For adjusting the position manually, each of sheet brakes 48; 49 can be provided with one switching element 196; 198, the manipulation of which moves or can move braking system 48; 49 or holding means 92 to a position further downstream, i.e. adjusting it to a format length that is smaller than the current format, and one switching element 197; 199, the manipulation of which moves or can move braking system 48; 49 or holding means 92 to a position further upstream, i.e. adjusting it to a format length that is smaller than the current format. This allows more precision adjustments to be made, in addition to adjustments to a new format, where necessary.

The aforementioned adjustment of deposition speed $v_{dep}$ (as the variable to be set, or the setting variable $v_{dep}$ for the drive or drive means 106) to a desired level is implemented, for example, using a correcting variable that represents the desired level or a direction-dependent adjustment interval, which are or can be forwarded to the respective control means S106. These are reflected, for example, in a change in the parameters on which the profile is based, and ultimately in a corresponding actuation of drive means 106. This adjustment can preferably also be carried out by the press operator (see below).

Alternatively or preferably in addition to this manual intervention, the correcting variable relating to the desired position of braking system 48; 49 or holding means 92 and/or the correcting variable relating to the level of deposition speed $v_{dep}$ may be obtained and/or obtainable by the specification of setpoint values $W_B$, e.g. the specification of a parameter set $W_B$ which is calculated and/or stored for a format to be output. The latter can be transmittable or transmitted from a product planning and/or presetting system.

In a preferred embodiment of delivery device 03, which comprises, in the transport path of sheets B being conveyed by a conveyor system 21, a last, e.g. second pile delivery II in the transport direction T, and at least one pile delivery disposed upstream of the last pile delivery II in the transport path, e.g. a first pile delivery I, a braking system 48 is thus assigned to the upstream pile delivery I in the transport path, and/or a variable-operative-length sheet guiding element 47.4 is disposed upstream of said pile delivery, wherein the braking system 48 itself, or at least an operative surface 112 of the braking system 48 that comes into operative contact with substrate sheet B, and/or a downstream end of the variable-operative-length sheet guiding element 47.4 of the upstream pile delivery I can be moved to a first position $P_1$(48); $P_1$(47.4), as viewed in transport direction T, for delivering sheets B of a first format length $L_B$, and can be moved to a second position $P_2$(48); $P_2$(47.4); $P_S$(48); $P_S$(47.4) further downstream, as viewed in transport direction T, for delivering sheets B' of at least a second format length $L_{B'}$ which is shorter than the first format length $L_B$.

In a first operating mode, for example, all delivery stations I; II are activated, i.e. are ready for the deposition of approaching sheets B. In this mode, sheets B can be deposited on the appropriate pile 11; 12; 168; 169 in the respective delivery station I; II based on the aforementioned control commands, or can be conveyed past these delivery stations, with the respective braking system being operated in the first or the second operating mode m1, m2, depending on the intended destination.

Thus during operation of delivery device 03, which comprises, in the transport path of sheets B being conveyed by a conveyor system 21, a last, e.g. second pile delivery II in transport direction T, and at least one forward pile delivery, disposed upstream of the last pile delivery II in the transport path, e.g. a first pile delivery I, wherein a braking system 48 is assigned at least to the upstream pile delivery I in the transport path, and/or a sheet guiding element 47.4 having a variable operative length is disposed upstream of said pile delivery, in a first operating mode, braking system 48 itself, or at least one operative surface 112 of the braking system 48 that comes into operative contact with substrate sheet B, of the forward pile delivery I, and/or the variable-operative-length sheet guiding element 47.4 of the forward pile delivery I, or at least the downstream end of said sheet guiding element, can be positioned, in at least a first operating mode of delivery device 03, in various positions $P_1$(48); $P_1$(47.4), $P_2$(48); $P_2$(47.4) along transport direction T, depending upon the format length $L_B$; $L_{B'}$ to be deposited.

Figure 22:
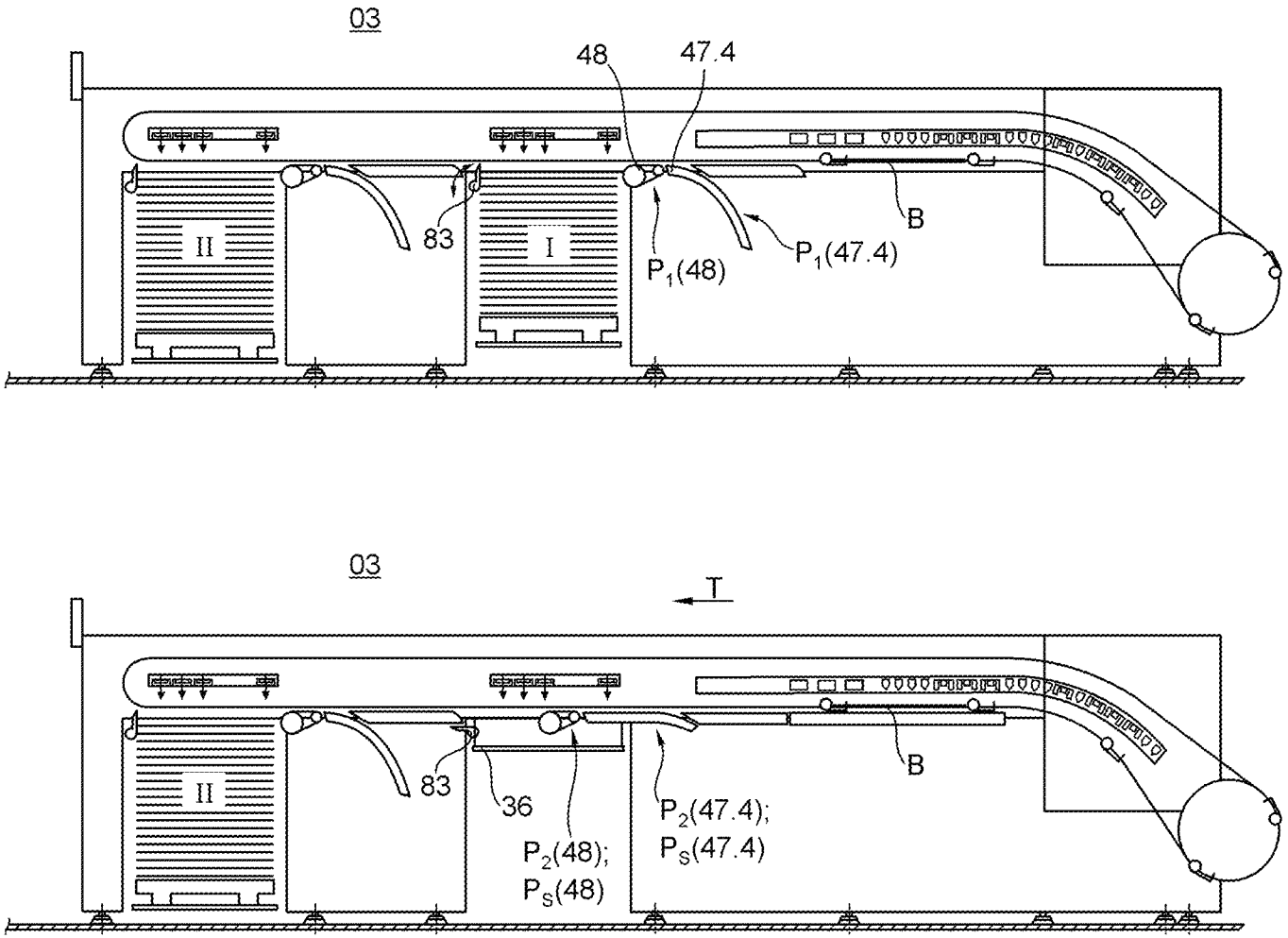
FIG. 22 a schematic representation of a first operating mode of the delivery device a) with two activated delivery stations and b) with an activated second delivery station and a deactivated first delivery station.
Figure 23:
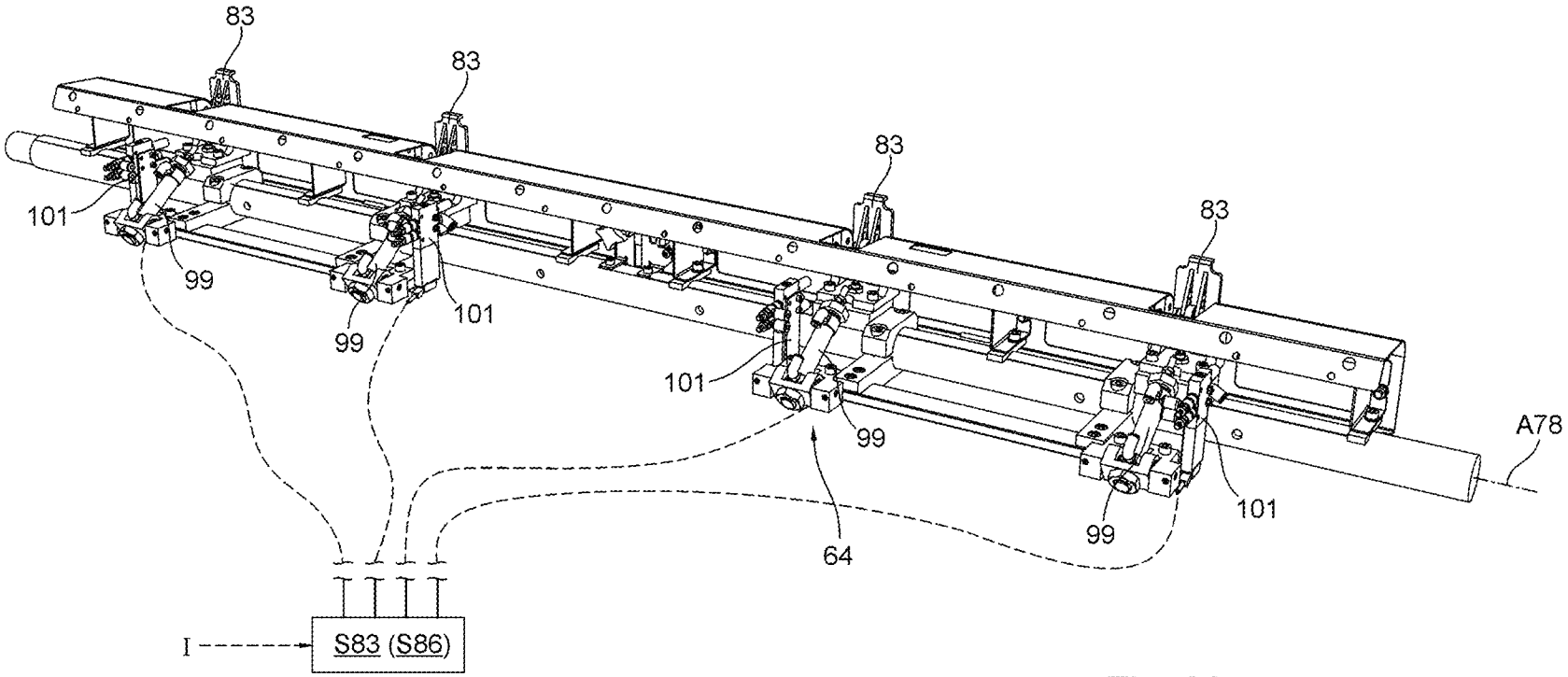
FIG. 23 a stop device disposed downstream of a delivery station.

In a second operating mode, provided in the preferred embodiment, of the delivery device 03 comprising at least one first and one second delivery station I; II (see, e.g. FIG. 22), said delivery device will be or is operated during normal operation, for example during a production run or production phase, such that one delivery station II, in particular a delivery station other than the first delivery station I, e.g. the last delivery station downstream, is active, i.e. is basically ready for use for the deposition of sheets B, while another delivery station I, in particular one that is upstream of said active delivery station II, or the forward delivery station, is deactivated, i.e. a deposition of sheets in this delivery station I is neither possible nor intended in this operating mode. The basic readiness of the former delivery station II may include both a continuous deposition and an optional deposition or bypass during normal operation, as described above. Thus, in this operating mode, delivery device 03 is operated using a reduced number of delivery stations I; II, rather than all the delivery stations I; II that make up the delivery device 03. In this operating mode, during normal operation all incoming sheets B are conveyed past the deactivated delivery station I; II and cannot be deposited there automatically or via a manual control command.

For such a production run or production phase involving a decreased number of piles, the delivery station I that will not be used for pile formation, e.g. the first delivery station I is deactivated, for example. The pile delivery I in question can be deactivated during press configuration for the upcoming run, i.e. during the specification and/or presetting of the units that will be involved in the upcoming run. This can be performed directly from a control console, or from control means that are in signal connection with said control console, or automatically via input production data.

For displacing braking system 48 or at least the operative surface 112 thereof, or the variable-operative-length sheet guiding element 47.4 or the downstream end thereof, of the deactivatable pile delivery I, an aforementioned drive means 63 is provided, preferably along with a control means S63 in signal connection thereto, which positions braking system 48 or the operative surface 112 thereof and/or at least the downstream end of the variable-operative-length sheet guiding element 47.4 of the upstream pile delivery I based upon the operating mode of delivery device 03, either in a first operating mode based upon the format length $L_B$; $L_{B'}$ currently being delivered, and for operation in the second operating mode, moves the above to a fixedly defined support position $P_2$(48); $P_2$(47.4); $P_S$(48); $P_S$(47.4), which is preferably located at a point downstream of the position $P_1$(48); $P_1$(47.4) that would be specified in delivery device 03 for the format length $L_B$ currently being delivered in the first operating mode.

As described above, holding means 92 of braking system 48 comprises an operative surface 112, which, when activated, can be brought into form-fitting or friction-locking operative contact with an incoming sheet B, wherein in an advantageous embodiment, in at least one operating mode in which an incoming sheet B will be deposited in the assigned pile delivery I, the operative surface 112 to be brought into form-fitting or friction-locking operative contact with substrate sheet B can be forcibly moved in transport direction T by means of a drive 106, at a variable holding means speed v92.

To operate delivery device 03 in the second operating mode of delivery device 03, in which the forward pile delivery I is deactivated, braking system 48 itself, or at least an operative surface 112 of braking system 48 that comes into operative contact with substrate sheet B, and/or a downstream end of the variable-operative-length sheet guiding element 47.4 of the forward pile delivery I is moved to a fixedly defined support position $P_2$(48); $P_2$(47.4); $P_S$(48); $P_S$(47.4), which is located at a point downstream of the position $P_1$(48); $P_1$(47.4) that is occupied by braking system 48 or the operative surface 112 thereof or by the downstream end of the variable-operative-length sheet guiding element 47.4 for the format length $L_B$ of sheets B being delivered in delivery device 03 in an operating mode in which pile delivery I is activated. This point is preferably located downstream of the position $P_1$(48); $P_1$(47.4) that would be specified for the format length $L_B$ of sheets B being delivered in delivery device 03 in the first operating mode.

Operative surface 112, which is located in the support position $P_2$(48); $P_2$(47.4); $P_S$(48); $P_S$(47.4) when pile delivery I is deactivated, is preferably moved in transport direction T, at least as long as form-fitting or friction-locking operative contact exists between the conveyed sheet B and the operative surface 112, at a speed v92 that corresponds as described above approximately, i.e. with a maximum deviation of ±10%, to the current conveying speed v32 of conveyor system 21.

Support position $P_2$(48); $P_2$(47.4); $P_S$(48); $P_S$(47.4) can be the same as position $P_2$(48); $P_2$(47.4), which is the position to be set for the smallest format length $L_B$ of sheets B to be deposited in the first operating mode. In other words, braking system 48 itself, or at least an operative surface 112 of braking system 48 that comes into operative contact with the substrate sheet B, and/or a downstream end of the variable-operative-length sheet guiding element 47.4, is set to the smallest deliverable format, e.g. the minimum format. In principle, the movement path may extend downstream beyond this minimum format setting, in which case the support position $P_2$(48); $P_2$(47.4); $P_S$(48); $P_S$(47.4) can be determined by the downstream boundary of the potential movement path.

In an advantageous embodiment, for the second operating mode, at least one lateral stop system 103 is also set for the pile delivery I that is or will be deactivated. This can be carried out in the manner set forth above.

If movable stop means 83 (see e.g. below) are provided at the upstream end of the conveyor line that follows the delivery station I in question, these stops are moved out of the movement path of the sheets B in the second operating mode or will be moved out of said path in preparation for the second operating mode.

In an alternative embodiment for operation in the aforementioned second operating mode, which involves at least one deactivated delivery station I to be bypassed, in place of or optionally in addition to the aforementioned positioning of braking system 48 or the holding means 92 thereof and/or the positioning of sheet guiding element 47.4, the free length of the sheet travel gap can be shortened by other mechanical support means. Said mechanical support means may be, for example, a sheet guiding element, formed, e.g. by the correspondingly raised support device 36; 37, or by a sheet guiding means, e.g. a guide plate, arranged thereon. For example, for the second operating mode, support device 36; 37 in the delivery station I in question is moved by vertical positioning to a position close to the transport path, e.g. its highest possible position. In addition, before, during, or after said support device reaches this position, said sheet guiding means can be placed thereon or inserted therein.

Figure 8:
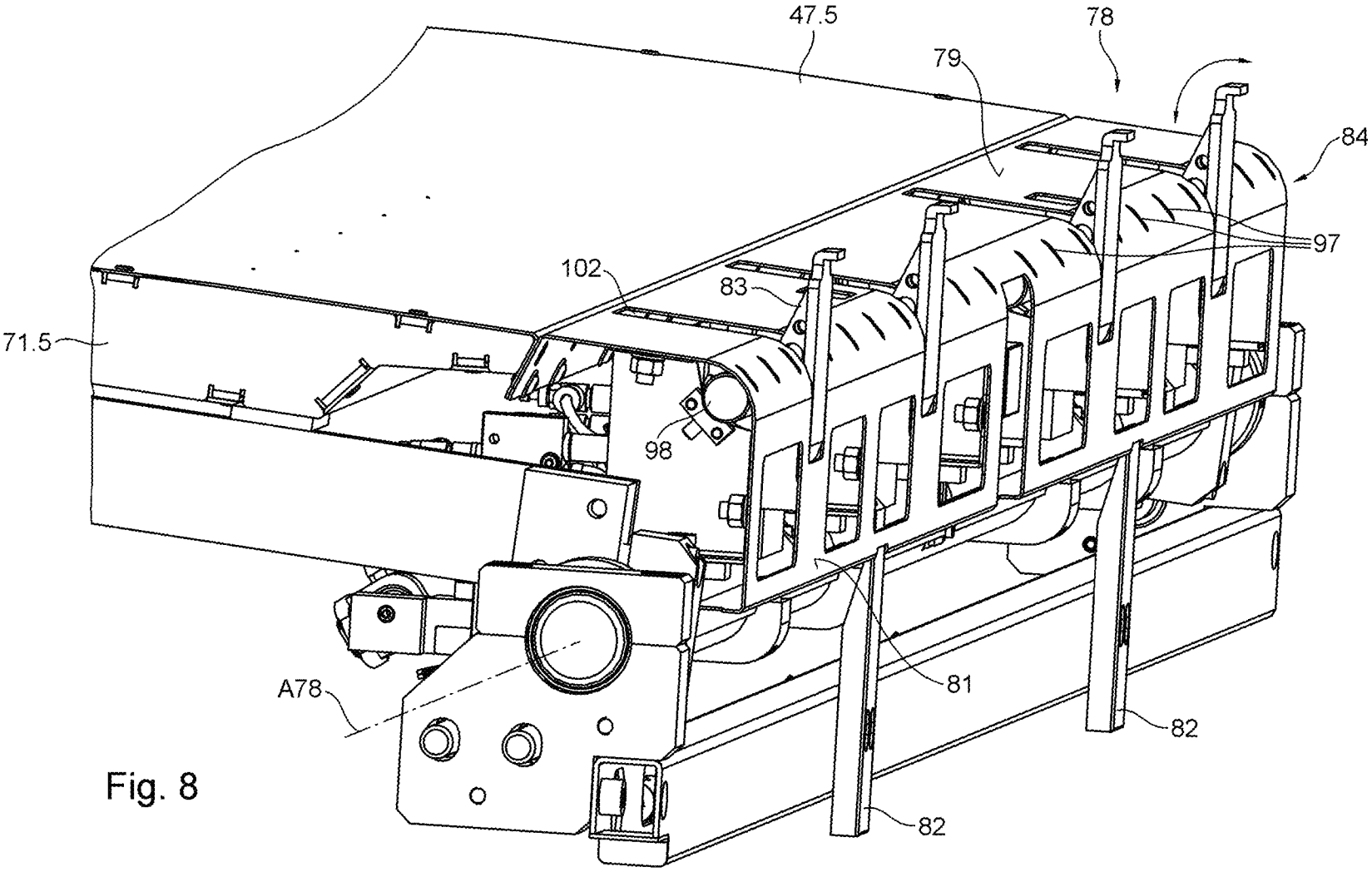
FIG. 8 an approach section of the sheet guiding device for conveying sheets downstream, disposed downstream of a delivery station.

As mentioned above, approach section 78 has an approach ramp, preferably with a rounded edge 84, in particular upper edge 84, at its upstream end. To create this ramp, the substantially flat guide surface 79 of approach section 78, which faces conveyor system 21, continues in a downwardly curved, e.g. rounded approach surface 81. The substantially flat guide surface 79 is understood to include both actually flat surfaces and also slightly curved surfaces with a consistent radius of curvature of, e.g. at least 1,000 mm, in particular at least 3,000 mm. The rounding of edge 84 is embodied, e.g. such that edge 84 is rounded in such a way that the profile, as viewed in a vertical section extending in the transport direction, of the upper side between a first point that lies in the region of the still flat or slightly inclined guide surface 79 and a second point, at which the slope of a tangent is 45° relative to that at the first point, has a radius of at least 50 mm, and/or such that the profile of edge 84 between the end of the flat or at least substantially flat guide surface 79 and a point on the approach surface 81, which is perpendicular to the profile of the former plane and is spaced 50 mm therefrom, has a radius of curvature at any point of at least 5 mm, preferably at least 10 mm, and preferably has a maximum radius of curvature of, e.g. 500 mm, in particular of 200 mm. The radius of curvature here need not be constant in the section in question, and instead may vary. A side that comprises the aforementioned rounded approach surface 81 can, in principle, be embodied as continuous, interrupted in areas, or composed of multiple parts in the transverse direction, i.e. in the direction of the width of the delivery system (see, e.g. FIG. 8). The term "flat guide surface" is intended in the following to include the aforementioned case involving a slightly curved surface.

The "edge" 84 of approach section 78 as set forth above is understood here as the upper corner region of approach section 78, regardless of whether it is formed, e.g. by the rounded corner of a solid component or, e.g. by a sheet metal plate that is bent downward.

In or upstream of the vertical alignment of approach surface 79, and below the level defined by guide surface 79, stop means 81 of a stop device are preferably provided, which limit the movement in transport direction T of sheets B to be deposited in the first delivery station I. Along these stop means 82, the downstream pile edge of pile 11 to be formed is formed. Movable stop means 83 may also be provided, which in a first, e.g. active operating mode, project beyond the height defined by guide surface 79, and in a second, e.g. inactive operating mode are positioned below this level, by means of a drive system 64 having at least one drive means 99. In a less complex embodiment, a plurality of stop means 83 are or can be movable together via a link or a shaft, for example. Approach section 78 may include air passage openings 68; 69, in particular blower air openings 69 or blower air-operated air passage openings 69, in the region of its guide surface 79 and/or in the region of its approach surface 81 and/or in the region of its rounded edge 84.

In a first preferred embodiment of approach section 78, said section comprises a blower system having one or preferably a plurality of blower air openings 97 in the area of rounded edge 84, i.e. in a curved surface section 84 adjoining flat guide surface 79 upstream. The blower air openings 97 may be formed as round or preferably slot-shaped recesses 97 in a material section 84, in particular a metal plate section 84, that forms the rounded edge 84, and can be supplied with blower air from inside the approach section 78, i.e. from the side of material section 84 that faces away from substrate transport. The supply of blower air may be formed by an air module attached to material section 84 on the inside.

In a preferred embodiment, the supply of blower air is provided via by a blower air line 98 extending in the transverse direction on the inside of the material section, the wall of which in turn comprises outlet openings arranged corresponding to the blower air openings 97. The shape of blower air line 98, at least on its side that faces material section 84, preferably conforms to that of the inside of the material section. For example, blower air line 98 is embodied as a blower bar with a circular outer peripheral cross section, and material section 84, at least in the portion thereof opposite blower air line 97, is configured as a circular arc in cross-section. The blower air openings 97 provided in material section 84 have a larger opening cross-section than the outlet openings, at least in a direction that extends in the direction of movement of the substrate sheets that are guided over approach section 84. This ensures a more reliable passage of air, for example.

In a particularly advantageous refinement, blower air line 98, preferably in the form of a tube, can be mounted so as to pivot about an axis that extends in the transverse direction. This allows the position of blower air emission to be adjusted at least slightly along the direction of sheet movement, particularly if blower air openings 97 are larger than the outlet openings, as described above. In principle, the approach section 78 configured in this way may be provided in the area of the beginning of a conveyor line that comprises sheet guiding elements, regardless of the embodiment of delivery device 03 with a plurality of delivery stations I; II. Preferably, however, it is provided at the start of a conveyor line located between two delivery stations I; II.

Ordinarily, sheet B, which is guided only at its leading edge by conveyor system 21 or holding device 32, in particular holding elements 56, drops into the shaft of the delivery station I; II it is passing over, until it reaches equilibrium with the air cushion that naturally forms on its underside. Continuing sheet guidance along a predominantly horizontal guidance path can lead to a detrimental jump in height at the end of the delivery station I; II being bypassed—particularly in certain operating situations involving a low pile level, for example. In such cases, the natural air cushion is not sufficient to act as a supporting surface that can lift sheet B above this stage and onto the subsequent sheet guiding element 47.5; 78, in particular approach plate 78. Especially at higher speeds, the underside of the sheet B may be impacted, with the contact resulting in damage.

These potential effects can be avoided or at least mitigated by one or more of the aforementioned measures (rounding and/or blower air). Alternatively or in addition to one or more of the described measures, in a particularly advantageous embodiment of delivery device 03 and/or of sheet guiding device 47 and/or of the sheet guiding element 47.5; 78 which is disposed immediately downstream of a delivery station I; II, in particular of an approach section 78 which is part of a sheet guiding element 47.5 or is disposed upstream thereof, said element or at least the guide surface 79 thereof that faces the guided sheet B is configured and/or mounted with at least its upstream end in a variable vertical position. More particularly, this sheet guiding element 47.5; 78 or this approach section 78 is embodied such that its vertical position can be varied by means of a controllable drive means 283.

At least the upstream end of approach section 78 can be adjusted in terms of height to the variable pile height, i.e. the height of the topmost sheet B in the pile 11; 12. The height of this end can be adjusted automatically, in particular via control means, to the variable pile height. For this purpose, drive means 283, which is part of the actuating drive, in particular the control unit or drive controller thereof, is in signal communication with a control means that adjusts the vertical position of at least the end of sheet guiding element 78, on the basis of and/or in correlation with the pile height.

Figure 9:
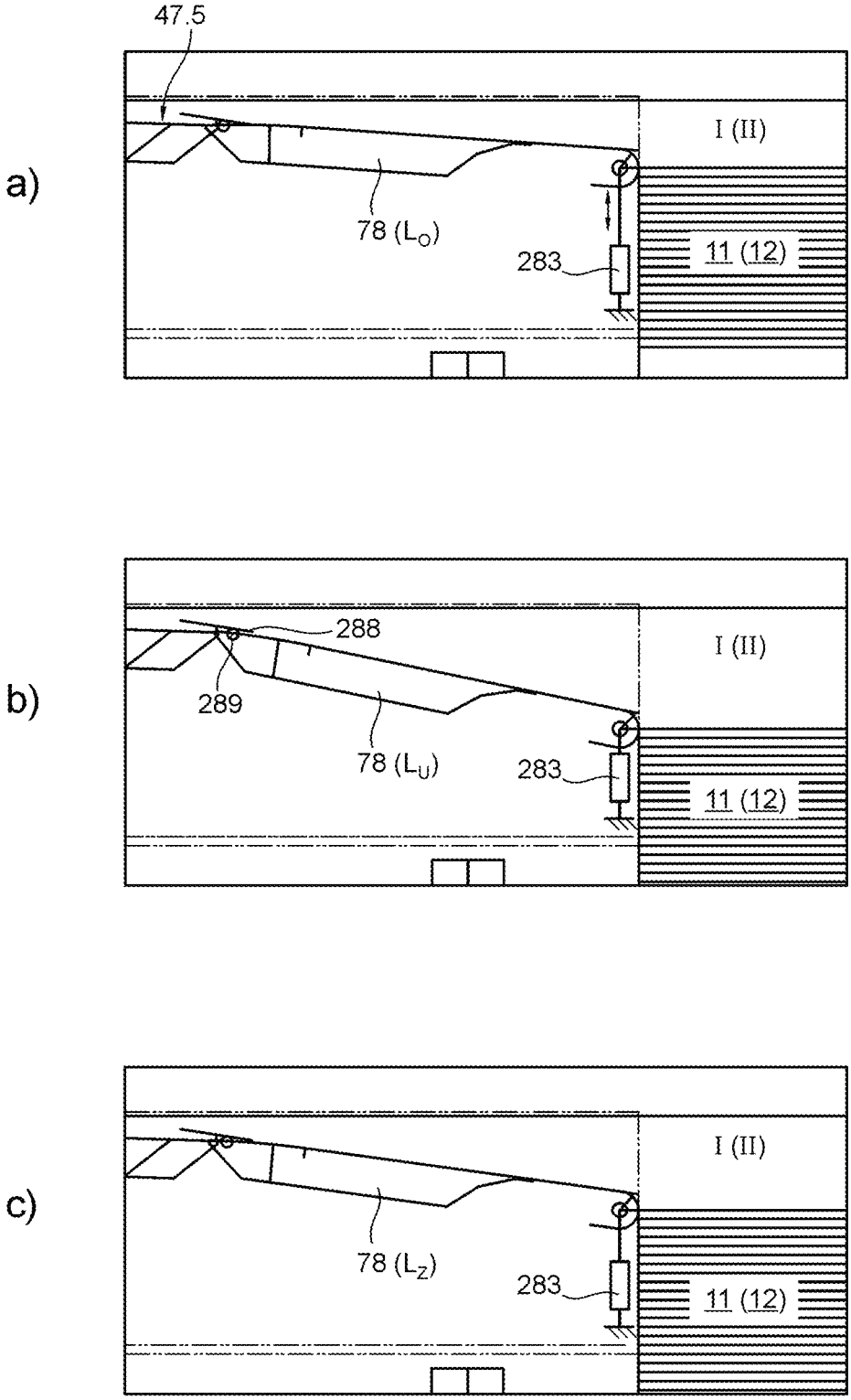
FIG. 9 a schematic representation of an embodiment of a delivery device having an approach section which is vertically movable at its upstream end, in a) the upper position, b) the lower position, and c) an intermediate position.
Figure 10:
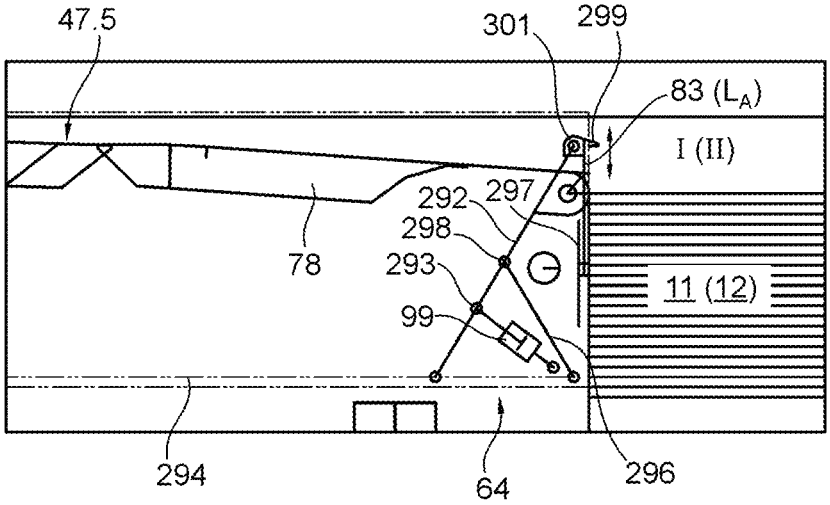
FIG. 10 a schematic representation of an embodiment of a delivery device having a stop device that comprises a catching or holding device, in a) the stop position and b) the holding position.
Figure 10:
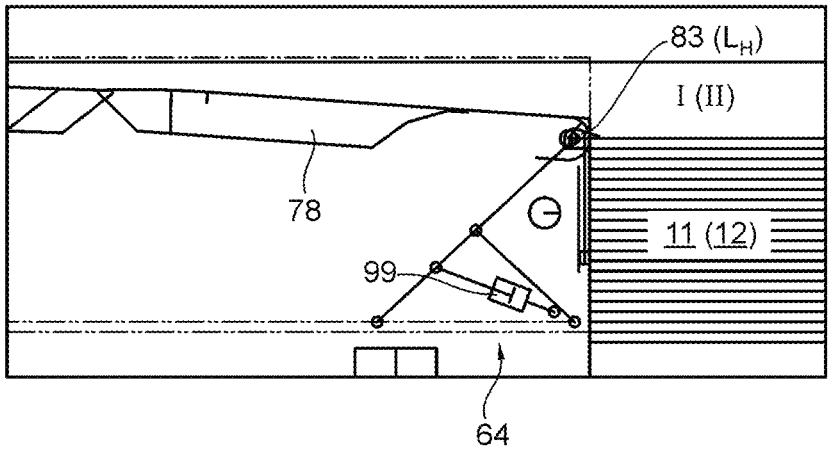

Positioning and/or variation are carried out at least within an adjustment range specified for normal operation that extends from an upper position $L_O$, in which, during production printing with an already partially formed pile 11; 12 of minimum height, sheets are deposited without further variation of the height of the approach section 78 until the target pile height is reached, down to a lower position $L_U$, in which, e.g. during production operation, sheets are deposited from the start of pile formation (see, e.g. FIGS. 9*a*) and *c*)). The latter position is approached, for example, when the time required to move pile board 36; 37 until it reaches the working height it occupies during production printing is to be at least partially used, and/or if at the start of pile formation, the working height, i.e. the level of the topmost layer of sheets ideally to be occupied during the aforementioned production printing, cannot be reached with low pile heights due to a limited travel range of the pile board 36; 37. Although in principle the positions $L_Z$ located between these two positions $L_O$; $L_U$ (see, e.g. FIG. 9*b*) may be approached steadily in other specific operating situations, they are typically traversed only dynamically on the way between the other two positions $L_O$; $L_U$. The adjustment range between the upper and lower positions $L_O$; $L_U$ specified for normal operation is typically at least 50 mm, for example, preferably more than 100 mm. In principle, positions beyond these two boundaries (position $L_O$ and position $L_U$) on one or both sides are possible, but only for set-up or maintenance tasks or other non-operational activities, for example.

Due to the above-described variability, approach section 78 is configured and/or mounted such that it connects the pile height present at a given time, including for reduced levels as compared with the maximum pile height or the pile height used during production printing, to the preferably horizontal sheet guidance level, which is higher in this case, i.e. with the level defined by the profile of the conveyor system. Here, the "pile height" is understood as the vertical position of the upper end of the pile.

A motor 283, for example, in particular an electric motor 283, is provided as drive means 283, which meshes directly or indirectly, e.g. via a transmission 284, with sheet guiding element 47.5; 78 or approach section 78. A spindle drive 284 can advantageously be provided as transmission 284, with the threaded spindle 286 thereof, driven by motor 283, meshing with a bearing block 287, which is connected directly or indirectly to sheet guiding element 47.5; 78 or approach section 78. In principle, the drive for varying the position may be implemented on only one side by means of only one actuator with motor 283, or from two sides, by means of one actuator each with motor 283. In an advantageous embodiment, positioning is carried out by means of an actuating drive with only one motor 283, but from two sides. For this purpose, transmissions 284 that mesh directly or indirectly with approach section 78 on both sides are provided, for example, the movement of which is mechanically synchronized, e.g. via a shaft 291. The two synchronized drive trains of the actuating drive are driven by a motor 283 at some point, for example on one of the two sides.

Sheet guiding element 47.5; 78 or the drive means 283 for varying the vertical position of sheet guiding element 47.5; 78 may be manually adjustable, for example via control elements not shown here. In place of or advantageously in addition to this, sheet guiding element 47.5; 78 or the drive means 283 for varying the vertical position of sheet guiding element 47.5; 78 is preferably adjustable automatically via control means, preferably in correlation, at least within an adjustment range or sub-range specified for operation, with the vertical position of the top side of the pile in the pile space 44; 46 upstream. Thus, during operation the vertical position of at least the upstream end of approach section 78 is varied in correlation with the vertical position of the top of the pile in the pile space 44; 46 upstream. Here, the vertical position of the upstream end or the drive means 283 can be controlled, for example, on the basis of information that represents the position of the top of the pile. Alternatively, or in addition to the above, the vertical position of the upstream end or drive means 283 can be controllable and/or controlled in conjunction with and/or in correlation with the control of the vertical position of pile board 36; 37.

To supply the information representing the position of the top of the pile, a sensor system configured for this purpose, for example, may be provided. The output signals thereof, or results obtained from these, are or can be forwarded, e.g. to the control means. For example, a distance sensor may be provided above the pile 11, 12, or a sensor system that detects the upper edge of the pile may be provided in the upstream end face of approach section 78.

Sheet guiding element 78 is preferably disposed and/or mounted in delivery device 03 in such a way that, when the variation in the vertical position of the upstream end of sheet guiding element 78 lies within the adjustment range specified for operation, the end face of sheet guiding element 78 that faces the upstream pile space 44; 46 vertically opposite transport direction T comes to rest on a substantially vertical line. In this case, the "substantially vertical line" is meant to include an actually straight vertically extending line, as well as a straight line that extends with a maximum deviation of 5° from vertical, or a constantly or variably curved line, whose minimum radius of curvature corresponds to twice the length of sheet guiding element 78 extending in transport direction T. Common among all of these lines is that the end surface regions closest to the pile space, which are each directed opposite the transport direction T in the respective vertical position, and thus also the position of first contact with an incoming sheet B, does not change significantly in the horizontal direction, despite a vertical variation.

This substantially vertical positioning of the upstream end is implemented by means of an actuating drive, which engages with approach section 78 directly at or at least near the end that will be moved, i.e. for example within a first one-tenth of the length of the sheet guiding element in the transport direction (T) and displaces approach section 78 at the point of engagement along a vertically extending rectilinear movement path.

In an advantageous embodiment, sheet guiding element 78, or the approach section 78 also referred to, e.g. as approach plate 78, is embodied and/or mounted in one advantageous variant such that, when the vertical position of the upstream end is varied, the vertical level of guide surface 79 that supports sheets B at the downstream end remains unchanged. However, in light of the guide element dimensions, this includes negligible deviations in the range of a few millimeters, e.g. up to 5 mm. By maintaining this level, a transition to a downstream section or to sheet guiding element 47.5 can be kept quasi-continuous in the above sense, irrespective of the vertical position of the upstream end.

If the aforementioned height variation of the upstream end along the aforementioned substantially vertical line is provided, and if the level at the downstream end is maintained, then a guide device having a stop means 288 that is fixed relative to the frame is provided, which cooperates with a stop means 289 that is fixed relative to the approach section, and in particular is provided in a region of approach section 78 that is closer to the downstream end than to the upstream end, in order to bring the downstream end of approach section 78 into the specified position.

Said stop means 288; 289 are configured such that, when the upstream end is varied vertically along the substantially vertical line and the downstream end executes the horizontal movement associated therewith, then the guide surface 79 functioning in the area of transition to the sheet guiding element 47.5 that follows downstream maintains the level, as described above. In this case, e.g. at least one of stop means 288; 289 comprises a correspondingly shaped stop cam on which the corresponding stop means 289; 288 is supported during relative movement. For example, stop means 288, which is fixed relative to the frame, comprises such a cam, on which stop means 289, which is fixed relative to the approach section and is embodied, e.g. as a roller 289, runs. Stop means 289, which is fixed relative to the approach section, may be supported from below by stop means 288, which is fixed relative to the frame, with gravity, optionally i.a., providing for a secure contact. Conversely, stop means 289, which is fixed relative to the approach section, may be forced from below against the corresponding, frame-fixed stop means 288. The latter case can be implemented either statically via a spring element acting on approach section 78, or via a drive means, with which, e.g. the corresponding stop means 288; 289 can be brought into and out of contact with one another. In the embodiment that has an embodiment of an approach section 78 as described below, in which the downstream end can be pivoted away in the event of a malfunction, the drive means that engages on approach section 78 and ensures contact between the corresponding stop means 288; 289 may be formed by the drive means 104 that effects the pivoting.

Approach section 78, the vertical position of which is variable in this way, is preferably provided at the beginning, or at the upstream end of a conveyor line disposed between two delivery stations I; II. The downstream end of approach section 78 can be followed by a section of the same sheet guiding element that preferably extends horizontally, or by an additional sheet guiding element 47.5 that preferably extends horizontally. In a further variant, the sheet guiding device can end with the upstream end of approach section 78 in the conveyor line located between two delivery stations I; II.

Approach section 78, also called approach plate 78, can be composed of multiple parts, e.g. multiple adjoining guide plates. The guide contour of approach section 78 can thus comprise both flat and curved sections. In an advantageous embodiment, approach section 78 comprises the aforementioned air passage openings, in particular blower air openings 69; 97, in the region of guide surface 79, and/or includes the same in the region of bent edge 84. For this purpose, approach section 78 is supplied, e.g. with blower air in the manner described above.

In addition to the aforementioned blower system and/or the vertically variable embodiment of the upstream approach section end, or on its own, in a further advantageous embodiment or variant of an approach section 78, an aforementioned stop device can be embodied such that a plurality of stop means 83; 86 arranged side by side in the transverse direction can be moved, e.g. pivoted or moved translationally, individually or at least in a plurality of groups, between the active and the inactive position by a corresponding number of drive systems 64 and drive means 99.

In principle, drive means 99 for moving all, a group of, or preferably the individual stop means 83; 86 can be any type of drive. Preferably, however, it is embodied as a cylinder-piston system 99 that operates using pressurized fluid, in particular as a pneumatic cylinder 99.

In principle, the pneumatic cylinders 99 for moving the individual stop means 83; 86 of the groups thereof can be controlled and/or supplied with compressed air via one common switching valve. Preferably, however, each group or each stop means 83; 86 to be moved individually is equipped with its own switching means 101, in particular switching valves 101, or valves 101, the intake side of which is connected to a compressed air source, for example, and which be controlled via appropriate control signals to allow the compressed air to flow through to the output side, and from there via a line connection to the pneumatic cylinder 99 in question.

In principle, the switching means 101 or valves 101 assigned to the groups or preferably to individual stop means 83; 86 via the drive means 99 can be combined at a centralized point, for example in the manner of a valve terminal. In a preferred embodiment, however, switching means 101, in particular valves 101, are arranged in a decentralized manner and/or at least in groups, or preferably all distanced from one another spatially, in particular each disposed close to the pneumatic cylinder 99 to which it is assigned. In that case, each switching means 101 or valve 101 is disposed closer to its assigned pneumatic cylinder 99, for example, than to the other or one of the other pneumatic cylinder(s) 99. In any case, however, they are at least disposed closer to their assigned pneumatic cylinder 99 than one-half the distance between the two most widely spaced pneumatic cylinders 99.

The switching of valves 101 is synchronized and/or correlated, for example, with a press phase position and/or substrate phase position by control means S83 (S86) of a control device, which is in signal communication, for example, with a sensor or a master from which it receives the information I(Φ) that relates to and/or represents the press phase position and/or substrate phase position. The stops can then be moved into the active position, for example precisely within a gap between two approaching substrate sheets B. If sheet travel is known and/or constant, delay compensation can be accomplished through a pre-control process, for example.

Control means S83 (S86) may be part of a higher-level press controller or may be provided in a decentralized location and, if necessary, connected to such a press controller.

Stop means 83; 86 are controlled, e.g. on the basis of whether a substrate sheet B will be deposited in the upstream delivery station I; II or will be conveyed further to another delivery station II or to a test sheet removal point.

In the case of the aforementioned blower system integrated into the region of edge 84, for example, the supply of air is activated and deactivated on the basis of whether a substrate sheet B will be deposited in the upstream delivery station I; II or will be conveyed further to another delivery station II or to a test sheet removal point.

In an advantageous refinement of approach section 78, blower air openings 69, in particular in the form of Venturi nozzles 69, are provided in guide surface 79 and/or in the surface of sheet guiding element 41.5 that continues guide surface 79.

In a first embodiment, pivotable stops 83 can be provided as stop means 83, for example. In that case, the movable, in particular pivotable stops 83 can be integrated into the upstream end of approach section 78 and/or disposed thereon. For this purpose, guide surface 79 includes, e.g. recesses 102, into which the stops 83 formed in the first embodiment, for example, can be lowered in their inactive state.

In the embodiment in which the upstream end of the approach section is vertically variable, this stop device having pivotable stop means 83 can then be disposed fixed relative to the frame or can be movable vertically together with the end of the approach section.

Furthermore, in a variant of this embodiment of the stop device comprising pivotable stop means 83, not shown here, mechanical holding devices can be integrated into the approach section 78 module, which hold down substrate sheets B that have already been deposited into the upstream delivery station I, while subsequent substrate sheets B are forwarded to another delivery station II or to a removal point. If another sheet B will be deposited on pile 11, 12 of the upstream delivery station I, for example, such a holding device can be removed from the movement path, in particular at least from the drop path, of sheet B, preferably at least for the time required for such deposition. A holding device of this type can prevent, or at least impede or inhibit, the entrainment of sheets B that have already been deposited.

To change the deposition point from the first pile to a downstream pile 11; 12, e.g. from waste pile 11 to good sheet pile 12, the stop means 83 that catch sheet B and are required for deposition on the first pile 11 are moved out of the movement path of sheets B, to provide a free passageway for the conveyance of substrate sheets B, e.g. good sheets. In so doing, however, the problem can arise that, e.g. even if a blower system is provided, the sheets B most recently deposited, which may form a "buoyant" ream that still contains air pockets, and due to the fluid-mechanical forces of the holding devices 32 embodied, e.g. as gripper carriages 32, which are conveying the sheets B at full speed, a drift may be created, which can ultimately lead to an entrainment of the ream or of individual sheets B.

To counteract this effect, one or more stops 83, configured as in the first embodiment described above, can be embodied and movably mounted in such a way that, in the active state, i.e. in the active position, they are located within the travel path of substrate sheets B, with the side of said stops that faces the leading ends of the sheets, e.g. a stop surface, acting as a forward stop, and in the inactive state, i.e. in the inactive position, they are moved out of the travel path of approaching substrate sheets B, i.e. they are disposed outside of the travel path, and do not act as a stop for approaching substrate sheets. In addition, a holding means 299 that is forcibly carried along when stop means 83 is moved and that protrudes beyond the stop surface in the direction of the approaching substrate sheets B in at least one inactive position of stop means 83 is assigned to each of the one or more movable stop means 83 and, when stop means 83 is in the inactive position, the holding means holds the topmost substrate sheet B back, in the region of its downstream edge, to prevent it from being lifted off and carried away by substrate sheets B that are being conveyed past. When the stop means 83 to which holding means 299 is assigned is in the active position, the holding means preferably comes to rest downstream of and/or above the movement path of the substrate sheet B to be deposited on pile 11, and when the assigned stop means 83 is in the inactive position, the holding means preferably comes to rest below the travel path of the substrate sheet B that will be conveyed beyond pile 11 and above the topmost substrate sheet B of pile 11.

Thus, when stop means 83 is inactive, the holding means 299 assigned to stop means 83 holds the topmost layer of pile 11 down, preventing it from being lifted off and/or entrained by subsequent substrate sheets B being conveyed past. In its holding position, holding means 299 can be brought actually or nearly, e.g. with at most only a slight distance, into physical contact with the topmost layer of the pile. A maximum slight distance can correspond, e.g. to the length, from an overhead view, by which holding means 299, in the holding position, overlaps the pile footprint at the downstream end of pile 11 in transport direction T.

In a preferred embodiment, holding means 299 can be assigned in such a way that the part of stop means 83 that is its upper part in the inactive position comprises the holding means 299 that extends over the pile edge upstream. Alternatively, a holding means 299 could also be connected, rigidly or via a mechanical coupling, to stop means 83 in such a way that a movement of stop means 83 necessarily forces the required movement of holding means 299, and/or conversely, a movement of holding means 299 forces the appropriate movement of stop means 83.

Stop means 83 is preferably embodied as a stop 83 which, in the active position, serves as a forward stop for the approaching substrate sheet B, and which comprises, in particular at its end that is its upper end in the inactive position, as a holding means 299 for holding down the topmost layer of the pile, a projection 299 in the form of a holding finger that is bent down in the upstream direction, which extends upstream over stop surface 302, and, at least as holding means 299, overlaps the pile footprint at the downstream end thereof. The projection 299 or holding finger for holding sheets down can also be referred to as front lay cover 299.

In the embodiment of stop means 83 that comprises holding means 299, when substrate sheets B to be deposited, e.g. waste sheets, are deposited onto pile 11, they strike these movable stop means 83 or stops 83. When substrate sheets B, e.g. good sheets, will be conveyed past pile 11, e.g. to a delivery station II downstream, these stop means 83 are moved from their "catch position" within the movement path, to a retracted position outside of the movement path, wherein the holding means 299 or front lay covers 299 that are part of the stops 83 hold the topmost sheet on the pile down, preventing it from sliding and/or being carried away.

In principle, stop means 83 can be moved via pivoting, in which case, e.g. in contrast to the embodiment described above, pivoting into the retracted position is carried out not downstream, but in the upstream direction. In that case, when stop means 83 is pivoted upstream, for example, it can hold down the topmost sheet on the pile. Movement can also be executed along any other movement path, as long as stop means 83 and the holding means 299 assigned to it assume the positions specified above.

In an embodiment that is preferred here, however, stop means 83 is disposed and/or mounted such that the stop means 83 comprising holding means 299 is moved along a straight line, in particular along a substantially vertical line, i.e. in a direction that deviates no more than 5°, in particular no more than 2°, preferably no more than 1° from vertical. The movement of stop means 83 is preferably guided such that the holding surface, or at least a point thereon, that faces the sheet B to be held is subjected to precise linear guidance.

Stop means 83 is preferably disposed and/or mounted such that during the retraction movement, throughout the entire operational adjustment range, which extends, e.g. from an upper position, in which an incoming sheet B is or is intended to be captured, to a lower position, in which an incoming sheet B is able to pass and the upper sheet on the pile is held down, holding means 299 never completely leaves the pile footprint in the region of the downstream end of the pile, i.e. from an overhead view, an aforementioned overlap always remains between holding means 299 and the pile footprint. The retraction movement ends, for example, in contact or at least nearly in contact, as defined above, with the topmost sheet B on pile 11.

As specified above, drive means 99 for moving all, a group of, or preferably the individual stop means 83; 86 can, in principle, be any type of drive, but is preferably embodied as a cylinder-piston system 99 that operates using pressurized fluid, in particular as a pneumatic cylinder 99.

The above description relating to the pressurization of pneumatic cylinder 99, the number and location of switching means 101, in particular control valves 101, and the actuation thereof via control means S83 (S86) of a control device can and should be applied here accordingly.

In principle, the drive means 99 that effects movement, e.g. pneumatic cylinder 99, can engage directly on the output side of the stop means 83 that comprises holding means 299. Preferably, however, stop means 83 is driven via a transmission, e.g. via a transmission that increases the adjustment distance of drive means 99. In an advantageous embodiment, this transmission is embodied as a coupling mechanism, more particularly as a quick-release coupling mechanism. This is embodied, for example, as a straight-line gearing mechanism based on an isosceles slider-crank mechanism. For this purpose, the stop means 83 to be moved cooperates at least at one point in its direction of movement with a guide 297, e.g. linear guide 297, so that stop means 83 can be or is moved with linear guidance, at least at the level of said point. In principle, a point on stop means 83 that is spaced therefrom as viewed in the direction of movement could also be guided linearly by the same or by an additional linear guide 297. A linkage element 292, e.g. a coupler 292, engages on stop means 83 via a pivot axis 301 that extends perpendicular to the direction of movement defined by linear guide 297. Spaced from this pivot axis 301, an additional linkage element 296, e.g. a crank 296, engages on coupler 292 via an additional, second pivot axis 298 that extends parallel to the first pivot axis 301. Crank 296 is mounted on a frame 303 so as to pivot about a pivot axis 304 that is parallel to the first two pivot axes 301; 298. In a preferred embodiment, the active length of coupler 292 between the first two pivot axes 298; 301 corresponds to the active length of crank 296 between the second and third pivot axes 298; 304.

In principle, any suitable drive mechanism, for example a direct rotary drive of crank 296 or an engagement of a drive means 99 at a point on crank 296 that is spaced from pivot axis 304, may be used for driving the pivoting movement of crank 296 or the crank-coupler system. In these cases, the above-mentioned guidance of stop means 83 at two points spaced from one another in the direction of movement would be advantageous.

In the embodiment preferred here, coupling with the linear guide 297 at multiple points or a coupling that extends significantly in the direction of movement can be dispensed with, since when crank 296 moves, it forces coupler 292 to move along a defined curve, at an engagement point that is fixed relative to the coupler and is spaced from the second pivot axis 298. The second, coupler-fixed engagement point can, in principle, be located within the connecting section that connects the two first pivot axes 298; 301, but is preferably located in a section 307 that is a continuation of said connecting section, beyond the second pivot point 298, in a different direction from the operative direction of the connecting section, in particular in the opposite direction. This section 307 may be embodied as part of a coupler 292 that extends beyond the engagement point of the second pivot axis 298, or as a lever arm that is rigidly connected to coupler 292, but regardless of its embodiment, it will be referred to in the following as the coupler 292 extending section 307.

At this spaced-apart, coupler-fixed point, coupler 292 is preferably forced via a guide 294, e.g. linear guide 294, along a rectilinear movement path, especially extending perpendicular to the direction of movement defined by linear guide 297 and to the first two pivot axes 298; 301. Coupler 292, or the section that forms a continuation thereof, is mounted at this spaced-apart coupler-fixed point so as to pivot via an additional, e.g. fourth pivot axis 306, which likewise extends parallel to the first and second pivot axes 301; 298.

As mentioned above, drive means 99 could, in principle, act directly on crank 296, but preferably engages here on coupler 292, in particular on the section 307 that is an extension of coupler 292. This engagement is implemented, e.g. via an additional, e.g. fifth pivot axis 308, likewise extending parallel to the first and second pivot axes 301; 298 and disposed between the second and fourth pivot axes 298; 306. The drive preferably engages on coupler 292 or on the section 307 which is an extension of coupler 292 at a distance from the second pivot axis 298 that corresponds to less than one-half the distance between the first and second pivot axes 301; 298. These length proportions enable a short stroke of the drive means to be translated into a long positioning movement.

Figure 14:
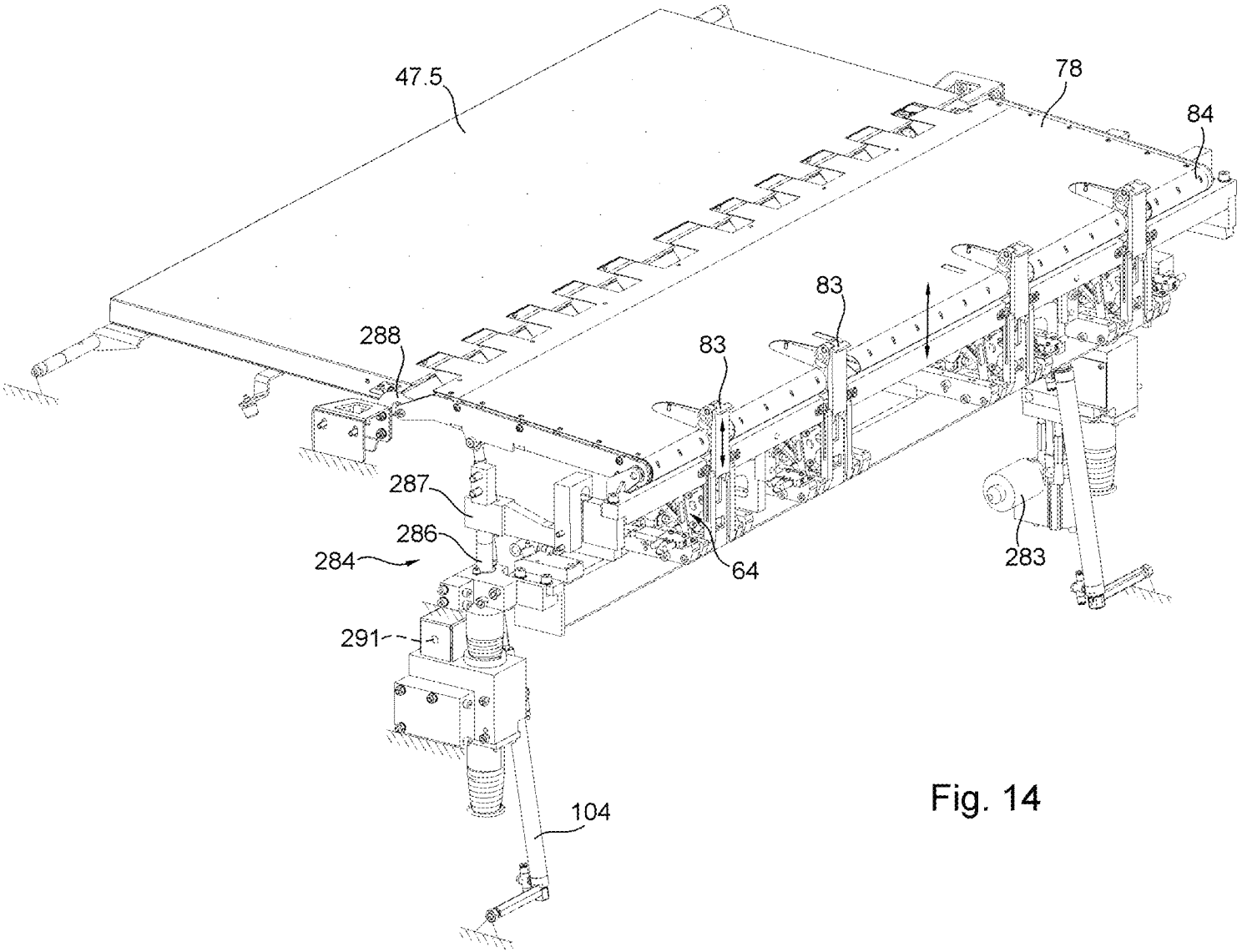
FIG. 14 a three-dimensional oblique view of an embodiment of a delivery device with a vertically movable approach section and a stop device which has a holding means.
Figure 15:
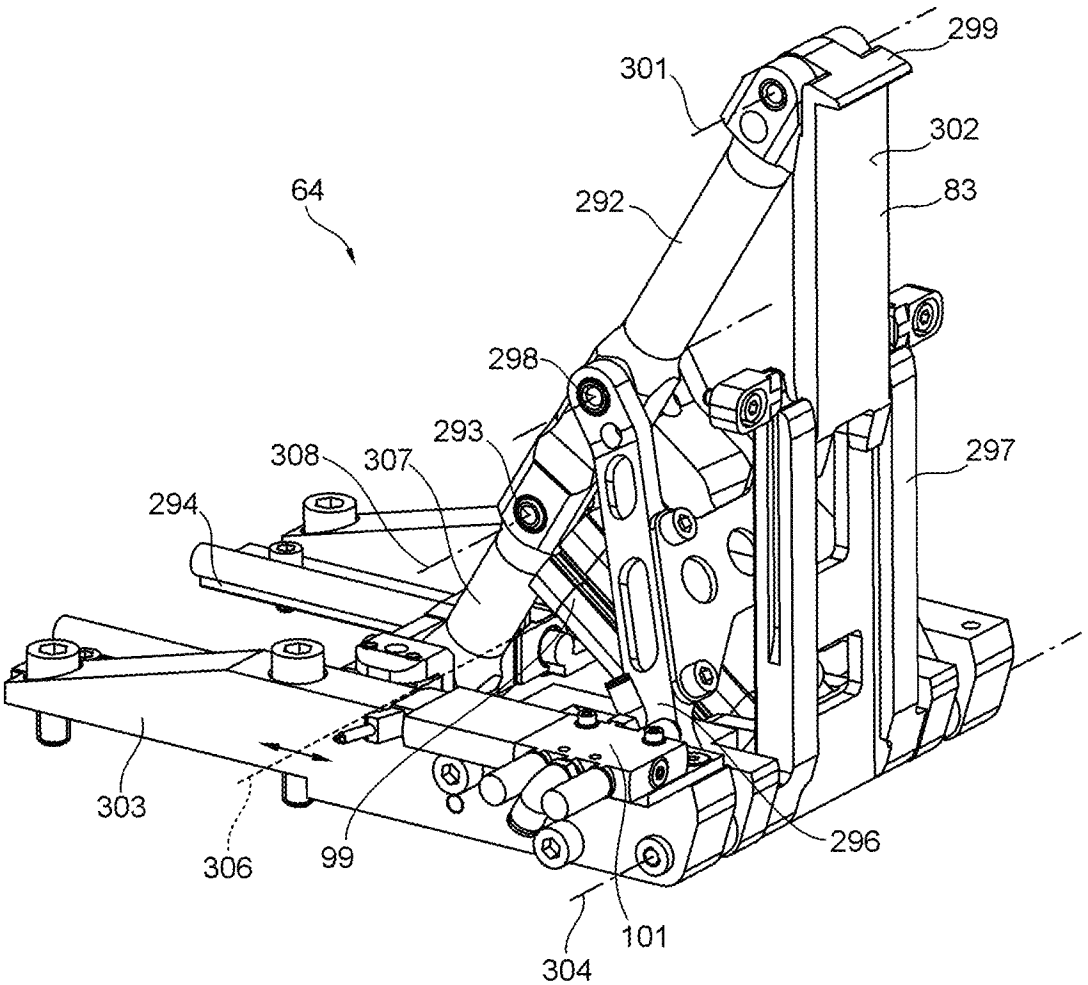
FIG. 15 a detail view of an embodiment of a stop device comprising a catching or holding device.

The transmission engaging on stop means 86 can be embodied and disposed (as shown, e.g. in FIG. 14 and FIG. 15) in such a way that the pivot axes 298; 301; 304; 306; 308 extend perpendicular to transport direction T. Alternatively, however, it may also be embodied and disposed rotated by 90°, so that pivot axes 298; 301; 304; 306; 308 extend in transport direction T.

Although the embodiment of delivery device 03 and/or the sheet guiding device having a sheet guiding element 78 the end of which is variable in terms of its vertical position, disposed adjoining the delivery station, and the embodiment of delivery device 03 and/or the sheet guiding device having the stop device that comprises holding means 299 may be used to advantage on their own, the embodiment in which these are combined offers particular advantages in terms of a safe and smooth transport of substrate sheets B (see, e.g. FIG. 11, FIG. 12, FIG. 13, and FIG. 14).

Figure 13:
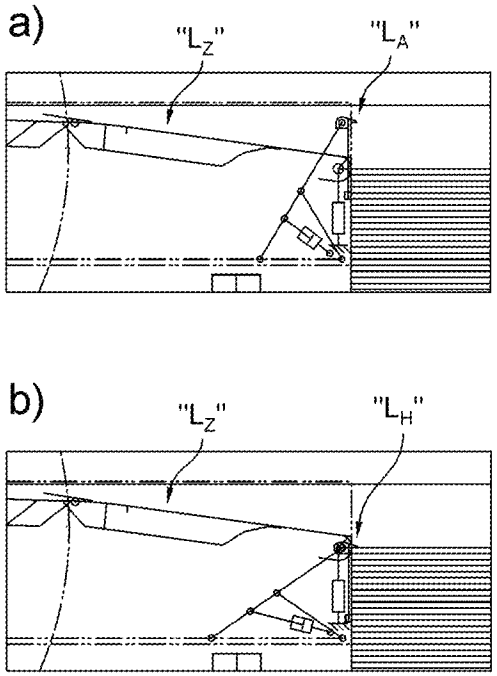
FIG. 13 a schematic representation of an embodiment having a delivery device with a vertically movable approach section and a stop device, with the approach section in the intermediate position and the stop device being shown in a) the stop position and b) the holding position.
Figure 12:
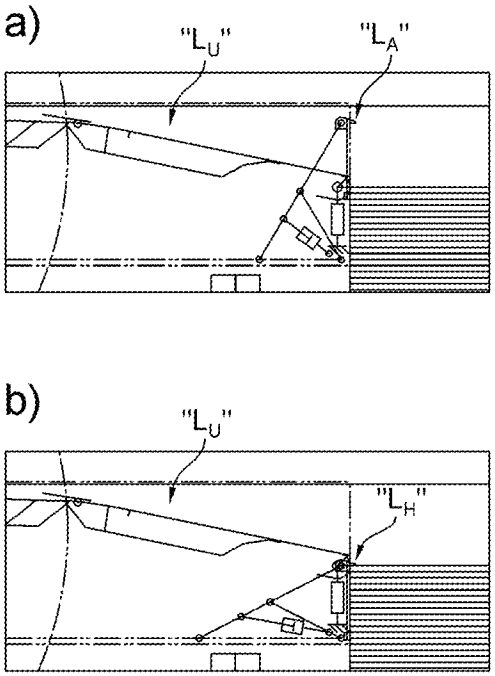
FIG. 12 a schematic representation of an embodiment having a delivery device with a vertically movable approach section and a stop device, with the approach section in the lower position and the stop device being shown in a) the stop position and b) the holding position.
Figure 11:
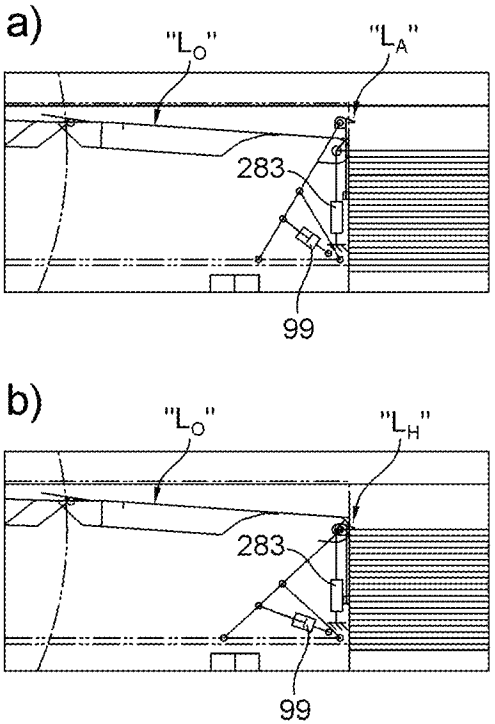
FIG. 11 a schematic representation of an embodiment of a delivery device having a vertically movable approach section and a stop device, with the approach section in the upper position and the stop device being shown in a) the stop position and b) the holding position.

For example, FIG. 11 shows the upstream end of sheet guiding element 78 in the upper position $L_O$, while FIG. 11*a*) shows the stop means 83 comprising holding means 299 in the active stop position $L_A$, and FIG. 11*b*) shows said stop means in the holding position $L_H$. The diagrams of FIG. 12 and FIG. 13 depict the same situation, but in FIG. 12 with the end of sheet guiding element 47.6; 78 in the lower position $L_U$ and in FIG. 13 with the same in an intermediate position $L_Z$.

Figure 24:
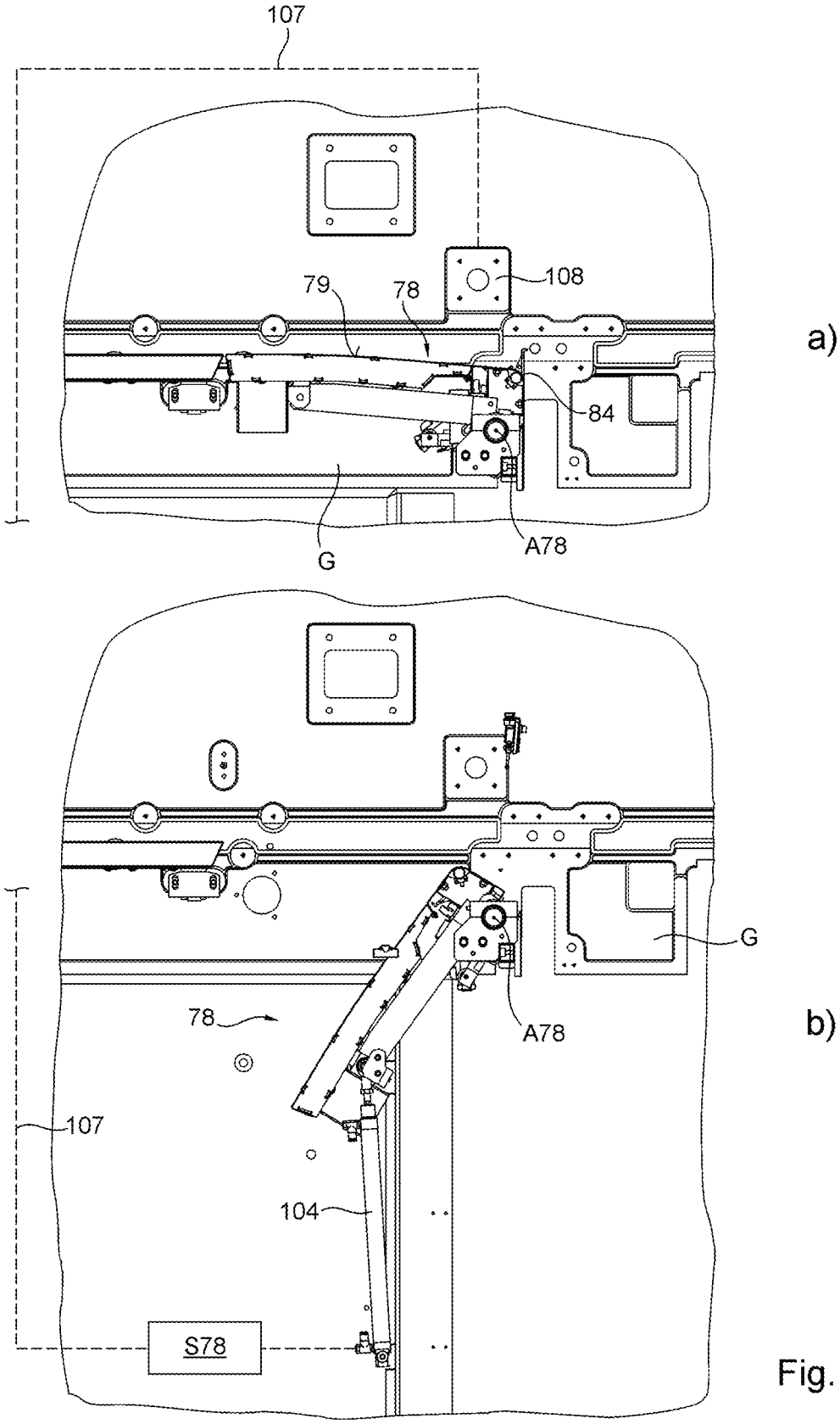
FIG. 24 a pivotable approach section in a) the operating position and b) the diverting position.
Figure 25:
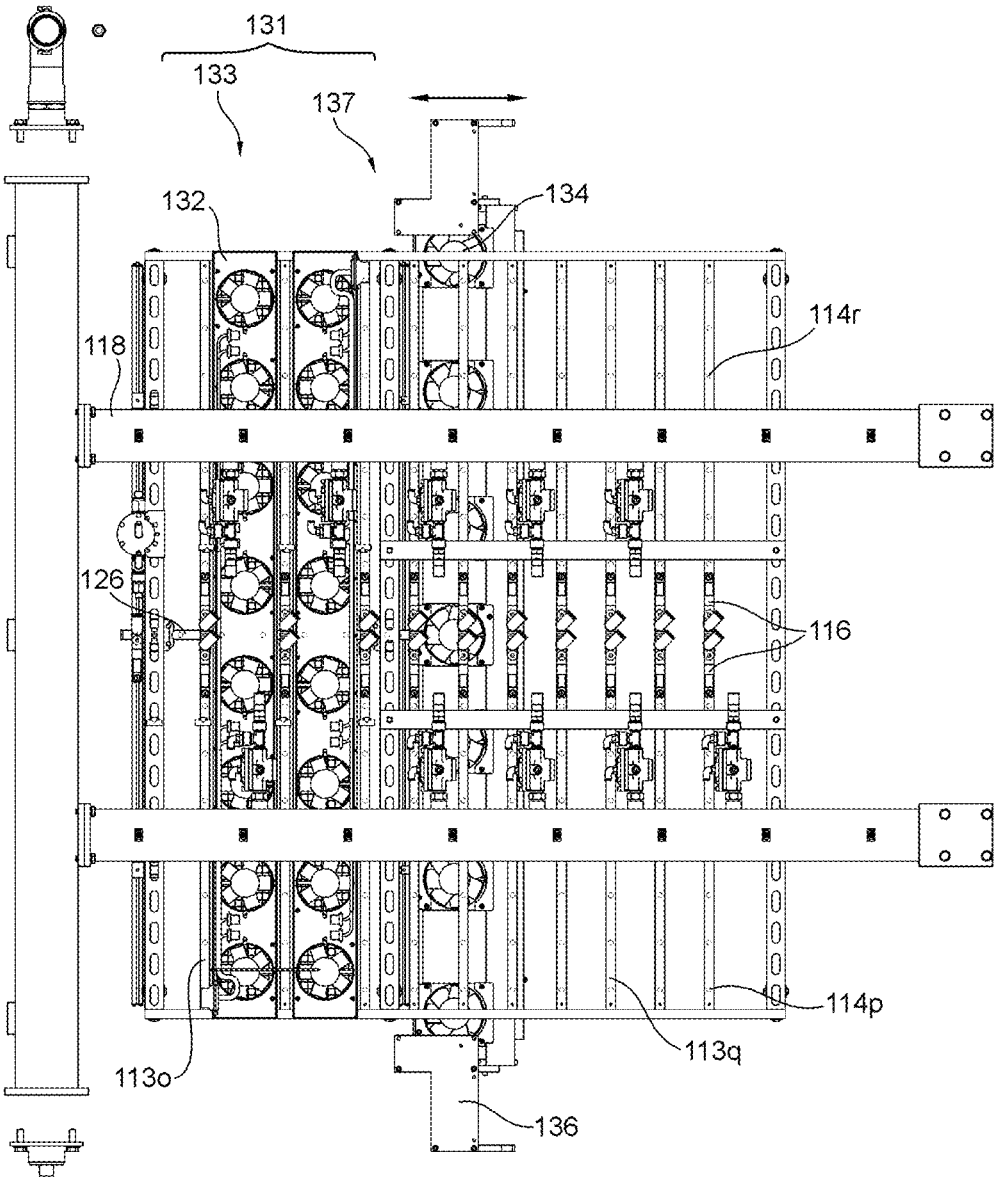
FIG. 25 a plan view of a blower system.
Figure 26:
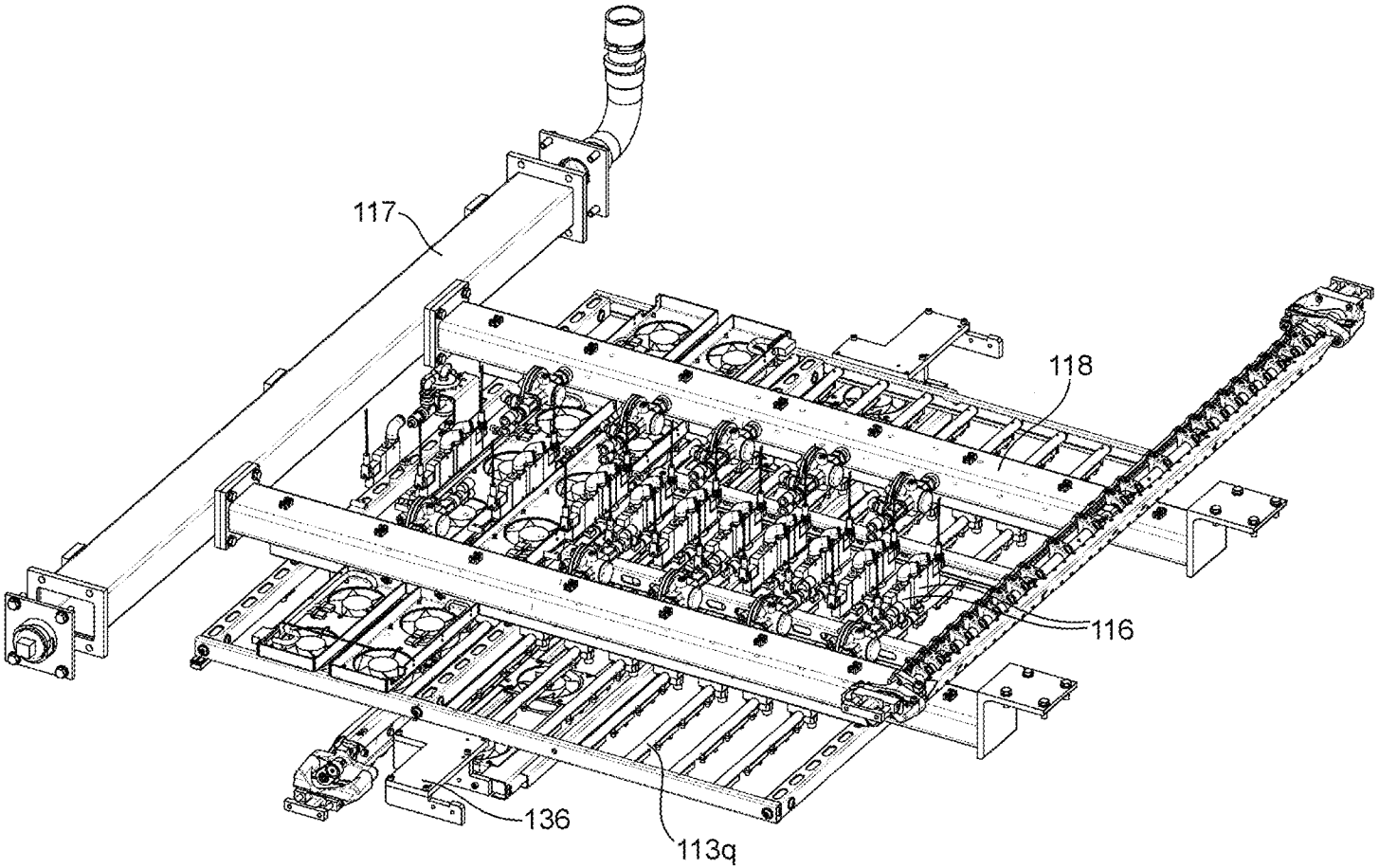
FIG. 26 a perspective view of the blower system.
Figure 27:
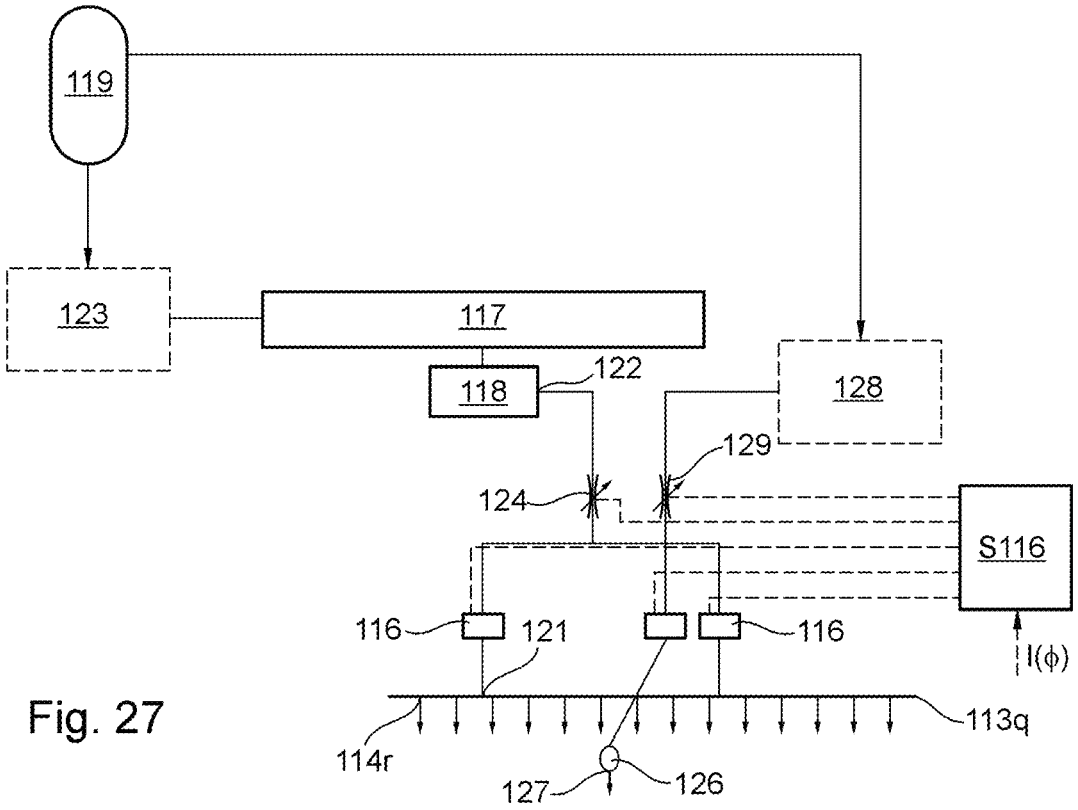
FIG. 27 a schematic diagram illustrating the supply of air to the blower system.

In an advantageous refinement, independently, in principle, of the aforementioned nature and embodiment of the movement or vertical variability of the stop at the upstream end, and/or independently of the specific drive configuration for the stop means 83, approach section 78 can be movably mounted in or on a spatially fixed frame G or frame part G of delivery system 03 such that it can be moved out of the position it occupies in the operating state, and can thus be moved, preferably downward, out of the sheet transport path in the operating state. Although it could also be mounted so as to move linearly for this purpose, it is preferably mounted so as to pivot downward out of the operational position, about a pivot axis A78 that extends transversely to the direction of transport (see, e.g. FIGS. 24*a*) and *b*)). In this case, pivoting is achieved, e.g. by means of a drive means 104, which is preferably embodied as a pressurized fluid cylinder-piston system 104. For its activation, drive means 104 for moving approach section 78 can preferably be connected via a signal connection to control means S78, by which it is or will be controlled, said control means in turn being connected, e.g. via a signal connection 107, to a sensor, in particular an optical sensor, e.g. a photosensor 109. Said sensor is able, for example via corresponding signal processing, to detect irregularities in sheet travel, especially crumpling and possibly sticking of an incoming printing material sheet B. Control means S78 can be configured and/or embodied, in response to a signal pattern from sensor system 108 that indicates a disruption in substrate travel, in particular a crumpling, to generate a signal that causes approach section 78 to move away, in particular pivot away, automatically, and to forward this signal to drive means 104.

This movement away or pivoting away preferably involves the downstream end of sheet guiding element 78, which is preferably configured as an approach section 78, being moved farther out of the transport path used during undisrupted operation, in particular further downward, than the upstream end.

The aforementioned stop means 83 are preferably structurally integrated into approach section 78 or into movably mounted sheet guiding element 78. In the latter case, said stop means are, e.g. moved along with sheet guiding element 78 when said element moves.

In the region of the first and/or second delivery station I; II, at least on one side, and preferably on each of the two sides of the movement path of sheet B, a device 103, or lateral stop system 103, for stopping the sheets B is preferably provided, which serves as a lateral path boundary for sheets B to be deposited in the delivery station I; II in question, ensuring the precise alignment of the pile edge (see, e.g. in FIG. 5). Such a lateral stop system 103 preferably comprises stop means 201 (see below) that are movable laterally, i.e. in the direction of the pile width extending transversely to transport direction T, permitting precision alignment and/or adjustment to varying format widths of sheets B.

In a preferred embodiment, as indicated above, sheet guidance and/or the controlled deposition onto pile 11; 12 is supported by a system 51; 52 that is or can be operated using blower air, disposed above the transport path. When used in an embodiment having only one delivery station I, said system can be of particular advantage for that delivery station I, and when used in an embodiment of a delivery system 03 having two or more delivery stations I; II it can be of particular advantage for one of those delivery stations I; II or for some or all of those delivery stations I; II.

Blower system 51; 52, which is disposed above the transport path over delivery station I; II, comprises a plurality of blower devices 113*q* ($q \in \{2, 3, \ldots o\}$), e.g. a number o (with $o \in \mathbb{N}$, $o>1$), extending in the transverse direction and arranged one behind the other in transport direction T; said blower devices are preferably embodied as blower bars 113*q*, in particular as cross blower bars 113*q*, and in one variant may include one or more chambers in some sections. At least five ($o \geq 5$), for example, or preferably more than 7 ($o>7$), in this case, e.g. ten ($o=10$) blower devices 113*q* are provided.

Each of the transversely extending blower devices 113*q* can be formed by a flat spray nozzle extending continuously in the transverse direction over, e.g. at least one-half the maximum substrate width.

Each of the transversely extending blower devices 113*q* is formed by a group 113*q* of blower elements 114*r* provided side by side in the transverse direction, i.e. transversely to transport direction T. Each group 113*q* comprises, e.g. a number p (with $p \in \mathbb{N}$, $p>1$) of blower air openings 114*r*, in particular blower air nozzles 114*r* ($r \in \{2, 3, \ldots p\}$), and extends, e.g. over at least the two center quarters of the maximum substrate width. For example, at least 8 ($q \geq 8$), or preferably more than 12 ($q>12$), in this case, e.g. sixteen ($q=16$) blower openings 113*q* are provided per blower device 113*q*. The group 113*q* of blower air openings 114*r* is preferably formed by a blower bar 113*q* that includes the blower air openings 114*r*.

In principle, the number o of transversely extending blower devices 113*q* may all be combined with respect to the supply of blower air and/or with respect to circuitry. In that case, all blower devices 113*q* can be activated and deactivated via one common switching means 116, for example.

Advantageously, however, blower devices 113*q* are activated and deactivated independently of one another or in main groups of multiple blower devices, via a plurality of switching means 116. In the case of multiple main groups, for example, several mutually adjacent groups 113*q* or blower devices 113*q* are combined.

Each blower device 113*q* is preferably provided with at least one switching means 116, which can be used to active the respective group 113*q* or a subgroup thereof, i.e. to supply it with blower air at a positive pressure. In a particularly fast-reacting embodiment, a plurality of blower air openings 114*r*, e.g. two subgroups thereof, are provided for each transversely extending blower device 113*q*, which can be controlled, i.e. activated and deactivated, via a number of switching means 116 that corresponds to the number of subgroups. In a particularly fast-reacting and in this respect preferred embodiment, for some or all of the blower devices 113*q*, one switching means 116 that is controllable independently of the other switching means 116 is provided for the left, and one for the right half of the blower air openings 114*r* of blower device 113*q*, in particular of the blower bar 113*q* comprising two chambers.

Switching means 116 are embodied as electronically switchable slide valves 116 or rotary disk valves 116, or preferably as electronically switchable control valves 116, or valves 116. Compressed air, for example, is supplied to said switching means on the input side and can be switched via corresponding control signals through to the output side and supplied, via a line connection, to the blower device 113*q* in question. Although in the following the switching means 116 are referred to as valves 116, the above description is also generally applicable to other embodiments.

Figure 28:
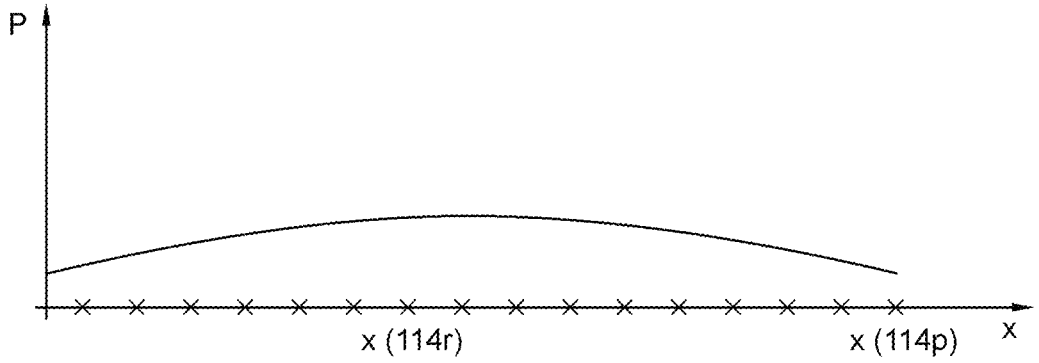
FIG. 28 a schematic diagram illustrating the axial profile of the blower air pressure acting on the sheet.

To facilitate a pressure profile that drops from the inside toward the outside, i.e. the profile of force K acting on sheet B (see, e.g. the graph of FIG. 28), a line that guides the blower air from the respective switching valve 116 to blower bar 113*q* preferably opens up within a middle longitudinal section, e.g. within the length of the two inside quarters, into the blower air-conducting interior of blower bar 113*q*. If two switching valves 116 or feeds to blower bar 113*q* are provided, this applies to both; the interior of blower bar 113*q* may also be divided by a wall in the area between the two feeds.

An adjusting means, not specified in greater detail, for adjusting and/or varying the flow of blower air and thus also the pressure profile may be assigned to some or all of blower air openings 114*r* of blower device 113*q*. Said adjusting means can, for example, be screw plugs that project into a line cross-section of a duct leading to blower air opening 114*r*; by varying the position of such plugs, the cross-section that is open for air flow can be varied. In this case, in terms of force, a pressure profile that drops outward is desirable, for example, although the specific shape may depend on the substrate and/or the conveying speed v32. A desired adjustment of the pressure profile can also be achieved without additional adjusting means, simply by adjusting the position of the blower air infeed into blower bar 113*q*, by adjusting the position and size of blower air openings 114*r*, and by the choice of the open cross-section or of a varying route.

In principle, the valves 116 that are assigned to the individual main groups, groups 113*q*, and subgroups 113*q*1; 113*q*2 of blower air openings 114 may be combined at a single centralized point, for example in the manner of a valve terminal. In a preferred embodiment, however, valves 116 are disposed in a decentralized fashion and/or at least in groups, or preferably all separated from one another spatially, in particular each being disposed close to its assigned main group, group 113*q*, or subgroups 113*q*1; 113*q*2. In that case, for example, each valve 116 is located closer to the inlet 121 into its assigned blower bar 113 than to the inlet into the other or another blower bar 113. At least, however, each valve is located closer to an inlet 121 into its assigned blower bar 113 than one-half the distance between the two blower air nozzles 114 that are spaced furthest apart on the assigned blower bar 113.

Blower bars 113*q*, i.e. the main groups, groups 113*q*, or in particular subgroups 113*q*1; 113*q*2, or the valves 116 disposed upstream of these, are supplied with air from a source 119 via a blower air path, which may be formed by serial and/or parallel line routes. For example, a line coming from a compressed air source can lead into a line 117 that extends transversely to transport direction T and is formed, for example, by a hollow, transversely extending cross member 117 or is integrated into such a cross member. An opening can lead from the cross line into at least one longitudinal line 118, e.g. longitudinal manifold 118, extending parallel to transport direction T, which may be formed by a hollow, longitudinally extending member 118 or may be integrated into such a longitudinal member. In an advantageous embodiment, two such hollow longitudinal members 118 may be provided for conducting the blower air. Extending outward from this longitudinal member 118 or these longitudinal members 118 are branch lines 122 for supplying air to the main groups, groups 113*q*, or in particular, subgroups 113*q*1; 113*q*2, or to the valves 116 disposed upstream from these. Preferably, one branch line is assigned to each of the blower devices 113*q* embodied as blower bars 113*q*. Source 119 may be a compressed air source 119 that is also intended for other uses in the press 01.

In an advantageous embodiment, an actuator 124, e.g. a pressure control valve 124, for adjusting the input pressure Pe on the input side to a desired output pressure Pa, is provided in the line route from source 119 to the valves 116 assigned to a main group, a group 113*q*, or subgroup 113*q*1; 113*q*2, in particular between the branch line 122 from the longitudinal manifold 118 and the at least one downstream valve 116. By means of this actuator 124, the pressure that is switched downstream via valve 116 can be set and/or varied, preferably automatically or via remote operation. If a plurality of valves 116 and inlets 121, e.g. two, are assigned to the same group 113*q* or to the same blower bar 113*q*, the valves 116 that are assigned to this same group 113*q* can be supplied with blower air via the same branch line and via a common actuator 124.

At least or precisely one such actuator 124 can be provided per main group, or preferably per group 113*q* or per blower bar 113*q*. In this way, a profile for the blowing effect along transport direction T can be set and/or varied.

Actuator 124 can be used, for example, to regulate the pressure to an output side pressure of between 0.6 and $1.8*10^5$ Pa, in particular between 1.0 and $1.5*10^5$ Pa. In an advantageous embodiment, a positive pressure of $1.2*10^5 \pm 0.1*10^5$ Pa is applied to the output side of pressure control valve 124 and/or to the input side of switching valve 116. In a preferred embodiment, when valve 116 is activated, i.e. open, the pressure P in the blower bar 113*q* downstream is greater than $0.6*10^5$ Pa and $1.8*10^5$ Pa, in particular between $1.0*10^5$ and $1.5*10^5$ Pa, preferably $1.2*10^5 \pm 0.1*10^5$ Pa. When switching means 116 is activated, or when valve 116 is opened, air at a pressure greater than $0.6*10^5$ Pa, in particular between $1.0*10^5$ and $1.5*10^5$ Pa, in particular at a pressure of about $1.2*10^5$, i.e., $1.2*10^5 \pm 0.1*10^5$ Pa, therefore flows, at least for a short time, out of blower air openings 114*r* as blower air. Cross blower bars 113*q* and blower air openings 114*r* are thus supplied with or pressurized with compressed air at a pressure greater than $0.6*10^5$ Pa, in particular between $1.0*10^5$ and $1.5*10^5$ Pa, preferably at $1.2*10^5 \pm 0.1*10^5$ Pa. The pressure specifications provided here refer to positive pressure relative to standard pressure, i.e. to $1.013*10^5$ Pa.

In the line that leads from source 119 to valves 116, in particular to the longitudinal manifold 118 upstream of valves 116, a control means 123 for restricting the pressure from source 119, in particular a pressure regulator 123 for restricting the pressure from source 119, may be provided. For example, a pressure regulator 123 for supplying a maximum output side pressure of $2.0*10^5$ Pa, e.g. in the range of $1.0*10^5$ to $1.5*10^5$ Pa, in particular $1.2*10^5 \pm 0.1*10^5$ Pa, is provided, or pressure regulator 123 is operated accordingly.

Regardless of whether or not pressure control valves 124 are provided, a blower system 51; 52 that has blower air openings 114*r* is thus provided, which will be or is supplied on the input side with compressed air at a pressure greater than $0.5*10^5$ Pa, e.g. a pressure between $0.6*10^5$ and $1.8*10^5$ Pa. Blower system 51; 52 is thus connected via lines on the input side to a compressed air source 119 that supplies compressed air at a pressure greater than $0.5*10^5$ Pa, e.g. a pressure between $0.6*10^5$ and $1.8*10^5$ Pa. If the line cross-sections are sufficiently large up to blower air openings 114*r*, then when the valve in question is in the activated state, blower air at approximately the same specified pressure, i.e. a pressure greater than $0.6*10^5$ Pa, e.g. a pressure between $0.6*10^5$ and $1.8*10^5$ Pa, is present in the blower bar, i.e. on the inner side of blower air opening 114*r*.

In a preferred embodiment of blower system 51; 52, in particular disposed above a first of a plurality of delivery stations I; II, the blower devices 113*q*, which, in particular, are arranged one behind the other in transport direction T and which extend transversely to the transport direction, are activated and deactivated individually or in main groups, based upon the intended transport destination of the sheets $B_i$ entering the delivery station I, in such a way that blower air is blown from above only onto those sheets B that will be deposited in the area of said delivery station I.

In principle, the transversely extending blower devices 113*q* or blower bars 113*q* can be jointly activated and deactivated in each case, depending on the transport destination. This could be implemented via a common switching means 116, which is controlled by a control unit that comprises control means S116.

In a preferred embodiment, for the sheets B to be deposited, blower devices 113*q* or blower bars 113*q* are activated and deactivated synchronously with the feed rate of sheet B to be deposited. In that case, blower devices 113*q* or blower bars 113*q* are activated and deactivated synchronously, for example, with respect to time and duration, and/or in correlation with the press phase position and/or substrate phase position Φ, i.e. clocked to the flow of substrate. For example, blower devices 113*q* or blower bars 113*q* can be switched on in succession for a sheet B to be delivered, beginning at its leading edge. If multiple overlapping sheets B will be delivered in succession, the blower devices 113*q* or blower bars 113*q* remain activated. When sheets B in the substrate flow are overlapping, blower devices 113*q* or blower bars 113*q* are deactivated again in succession, for example, beginning with the leading edge of the first sheet B that will be conveyed past.

For a stream of sheets overlapping in a shingled arrangement, the blower system will remain continuously inactive for a series of sheets B that will be conveyed past a delivery station.

For the alternative case involving sheets B that are conveyed without overlap, blower devices 113*q* or blower bars 113*q* that were activated for the sheet B to be deposited can be deactivated again in succession with the passage of the trailing edge of the sheet. For the next sheet B, depending on its transport destination, either a successive activation is carried out again, or the sheet is transferred with the blower system 51; 52 inactive.

Blower air openings 114*r* of blower bars 113*q*, in particular of cross blower bars 113*q*, are or will be operated, individually, in groups, or all together, depending upon the transport destination in each case, i.e. depending upon whether the incoming sheet B will be deposited or transported further downstream, with clocked activation and deactivation, in such a way that blower air is blown only onto those sheets B that will be deposited in the delivery station I located below said blower air openings.

The pulse generated by the blower air is optimized, and where applicable, is regulated in correlation with the transport speed, for example by means of the aforementioned pressure control valves 116.

To enable the transport destination-dependent and/or successive switching, i.e. activation and deactivation, of switching means 116, these means are in signal communication, for example, with the aforementioned control means S116, which are embodied and configured to effect the activation and deactivation of switching means 116 and/or the selection of an operating mode for operating the blower system 51; 52 on the basis of the transport destination of the sheet B that is entering the delivery station I; II. Alternatively, or in addition to the above, control means S116 are embodied and configured to effect the activation and deactivation of switching means 116, synchronized and/or in correlation with a press phase position and/or a substrate phase position Φ. A distinction can be made here between two operating modes, in which a first operating mode relates to a sheet B to be deposited and a second operating mode relates to a sheet B to be conveyed past a delivery station. In the first operating mode, blower devices 113*q* or blower bars 113*q* are activated simultaneously or successively; in the second operating mode, at least those blower devices 113*q* or blower bars 113*q* that are above a sheet B to be conveyed past a delivery station at the time of such conveyance, are deactivated during the conveyance.

Control means S116 for controlling switching means 116; 138 and/or positioning means 124; 128 may be part of a higher-level press controller or may be provided in a decentralized location and, if necessary, connected to such a press controller.

Control means S116 are preferably in signal communication with a signal generator, e.g. a sensor or a drive master, from which they receive information I(Φ) relating to and/or representing the press phase position and/or substrate phase position.

In principle, the aforementioned blower devices 113*q*, embodied in particular as blower bars 113*q*, can also extend in the transport direction, and can be arranged in groups side by side transversely to transport direction T. With an appropriate arrangement of blower bars 113*q* with the blower air openings 114 provided therein, a similar pattern of blower air outlets can then be realized. However, such an arrangement does not provide the variability, or the same variability, in terms of time and/or in terms of intensity of action in transport direction T as the transversely extending blower bars 113*q*.

Nevertheless, in addition to the plurality o of blower devices 113*q* or blower bars 113*q* extending transversely to transport direction T, at least one blower device 126 extending in transport direction T, e.g. a blower bar 126, in particular a longitudinal blower bar 126, can be provided, which includes a flat spray nozzle extending in the transport direction, or a plurality of blower air openings 127 configured, e.g. as blower air nozzles 127. The at least one blower device 27 embodied, e.g. as blower bar 127, in particular as longitudinal blower bar 127, is disposed, for example, centrally along the width of the pile 11; 12 lying and/or to be formed below it, extending transversely to transport direction T. When activated, this blower device 127 therefore assists with deposition, which is initially centered.

Activation and deactivation are also implemented in this case via a switching means 138, controlled by control means S116 and disposed upstream of blower bar 126, which is embodied as an electronically switchable slide valve 138 or rotary valve 138, or preferably as an electronically switchable control valve 138, or simply, valves 138.

Air can be supplied to the at least one longitudinal blower device 126 via a line connection from the same source 119, where appropriate via the same or an additional pressure-limiting adjusting means 123; 128, e.g. pressure regulator 123; 128. With or without the upstream adjusting means 128, an actuator 129 for controlling the output pressure, e.g. a pressure control valve 129, can likewise be provided in the line path. Longitudinal blower bar 126 preferably contains blower air at a higher pressure than the blower air of the cross-blower bars 113*q*, e.g. a pressure of at least $4*10^5$ Pa, preferably at least $5*10^5$ Pa. The central arrangement and the high pressure allow sheets B to be stiffened by a central "breach" for the purpose of pile formation.

The at least one longitudinal blower bar 126 is intended to be or is activated and deactivated in a clocked manner in a pattern comparable to that of cross blower bars 113*q*, and likewise dependent on the respective transport destination, in such a way that air is blown only onto those sheets B that will be delivered to the delivery station I located below said blower bar.

In addition to the plurality o of blower devices 113*q* or blower bars 113*q* extending transversely to the transport direction, and where applicable in place of or in addition to a longitudinal blower device 126, a fan system 131 that supports the dropping lowering of sheets B can be provided, in particular in the area of low conveyance speeds. Said fan system comprises, for example, one or more rows of fans 132, in particular axial fans 132, which are arranged side by side in the transverse direction along the transport path, and which can preferably be controlled individually or in groups with respect to their output. For example, two rows of eight fans 132 each may be combined on a common frame to form a fan module 133. In addition to this, blower system 51; 52 or fan system 131 can one or more rows of additional fans 134, in particular axial fans 134, arranged, e.g. on a common support frame 136 that can be moved along transport direction T in the delivery system. For example, a row of seven fans 134 may be combined on the common support frame 136 as a fan bar 137

Particularly in conjunction with the embodiment of delivery system 03 as a multi-pile delivery system 03, in particular as a dual-pile delivery system 03, blower system 51 is embodied and configured to blow blower air selectively onto individual sheets or onto a series of sheets B from a stream of sheets B arriving in a series, and to allow the remaining sheets B in the sheet series to pass by without blowing.

The described blower system 51; 52 enables individual sheets B, in particular sheets that will be deposited, to be selectively provided with strong momentum. This enables deposition, even at high conveyance speeds v32 and/or a high sheet frequency. For sheets B that will be conveyed past a delivery station, blower devices 113*q*; 126 are deactivated, so that air is not blown onto these sheets, and thus, they receive no momentum. As a result, the travel of sheets B that will be conveyed past a delivery station, which may be disrupted in any case, is not made unnecessarily more turbulent, and contact with the pile disposed therebelow can be avoided.

Activating the blower air in a clocked manner only for individual sheets B to be deposited decreases energy costs considerably as compared with continuous blowing.

In an embodiment which is advantageous with respect to the pile quality of the first pile 11, in an operating phase of the aforementioned second operating mode in which, e.g. one or more sheets B entering the first delivery station I are or will be transferred past said delivery station according to the first operating mode, the or some of the blower air openings 114*r* provided one behind the other in transport direction T, which are to be activated independently of one another, in particular transversely extending blower devices 113*q* or blower bars 113*q*, each comprising a plurality of blower air openings 114*r*, will be or are supplied with blower air or activated and deactivated in such a way that they blow only—at least for an interval of time or temporarily—into the gap between successive sheets B, in particular into the gap between the trailing end 11 of one sheet B and the holding device 32 of the subsequent sheet $B_n$; $B_{n+1}$, in particular the gripper carriage 32 transporting the subsequent sheet B.

In this operating situation, those blower devices 113*q* or blower bars 113*q* that, at a given time, are located above the sheets B being moved in transport direction T and to be conveyed beyond a delivery station are or will be deactivated, however, the blower devices 113*q* or blower bars 113*q* that, for a window of time as the sheets B advance, each lie above a gap between successive sheets B, in particular within a gap between the trailing end 11 of one sheet B and the holding device 32 of the subsequent sheet B, are or will be activated in succession for at least an interval of time that is within this time window.

The valve 116 assigned to the blower air openings 114*r* or blower devices 113*q* that can be activated independently of one another in succession are in signal communication with a control means S116, which is in turn in signal communication with a signal generator that supplies information I(Φ) relating to and/or representing the press phase position and/or substrate phase position and is embodied and configured to activate the blower air via valves 116, based upon the information I(Φ) relating to and/or representing the press phase position and/or substrate phase position, in such a way that air is blown only within a gap between two successive sheets B that will not be deposited.

For example, a sheet $B_n$ to be conveyed past a delivery station, which in this example may be a first sheet or any in a series of sheets B to be conveyed past, is transported above and beyond the pile 11, while the respective blower devices 113*q* or blower bars 113*q* above the pile in the aforementioned are inactive. One or more holding devices 32 that pick up said sheet above the gap between the trailing end of this sheet $B_n$ and the leading end 109 of the subsequent sheet $B_{n+1}$ which gap moves along with the advance of sheets B in transport direction T, or more particularly a holding device that picks said sheet up at the leading end 109, are activated in succession, and are deactivated again at the latest upon entry of the leading end 109 of the subsequent sheet $B_{n+2}$, or more particularly of a holding device 32 that picks said sheet up at the leading end 109.

For this purpose, control means S116 are provided and are configured to activate and deactivate the switching means 116 that are assigned to blower devices 113*q* or blower bars 113*q*, synchronized or clocked and/or in correlation with a press phase position and/or substrate phase position Φ. These control means S116 may be embodied as mechanically actuated rotary valves, or as a mechanically actuated cam control mechanism for switching individual valves 116, or as control means S116 for electronically actuating the individual switching valves 116.

Figure 29:
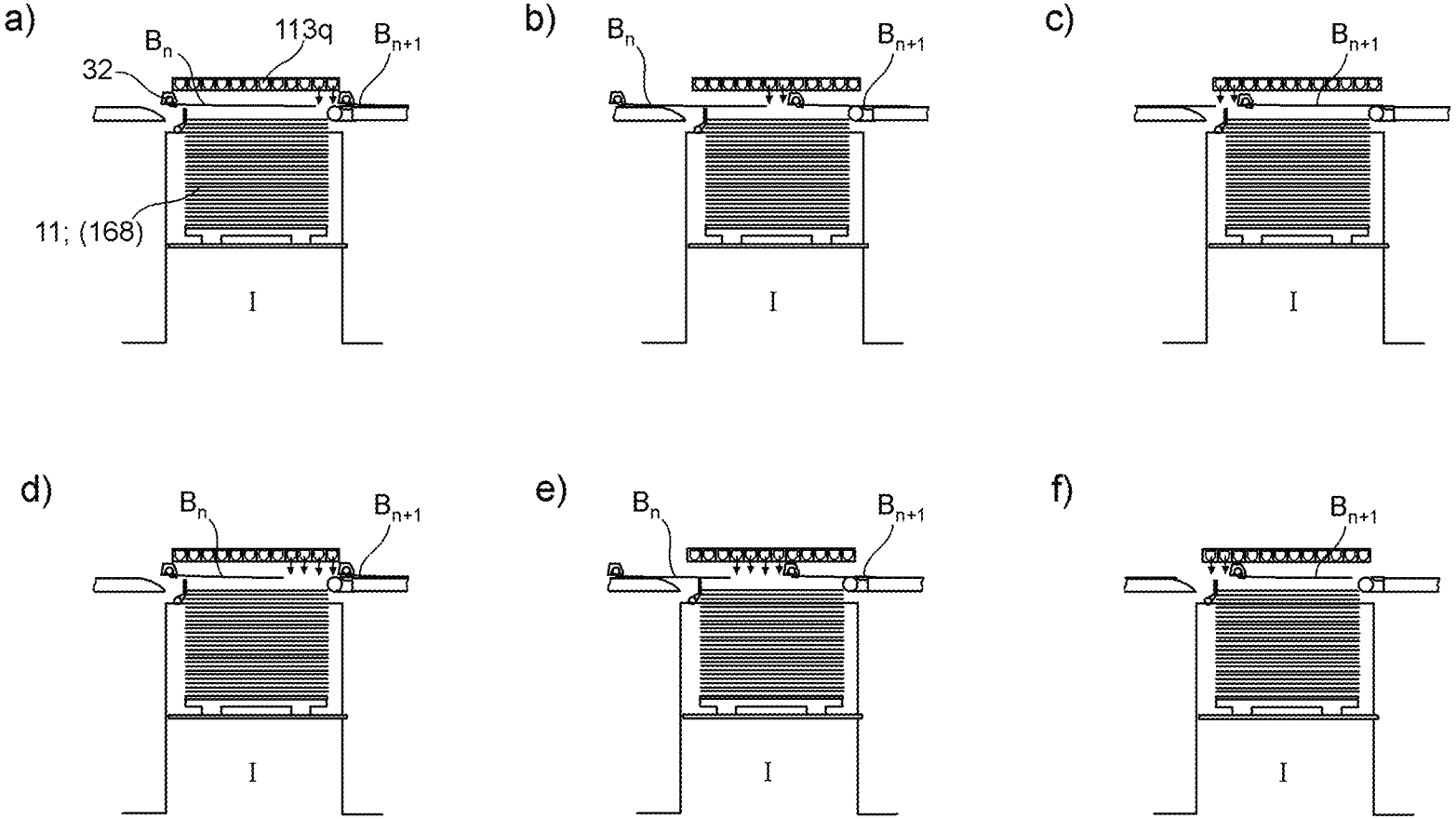
FIG. 29 a schematic diagram illustrating the blowing of air onto a pile to be bypassed, during the transfer of sheets of a first format a) to c), and of a smaller, second format d) to f)

In an advantageous refinement, the number of blower devices 113*q* that blow simultaneously into the same gap varies or can vary with the format length of substrate sheets B. For example, for a longer format, a first number of successive blower air openings 114*r* or blower devices 113*q* simultaneously blow air into the gap (see, e.g. FIGS. 29*a*) to *c*)), whereas for a shorter format, a greater number of successive blower air openings 114*r* or blower devices 113*q* blow air into the gap, which in this case is larger (see, e.g. FIGS. 29*a*) to *c*)).

In a further refinement, the action of blower devices 113*q* or blower bars 113*q* can be adjusted along their width and/or position as viewed transversely to transport direction T. For this purpose, e.g. outer sections can be continuously deactivated or deactivatable, in particular they are or can be continuously shut off. For example, individual blower air openings 114*r* may be closed by an adjusting means not further detailed here.

Together with one or more features of the above-described embodiments of sheet guiding device 47 and/or brake system 48; 49 and/or blower system 51; 52 and/or approach section 78, or also on its own, a particularly preferred system 139 for releasing the conveyed sheets B, or simply release system 139, comprises a switching device for releasing conveyed substrate sheets B, having a control device 143, by means of which the release in the region of the assigned delivery station I; II can be activated and deactivated, and having a control device 144, by means of which the point $X_{139}$ of sheet release as viewed in transport direction T, called the gripper opening point $X_{139}$ if the holding elements are configured as grippers 56, can be adjusted or varied in the region of the assigned delivery station I; II. The two control devices 143; 144 in this case can be controlled by independently actuatable drive means 146; 147. Release system 139 is thus embodied to effect, at a specified time, for example between two successive holding means 32, in particular gripper carriages 32, in transport direction T, the activation or deactivation of switching device 141, 142, in particular the engagement or disengagement of switching means 141; 142 of switching device 141, 142, which is embodied, e.g. as a mechanical device.

A particularly advantageous embodiment of delivery device 03 in this context includes a conveyor system 21 comprising at least one holding device 32, by means of which a substrate sheet B can be picked up and conveyed downstream to a delivery station I; II, where it can either be released by holding means 32 and deposited onto a pile 11, 12 being formed, or conveyed further downstream. It further comprises a switching mechanism 141, 142 for effecting deposition, which comprises a switching cam 141 that is functionally and/or spatially assigned to the delivery station I; II, and a cam follower 142 that is functionally and/or spatially assigned to holding means 32, wherein cam follower 142 acts directly or indirectly on at least one holding element 56 of holding device 32 for the actuation thereof.

Although cam follower 142 could, in principle, cooperate in a sliding manner with switching cam 141, it is preferably embodied as a roller lever 142 and cooperates with switching cam 141 via a roller which is part of cam follower 142.

Switching cam 141 can be moved, in particular pivoted, into and out of the uninterrupted movement path 152 of cam follower 142, i.e. the movement path that exists without switching cam 141, by means of a control device 143 engaging on switching cam 141, for the purpose of activating and deactivating the release. Said pivoting preferably takes place about a pivot axis A141, which runs perpendicular to transport direction T and is fixed in relation to a spatially fixed frame G of delivery device 03.

To vary the location along the transport path where the release will be effected by switching cam 141, a contact point 151 where contact first occurs between switching cam 141 and the cam follower 142, which approaches switching cam 141 in transport direction T, e.g. within at least a longitudinal section as viewed in the transport direction that acts, in particular, as a control section, can be varied by means of a second control device 144, which is different from the first control device 143 and engages on switching cam 141.

The term "cam follower" 142 is understood as any type of stop element 142 which, upon contact with an operative surface 149 of a cam 141, in particular switching cam 141, executes a movement that follows the shape of the operative surface 149 it is interacting with, and acts, if appropriate via a motion transmitting member 59, e.g. gripper shaft 59, on the element to be actuated, in this case, e.g. at least one holding element 56. On the other hand, a "switching cam" 141 is understood more generally as any type of structural unit that provides operative surface 149 as a stop surface. If cam 141 is mounted so as to be movable during operation, it is also understood, for example, as a multi-part and jointly movable structural unit having a component that comprises operative surface 149 and a holder that supports said component, optionally releasably.

The switching cam that acts as a release cam, in at least a longitudinal section thereof as viewed in transport direction T that acts as a control section, on a side that faces movement path 152 of cam follower 142, is embodied as having an operative surface 149, e.g. contact surface 149, that constantly approaches movement path 152 of cam follower 142 in transport direction T in this section.

The two separate control devices 143; 144 meet the need for precise adjustability, while at the same time providing the fastest possible inward and outward movement. Highly precise operation at high conveyance speeds and/or production rates, for example, with sheet streams of more than 12,000 sheets B per hour (S/h), in particular more than 15,000 s/h, is thereby made possible.

To vary the contact point 151 of first contact, in an embodiment that is preferred in this context, at least one of the ends of switching cam 141 with respect to transport direction T, in this case advantageously the upstream end, can be varied in terms of its distance from movement path 152 of cam follower 142, i.e. it can be moved, for example in the region of this end, either closer to or further away from movement path 152 by a movement that has at least one component extending perpendicular to transport direction T. For activation and/or deactivation, the distance of at least the other end of switching cam 141 with respect to transport direction T from the movement path of cam follower 142 can be varied in such a way that, in a first operating position, it extends into the uninterrupted movement path 152 of cam follower 142, and in a second operating position, it is completely removed from the movement path 152 of cam follower 141.

For this purpose, the first control device 143 engages at a first engagement point P143 on release cam 141, and the second control device 144 engages at a second engagement point P144 that is spaced from the first in transport direction T.

Switching cam 141 can then be pivoted by means of second control device 144 144 e.g. about a second pivot axis A144 lying at the engagement point P143 of the first control device 143. The second pivot axis A144 or the first engagement point P143 is displaceable radially by means of the first control device 143 and/or the first drive means 146, in particular pivotable about a pivot axis A141 that is fixed relative to a spatially fixed frame G of delivery device 03.

For driving the first control device 143, said device comprises a first drive means 146 that is or can be operated using a liquid or gaseous pressure medium F, e.g. pressurized fluid F, e.g. a hydraulic or preferably pneumatic cylinder 146. For supplying drive means 146 with pressure medium F, a switchable valve 153 is provided as switching means 153, along with at least one fluid line 154; 156 connecting valve 153 to drive means 143, wherein the line route of the, or of at least one fluid line 154; 156 between an outlet of valve 153 and an inlet into drive means 146 preferably corresponds at most to the maximum width, in particular at most to one-half the maximum width, of the substrate sheets B to be stacked in the delivery station I; II. Dead times and variances can thereby be minimized by compressibility.

Valve 153 is actuated, for example, via control means S146, which can be implemented, e.g. as part of a press controller, or provided in a different control device S141.

In an advantageous embodiment, the hydraulic or preferably pneumatic cylinder 146 is double-acting, i.e. can be pressurized with pressure medium in both actuating directions.

The double-acting configuration and/or the disposition of the valve in close proximity to the drive means result in a particularly fast and precise switching drive.

Since two fixed end positions are and/or can be defined, for example, in the drive train of the first control device, switching cam 141 can be engaged and disengaged very rapidly but nevertheless precisely, i.e. release device 139 can be activated and deactivated rapidly and precisely.

For driving the second control device 144, said device preferably comprises an electric motor 147. Electric motor 147 is controlled, for example, via control means S147. Electric power can be supplied to drive means 147 via a n line connection, not described in further detail, to a power unit.

In an advantageous embodiment, electric motor 146 acts on its output side on a threaded drive, and together with the latter forms an electromotive linear drive.

In one advantageous embodiment, in particular for delivery devices 03 for substrate sheets B having a large maximum width, the delivery station I; II is provided with one switching device 41, 42 as described above on each side of the sheet path, i.e. in the region of each of the two side frames of frame G. Each of the two switching devices 41, 42 is preferably assigned its own first control device 143, which has a first drive means 146 and a switching means 153, in particular valve 153. Control movements are synchronized electronically, for example.

In principle, each of the two switching devices 141, 142 can also be assigned its own second control device 144, each with a drive means 147. In a robust and low-cost solution, however, the second control devices 144 are synchronized mechanically with one another, e.g. via a shaft 157 extending transversely to the transport direction, in particular synchronizing shaft 157, and are preferably driven by a common drive means 147, in particular a common electric motor 147.

In principle, the first engagement point P143 or the second pivot axis A144 can be pivoted about the frame-fixed pivot axis A141 via any type of lever that can be pivoted about the frame-fixed pivot axis A141 and that displaces the pivot axis A143 to be pivoted or the engagement point P144 to be pivoted eccentrically by a lever length toward the frame-fixed pivot axis A141. Said lever can be non-rotatably connected to a shaft, which is mounted rotatably in frame G and can be pivoted about the frame-fixed pivot axis A143 by means of drive 146.

In a preferred embodiment, a one- or two-armed lever 158 is mounted pivotably on a frame-fixed axis 159, with the drive means 146 or an output-side motion transmitting member 161, e.g. the piston rod or a rod connected thereto, engaging on one side of said lever. On the other side of said lever 158, offset from the frame-fixed pivot axis A141 by eccentricity e, the first engagement point P143 or the second pivot axis A144 is articulated. This can be accomplished via an axle stub or shaft stub 162 mounted on lever 158. In that case, pivoting is carried out via a lever 158 embodied as an eccentric lever 158, over a lever length e determined by the eccentricity e. In an advantageous embodiment, in which the second pivot axis A144 to be pivoted extends within the axial cross-section of the axis 159 that defines the frame-fixed pivot axis A141, a particularly robust arrangement for supporting the first engagement point P143 or the second pivot axis A144 is created.

In a particularly advantageous embodiment, activation/deactivation is thus carried out by the forward and backward movement of switching cam 141 with the help of an eccentric lever 158, which will be or is actuated by means of a double-acting pneumatic cylinder 146, which is supplied in particular via a switching valve 153 in close proximity to the drive means.

In principle, the second engagement point P144 or the first pivot axis A143 can be pivoted about the second pivot axis A144 by any type of transmission, on the drive side of which the second drive means 147 engages.

However, a particularly advantageous embodiment in this context, in addition to comprising at least one one-arm or multi-arm lever 163; 164 that is pivotable about a frame-fixed pivot axis A149, also comprises a coupler 162 that is articulated at both ends in the drive train of control device 144. In an advantageous and illustrated embodiment, drive means 147 engages a lever 162, which is arranged in a torsion-free manner on a shaft 147, e.g. the aforementioned synchronizing shaft 147, which is pivotable about the frame-fixed pivot axis A149. Via an additional lever 164, which is disposed torsion-free on shaft 157, driving is implemented directly or indirectly via a joint onto coupler 162, and via an additional joint, directly or indirectly onto the second engagement point P144.

In an advantageous refinement, first control device 143 is embodied such that, in the operational end position of switching cam 141, which has been moved into the movement path 152 for the purpose of activation, in the region of a dead center point in close proximity to the movement path, i.e. in a projection plane that is perpendicular to pivot axis A141 as viewed about pivot axis A141, lever 158 engages on a line that lies at most 30°, in particular at most 20°, from the line of the shortest connection between pivot axis A141 and movement path 52. As a result, forces that are introduced into the structure by the impinging cam follower 142 are conducted at least predominantly into the bearing arrangement, and at most have only a slight impact on the drive.

For controlling the drive means 146 that moves switching cam 141 either into or completely out of the movement path 152 of cam follower 142 and/or a switching means 153 for switching the drive means 146, said means is in signal communication with a control means S146, which is in turn in signal communication with a signal generator that supplies information I(Φ) relating to and/or representing the press phase position and/or substrate phase position, and is embodied and configured to activate and deactivate the drive means 146 and/or a switching means 153 for switching the drive means 146 in correlation with a press phase position and/or substrate phase position Φ transmitted by a signal generator.

For controlling the drive means 147 that is used for varying switching cam 141 with respect to the delivery location and/or a switching means for switching the drive means 147, said means is in signal communication with a control means S147, which is in turn in signal communication with a signal generator that supplies information I(Φ) relating to and/or representing the press speed or transport speed, and is embodied and configured to adjust the drive means 147 and thus the gripper opening point in correlation with a press phase position and/or substrate phase position Φ transmitted by a signal generator.

In the forward and backward movement, for high production or conveyance speeds, it should be possible to move from one switching state to the other as rapidly as possible, e.g. within a maximum of 150 ms, preferably within 130 ms.

For this purpose, the optionally bilateral positioning movement is preferably carried out via respective drive means 146, rather than by mechanical synchronization. In place of or in addition to this, time lags at the operative end effected by the shortest possible line routes are advantageous, e.g. as with the short fluid lines 154; 156 set forth above. Alternatively or in addition to the aforementioned advantageous limitation of the length of the line path, the length of the respective line is selected such that the dead volume enclosed in the respective pressurized supply line is no more than 25% of the volume stored in the extended cylinder, which is determined, for example, by the piston cross-section multiplied by the piston stroke of the extended cylinder. In a particularly advantageous embodiment, this dead volume is less than 10%. In a further refinement in which valve 153 is mounted directly on cylinder 146 or is even integrated into cylinder 146, this value can be reduced to less than 5%, in particular to less than 2%.

To minimize control-based dead times, control means S146 for controlling deactivation/activation with fast switching logic, i.e. switching logic in which a signal from an aforementioned signal generator and relating to the press phase position and/or substrate phase position is processed without delay, directly, i.e. in particular without clocked processing, such as is carried out, for example, in PLCs and in bus systems that may be clocked, to a signal σ147 that actuates drive means 147 or triggers the activation or deactivation and is transmitted. The fast switching logic thus switches the control device 143 for activating and deactivating switching device 141, 142 at the precise press angle.

In place of or in addition to one or more measures for minimizing dead time, a dead time compensation—preferably dependent on press speed—that compensates for any dead time still existing, e.g. as a result of inertia, through a corresponding pilot control can be provided. In that case, for example, the press phase position and/or substrate phase position that is correlated with the possible switching time can be moved forward according to the dead time to be factored in. In a preferred refinement, the extent of forward movement can be varied based upon the transport speed, in such a way that, for example, the triggering press phase position and/or substrate phase position is moved further forward at a higher speed than at a lower transport speed. Thus, it is possible to have the actual movement of switching cam 141 always begin at the same or at least substantially the same press phase position and/or substrate phase position, even for different press speeds or rotational speeds.

Although the described switching device 141, 142 may be provided in a delivery device 03 that comprises only one delivery station I; II, configured for forming piles 11; 12 in which sheets B that will not be deposited in the area of the delivery station I; II can be routed, for example, to a test sheet removal point or to a receptacle for collecting waste sheets, it is preferably provided in a delivery system 03 that comprises a plurality of delivery stations I; II configured for forming piles 11; 12. In that case, a delivery station I; II comprising the aforementioned switching device 141, 142 is provided with an adjoining conveyor section 42, on which substrate sheets B that will not be deposited in the region of the first delivery station I; II can be conveyed by conveyor system 21 to the region of a subsequent delivery station I; II.

Thus, for controlling the delivery of substrate sheets B that are or can be conveyed downstream by a conveyor system 21 to a delivery station I; II, where they are or can be either deposited by a holding device 32 of conveyor system 21 onto a pile 11, 12 being formed, or conveyed further downstream, sheets are deposited by a switching cam 141, which is functionally and/or spatially assigned to the delivery station I; II, acting on a cam follower 142, which is functionally and/or spatially assigned to the holding device 32. Switching cam 141 is moved into and out of the uninterrupted movement path 152 of cam follower 142 to activate and to deactivate the release. To vary the delivery point, a contact point 151, described above, on switching cam 141 where first contact is made between switching cam 141 and cam follower 142, which moves toward said cam in transport direction T, is varied along transport direction T.

Activation and deactivation are preferably implemented by pivoting switching cam 141 about a frame-fixed first pivot axis A144. Switching cam 141 is preferably varied by varying the distance between at least one of its ends with respect to transport direction T and the movement path 152 of cam follower 142.

In a particularly advantageous refinement, switching device 141, 142 is controlled in such a way that switching cam 141 is in its first operating position, i.e. the active position, at least at one point when the aforementioned blower system is operated in the first operating mode and/or the aforementioned brake system 48; 49 is operated in the first operating mode m1.

The delivery system that includes a plurality of delivery stations I; II, e.g. two, preferably also comprises a release system in the region of the second delivery station II, which is configured in the manner of the first release system 139 and has at least a second control device 144 for varying the release point. First control device 144 may be omitted. In that case, pivot axis A44 or engagement point P143 is disposed fixed in relation to the spatially fixed frame G.

Together with one or more features of the above-described embodiments of sheet guiding device 47 and/or brake system 48; 49 and/or blower system 51; 52 and/or approach section 78 and/or release system 139, or also on its own, delivery system 03 comprises a non-stop pile changing system 53; 54, at least for one of a plurality of delivery stations I; II, in particular for at least one delivery station I; II for stacking good sheets. Preferably, delivery system 03 comprises one non-stop pile changing system 53; 54 for a plurality of delivery stations I; II, in particular for two or for all such delivery stations.

The sole, or each non-stop pile changing system 53; 54 comprises an auxiliary support means 166; 167, e.g. an auxiliary pile board 166; 167, which can preferably be lowered by a motorized mechanism, and which can be introduced between the top edge of an already formed pile 11; 12, e.g. the main pile 11; 12 that is ready for removal, and the sheet transport path extending above said pile. Auxiliary pile board 166; 167, in particular at least the support surface thereof that faces the sheet transport path, is preferably mounted vertically movably on frame G or on a frame part G of delivery system 03. In the active operating mode, i.e. the mode in which it is introduced into the drop path, an auxiliary pile 168; 169 can be formed on auxiliary pile board 166; 167 by additional approaching sheets B.

Vertical downward movement is preferably correlated to the growth of auxiliary pile 168; 169 and/or is carried out by means of a drive system, which preferably comprises a drive means 171 that is mechanically independent of the drive of conveyor system 21, preferably in the form of a motor 171, in particular an electric motor 171. For this purpose, the drive means is in signal communication with a control means S171, for example, which is configured and/or programmed to actuate drive means 171 in an operating situation in such a way that the upper pile edge is or will be held to a predefinable height. To accomplish this, control means S171 is connected to a sensor system that detects the upper pile edge and/or to a control system that supplies information about the sheet stream.

Auxiliary pile board 166; 167 is moved, for example horizontally, into and out of the drop path, i.e. is moved into a working position and back to an idle position, synchronized with respect to time and/or in correlation with a press phase position and/or substrate phase position Φ, i.e. clocked to the substrate stream. Thus, the pile board is preferably inserted when the press or the next approaching sheet B is in a defined phase position. Preferably, the pile board is moved into the drop path no later than the time at which the leading edge 109 of the first sheet B that will no longer be delivered to the pile 11; 12 in question reaches the downstream end of auxiliary pile board 166; 167 in transport direction T, and no earlier than the time at which the trailing edge 111 of the preceding sheet B in transport direction T passes the downstream end of auxiliary pile board 166; 167.

Auxiliary pile board 166; 167 is inserted and removed by means of a drive system, which preferably comprises a drive means 172 that is mechanically separate from the drive of conveyor system 21, preferably in the form of a motor 172, in particular an electric motor 172. For this purpose, drive means 172 is in signal communication with a control means S172, for example, which is configured and/or programmed to control drive means 172 so as to effect an insertion or removal in correlation with the aforementioned press phase position and/or substrate phase position $\Phi_m$, in response to a corresponding command input by the press operator, or from a program routine that is implementing the pile change.

The command in question may be input by the press operator, for example, or may come from a higher-level control routine or program routine for controlling the pile change, which is initiated by a triggering moment. The triggering moment may be provided, for example, by a signal $\Sigma_{AW}$ that initiates an automatic pile change, which is or can be triggered by the press operator via a user interface, for example, and/or automatically when the pile reaches a predefined or maximum pile height. For correlation of the movement for insertion and removal, the control routine or program routine and/or control means S172 can be in signal communication with a signal generator that supplies information I(Φ) relating to and/or representing the press phase position and/or substrate phase position.

Control means S171; S172 may be implemented as part of a press controller, or may be implemented in another central control unit, together with additional control means, or may be provided in a control unit S53 (S54) that is separate from these.

In a preferred embodiment of non-stop pile changing system 53; 54, auxiliary pile board 166; 167 is inserted into the drop path in transport direction T. This offers the advantage, e.g. that, even at high sheet transport rates and with potentially small distances between successive sheets B, the smallest possible number of copies, ideally not a single copy, is damaged or must be removed during insertion of the auxiliary pile board 166; 167. For this purpose, in its idle position auxiliary pile board 166; 167 is disposed or held ready upstream of its assigned delivery station I; II. This is also advantageous, e.g. for the embodiment in which the first delivery station I is used, for example, for the deposition of waste sheets B.

In principle, auxiliary pile board 166; 167 can be of any configuration, e.g. in the form of an insertable rigid plate, in the form of an insertable rake, in the form of an articulated and/or flexible roller rack, or as a longitudinally extendable mechanism. In the embodiment as a rake, it can cooperate advantageously with loading means 61; 62, the structure of which involves depressions in the support surface that complement the structure of the rake.

In the embodiment shown here, auxiliary pile board 166; 167 is embodied as flexible and/or articulated as viewed in the longitudinal direction, in particular as or in the manner of a roller rack 166; 167. Auxiliary pile board 166; 167, which is preferably embodied as flexible and/or articulated, is or is meant to be guided on or in an integral or multi-part guide structure 173, 174, which extends on both sides of the drop path over the entire length thereof in transport direction T, and which extends beyond the drop path sufficiently to receive the auxiliary pile board 166; 167 in its idle position, which in the aforementioned embodiment is provided, e.g. upstream. In an embodiment that is particularly advantageous in terms of a reduced space requirement, the guide section 174 of guide structure 173, 174 that is provided for receiving auxiliary pile board 166; 167 outside of the drop path bends or folds downward from guide section 173, which extends horizontally at the level of the drop path. In this case, auxiliary pile board 166; 167 is embodied as flexible and/or articulated, e.g. as described above. Preferably, one integral or multi-part guide structure 173, 174 of this type is provided on each side of auxiliary pile board 166; 167, i.e. to the left and the right of the movement path of sheets B as viewed in the horizontal projection.

In principle, the drive system for inserting and removing auxiliary pile board 166; 167 can be a drive system of any embodiment; preferably, however, it comprises a drive wheel 176, in particular a sprocket 176, which is mounted fixed in relation to the frame of guide structure 173, 174 and which is driven directly or indirectly by means of motor 172, which is likewise mounted fixed in relation to the frame of guide structure 173, 174, said sprocket being driven by cooperating with a drive track 177 on the auxiliary pile board 166; 167 to be moved. Drive track 177 may be formed, e.g. by a friction surface of auxiliary pile board 166; 167 itself, or preferably by a drive chain 177 which is included as part of auxiliary pile board 166; 167 and extends in the direction of movement thereof. Preferably, one drive wheel 176 of this type with drive tracks 177 is assigned to each lateral side of the two lateral guide structures 173, 174, wherein each of drive wheels 176 can be or is driven, mechanically synchronized, by a common drive means 172, or preferably by its own drive means 172, synchronized by control technology. Roller rack 166; 167 is preferably formed by a plurality of links 178, e.g. rollers, tubes, or rods, arranged one behind the other in the direction of movement, and connected to one another in pairs so as to pivot. Links 178 are preferably mounted at their end faces on the two chains 177, by which they are also connected to one another. Particularly if said links are embodied as rollers or tubes, they can be mounted rotatably on the chains 177.

Auxiliary pile board 166; 167, together with guide structure 173, 174 and the drive system for inserting and removing auxiliary pile board 166; 167, is mounted so as to be vertically movable in frame G or in a spatially fixed subframe or frame part G of delivery system 03 and can be moved vertically by means of the aforementioned drive system.

In principle, the drive system for moving auxiliary pile board 166; 167 up and down, or for moving a lowerable board assembly 179 that comprises auxiliary pile board 166; 167, guide structure 173, 174, and the drive system up and down, can be a drive system of any embodiment; preferably, however, it is embodied as a lifting mechanism and comprises, e.g. one or more drawing means 181; 182 that act on auxiliary pile board 166; 167 and/or on the lowerable board assembly 179, and the at least one drive means 171 that acts directly or indirectly on at least one drawing means 181; 182. The drawing means 181; 182 is or are preferably embodied as chains 181; 182, which are preferably guided over one or more deflector elements 183; 184 embodied as deflector wheels or rollers 183; 184 and which engage on auxiliary pile board 166; 167 and/or on lowerable board assembly 179. A drive wheel 186; 187 embodied, e.g. as a sprocket 186; 187, engages in each of chains 181; 182 for driving the same, and is and/or can itself be driven directly or indirectly by the at least one drive means 171.

Although it is possible, e.g., for four drawing means 181; 182, each acting on one corner region of auxiliary pile board 166; 167 and/or of lowerable board assembly 179, to be driven by two or even four such drive means 171, in this case the four drawing means 181; 182 are driven by one common drive means 171. Said drive means drives, for example, via a transmission 188, a shaft 189 extending transversely to transport direction T, on which two drive wheels 186; 187, e.g. sprockets 186; 187, that cooperate with two drawing means 181; 182 are disposed for conjoint rotation on each side of the lowerable board assembly 179.

One of two drawing means 181; 182 on the same side can be guided over a deflector element 193, embodied as a deflector wheel 193 or deflector roller 193, which for adjustment purposes is movable within an adjustment range in a direction perpendicular to the axis of deflector element 193 on frame G.

Figure 36:
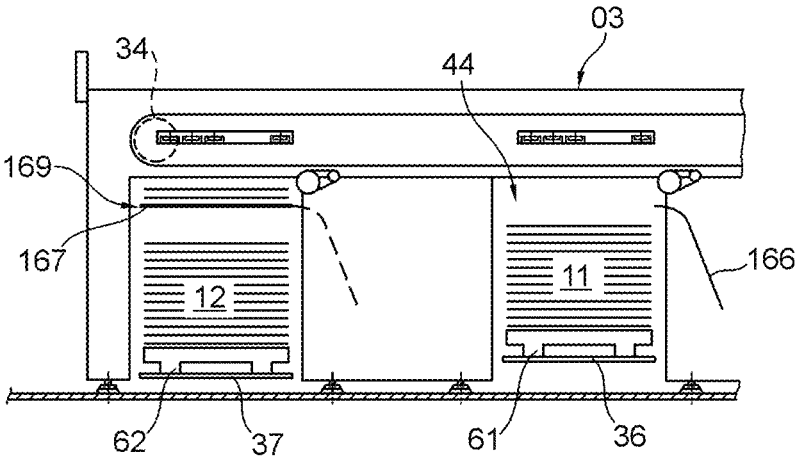
FIG. 36 a schematic diagram illustrating the operation during a pile changing process a) in the region of the last delivery station downstream, and b) in the region of a delivery station disposed upstream of the last delivery station.
Figure 36:
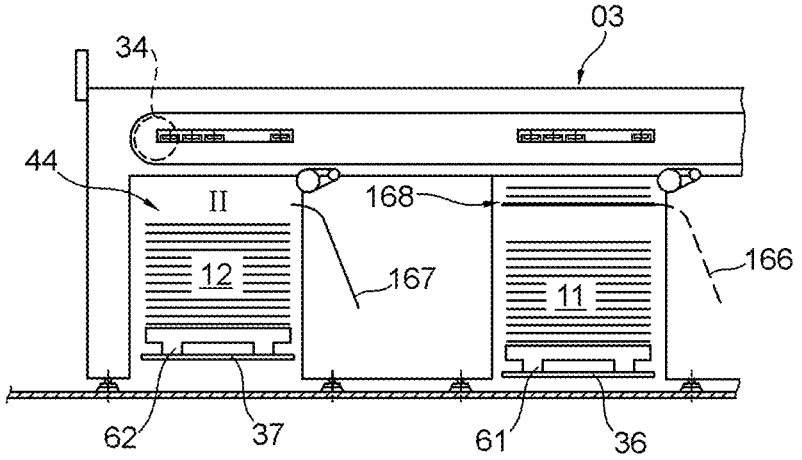
Figure 37:
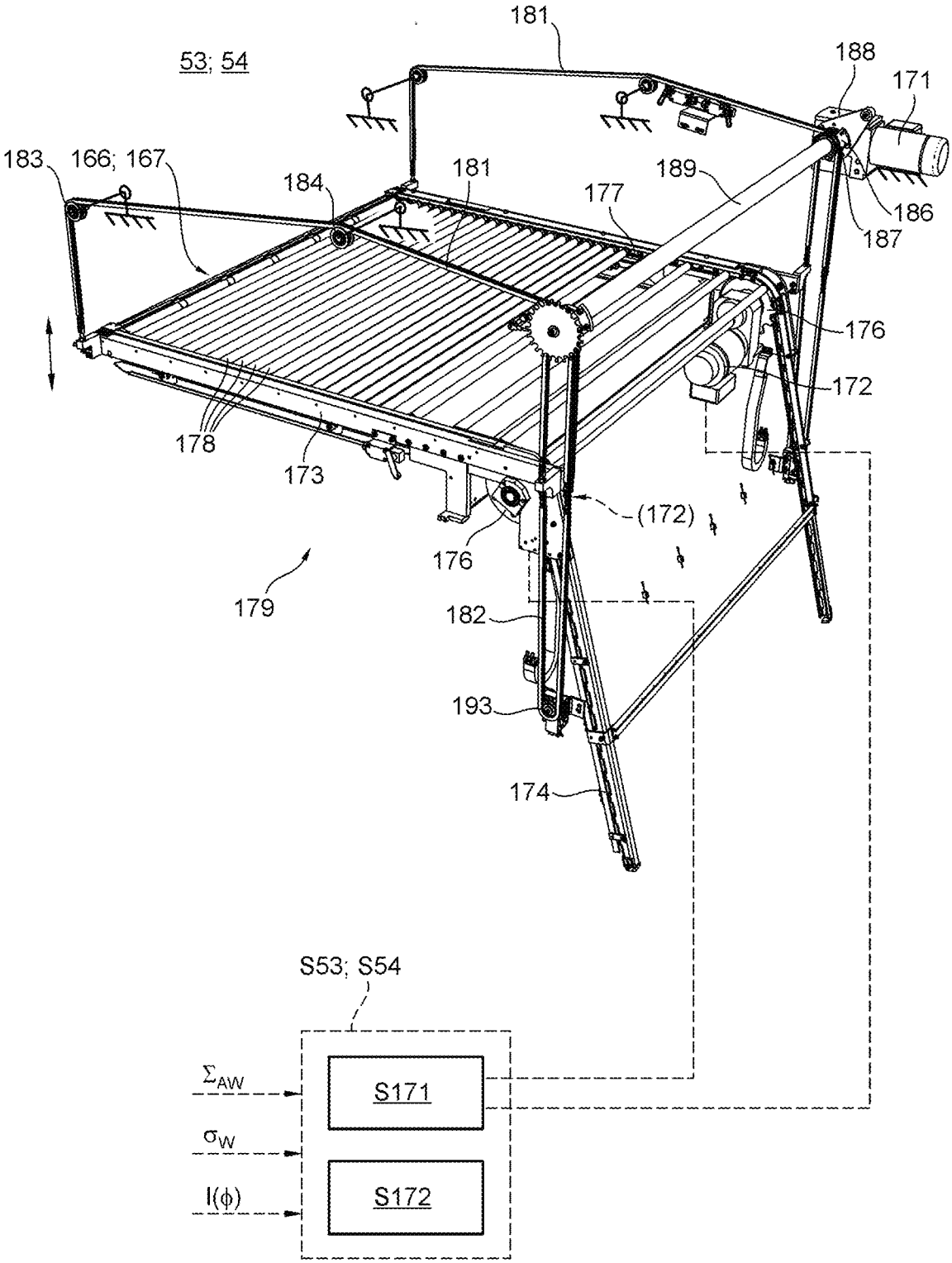
FIG. 37 a detailed, oblique view of a non-stop pile changing system.

For a non-stop pile change, i.e. a pile change that is carried out without interrupting production operation, the pile 11; 12 that will be removed is lowered from its most recent working position into a lower removal position, and auxiliary pile board 166; 167 is moved into its working position, i.e. into the drop path of sheets B being released (see, e.g. FIG. 36*a*) for the second or good sheet pile 12 and FIG. 36*b*) for the first or waste sheet pile 12). The subsequent sheets B are thus stacked on auxiliary pile board 166; 167 to form an auxiliary pile 168; 169, and auxiliary pile board 166; 167 is lowered accordingly as the pile height increases. After the pile 11; 12 to be taken away has been removed, an empty loading means 61; 62 is placed on the (main) pile board 36; 37, e.g. an empty pallet 61; 62 is placed on the pile board 36; 37. The (main) pile board 36; 37 is then moved upward until it a surface of the empty loading means 61; 62 reaches the auxiliary pile board 166; 167. By returning auxiliary pile board 166; 167 to its idle position, auxiliary pile 168; 169 is transferred to the new loading means 61; 62, which is then lowered accordingly as the pile height increases, in a manner known per se, by lowering the (main) pile board 36; 37.

Figure 2:
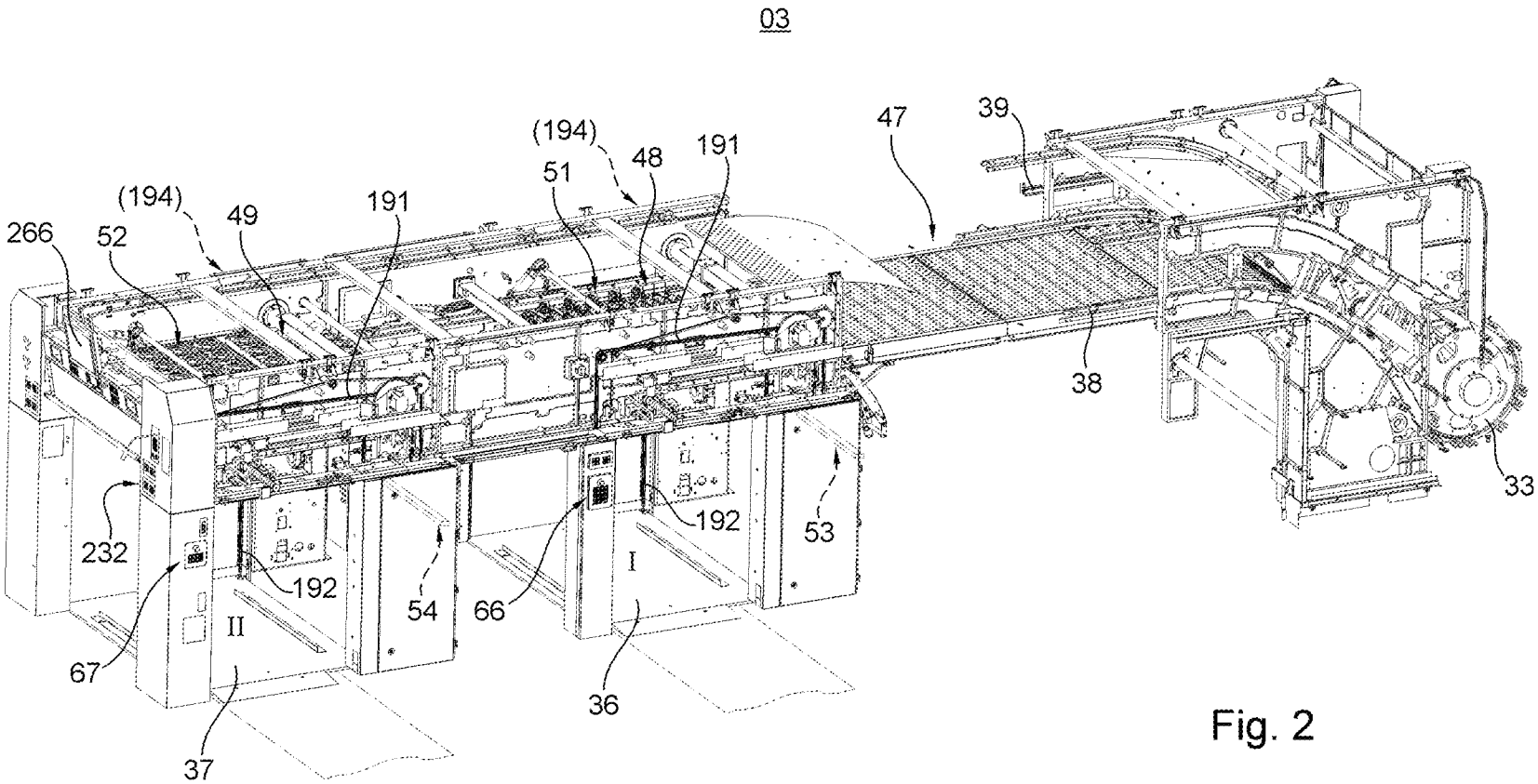
FIG. 2 a partially open, perspective view of a delivery device which is part of the machine.

In principle, pile board 36; 37 can be raised and lowered in any desired manner; preferably, however, this is carried out in a manner comparable to the vertical movement of auxiliary pile board 166; 167, via drawing means 191; 192, e.g. chains 191; 192, driven by at least one drive means 194, e.g. at least one motor 194, indicated, e.g. in FIG. 2, only by the reference sign.

The first and second pile changing systems 53; 54 are independently operable. In other words, during production operation of the press 01 and/or the delivery device 03, a non-stop pile change can be initiated and/or carried out in each of the two delivery stations I; II, regardless of whether or not a pile change is likewise being carried out in the other delivery station I; II.

Each of the delivery stations I; II is preferably assigned at least one control means 211; 212; 213; 214 to be actuated by the press operator, hereinafter also called a switching element 211; 212; 213; 214 or, e.g. a pushbutton 211; 212; 213; 214, disposed on a longitudinal side of delivery device 03, directly on frame G or on a dedicated control column (see, e.g. FIG. 39), which control means is in signal communication with control means S172 for controlling the drive means 172 for pivoting in/out in the delivery station I; II in question. For example, each delivery station I; II is provided with a switching element 211; 213, the actuation of which causes auxiliary support means 166; 167 to move into a working position in the drop path of sheets B, and/or a switching element 212; 214, the actuation of which causes auxiliary support means 166; 167 to move out of the drop path of sheets B into an idle position. As an alternative or preferably in addition to this, at least one control means 216; 217 to be operated by press operators, hereinafter also called switching element 216; 217 or, e.g. pushbutton 216; 217, is assigned, which is in signal communication with control means S171 for controlling the drive means 171 for lowering/raising auxiliary pile board 166; 167 in the delivery station I; II in question. For example, each delivery station I; II is provided with a switching element 216; 217, the actuation of which raises the relevant auxiliary support means 166; 167, e.g. to an upper end position.

One, some, or all of said switching elements 211; 212; 213; 214; 216; 217 may be included in an aforementioned user interface 66; 67, which is assigned to the respective delivery station I; II, in which case a user interface 66; 67 is embodied, for example, as an integral or multi-part control field 66; 67. The user interfaces 66; 67 assigned to each of the delivery stations I; II on the longitudinal side of delivery device 03 can be disposed directly on frame G or on a control column provided specifically for this purpose.

Thus, the drive means 171; 172 for effecting the inward and outward movement, and/or for effecting the vertical movement are controlled, for example, via said control means S171; S172, which are configured and/or programmed to effect the insertion or removal, or at least the lifting, of the auxiliary support means 166; 167, according to an issued positioning command. This positioning command may be triggered directly by a press operator, i.e. by signals $a_w$ from one or more switching elements 211; 212; 213; 214; 216; 217, e.g. pushbuttons 211; 212; 213; 214; 216; 217, that can be actuated by press operators. Alternatively or in addition to this, the positioning command may be issued both via said manual intervention and via an implemented program routine for automatic pile changing, which can be and/or is triggered in the aforementioned manner, for example by press operators, via a control means not explicitly described here, e.g. in the form of a switching element or pushbutton, of a user interface 66; 67, and/or automatically, by the pile reaching a predetermined or maximum pile height.

Together with one or more features of the above-described embodiments of sheet guiding device 47 and/or brake system 48; 49 and/or blower system 51; 52 and/or approach section 78 and/or release system 139 and/or non-stop pile changing system 53; 54, or also on its own, delivery system 03 comprises the lateral stop systems 103, mentioned above, in the region of the first and/or the second delivery station I; II.

Figure 38:
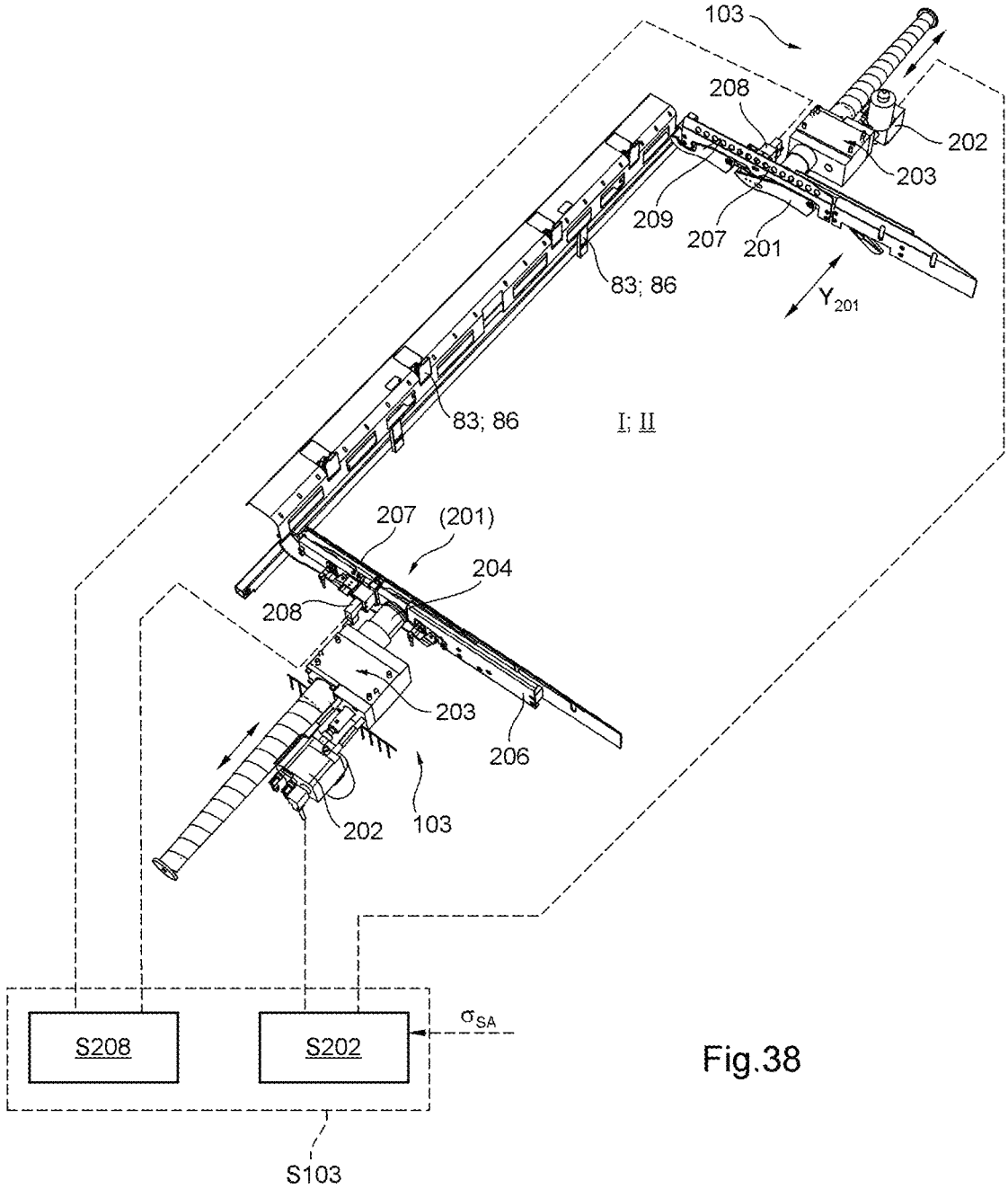
FIG. 38 an oblique view of a lateral stop system.

Preferably, the delivery station I; II in question comprises a lateral stop system 103 on each of the two sides of the sheet transport path, with at least one, but preferably both of the two lateral stop systems 103 comprising stop means 201, e.g. lateral stops 201, that are displaceable or movable laterally as described above (see, e.g. FIG. 38). Lateral stop 201, which contributes to the formation of a defined pile side profile, can be adapted to changes in the substrate width resulting from format changes by being moved laterally. Fine lateral adjustment to optimize pile formation is also possible.

The lateral movement of stop means 201 is effected by a drive system having a drive means 202, preferably embodied as a motor 202, in particular an electric motor 202. In an embodiment which is preferred in this case, motor 202 moves stop means 201 via a threaded drive 203, wherein stop means 201 is connected directly or indirectly, and resistant to compression and tension, to a threaded spindle 204, in particular to the output end thereof, which can be rotated by drive means 202, and thereby displaced laterally. For example, stop means 201 is disposed on a mount 206, which is connected in a compression- and tension-resistant manner to spindle 204. It is also possible for a plurality of stop means 201 to be provided as viewed in transport direction T, which are displaceable laterally by drive means 202.

Each of the delivery stations I; II is preferably assigned at least one control means 218; 219; 221; 222 to be actuated by the press operator, hereinafter also called a switching element 218; 219; 221; 222 or, e.g. a pushbutton 218; 219; 221; 222, disposed on a longitudinal side of delivery device 03, directly on frame G or on a dedicated control column (see, e.g. FIG. 39), which control means is/are in signal communication with a control means S172 for controlling the drive means 202 for moving stop means 201 laterally in the delivery station I; II in question. For example, each delivery station I; II is provided with a switching element 218; 221, the actuation of which causes at least one of stop means 201 to move inward toward the center of the machine, and/or a switching element 219; 222, the actuation of which causes at least one of stop means 201 to move outward, farther away from the center. If lateral stop systems 103 are provided on both sides in the delivery station I; II, in one embodiment only one such stop means 201 that can be moved via switching elements 218; 219; 221; 222 may be provided; in another embodiment, each of the two stop means 201 that can be moved via switching elements 218; 219; 221; 222 can be moved independently, via its own switching elements 218; 219; 221; 222. In the embodiment preferred here, however, both stop means 201 that can be moved via switching elements 218; 219; 221; 222 are movable inward and outward simultaneously via common switching elements 218; 219; 221; 222.

Lateral movement, or the drive means 202 for displacing lateral stop means 201, is thus controlled, for example, via control means S202, which are in signal communication with drive means 202 and are configured and/or programmed to effect lateral movement of stop means 201 in accordance with an issued positioning command $\sigma_{SA}$. In this case, the lateral position $Y_{201}$ of stop means 201 can be viewed as the variable to be set, or as setting variable $Y_{201}$. This positioning command may be issued directly by a press operator and/or via signals $\sigma_{SA}$ from a switching element 218; 219; 221; 222 that can be actuated by a press operator. Alternatively or preferably in addition to this, the positioning command may be issued and/or issuable both via said manual intervention and by specifying a set value $W_F$, e.g. a preset value $W_F$ that is identified and/or stored for a format to be used. The latter can be transmittable or transmitted from a product planning and/or presetting system.

If a plurality of delivery stations I; II and/or a plurality of individually driven stop means 201 for one delivery station I; II are provided, then the control means S202 for actuating drive means 202 may be arranged combined as processes or circuitry in the same control unit or may be dispersed individually or in several groups.

In an advantageous refinement, lateral stop system 103 comprise a device 207, 208 for jogging the sheets along their lateral edges, also called simply a lateral jogging device 207, 208. For this purpose, said device comprises an alignment means 207, e.g. a sheet jogger 207, preferably in the form of a metal strip, which moves laterally, in particular simultaneously and/or jointly along with stop means 201, and which includes, on a side facing sheet B in the direction of the sheet's lateral edge, a stop surface 209 that can be moved back and forth, i.e. that oscillates and/or can oscillate in a lateral direction. The lateral oscillation or jogging movement of alignment means 207 helps to align the sheets B that will be deposited on the respective pile 11; 12; 168; 169 along the lateral stop means 201.

In principle, the oscillating movement can be inducible and/or induced by any type of suitable drive means 208, e.g. by a motor that acts via a cam mechanism or via an eccentric. In an embodiment that is preferred here, jogging device 107; 208 comprises as its drive a drive means 208 that is and/or can be operated using liquid or gaseous pressure medium, e.g. a hydraulic or preferably a pneumatic cylinder 208.

Control of the drive means 208 that induces the oscillation, more particularly control of a valve that is assigned to the drive means 208 that operates using pressure medium, is preferably accomplished via control means S208, which are in signal communication with drive means 208 and which are configured and/or programmed to effect an oscillating movement of the alignment means 207, in particular a switching of the valve assigned thereto, in accordance with a predefined cyclical movement profile. This movement profile may be variable, e.g. in terms of frequency and/or in terms of the level of movement amplitude, via adjustment elements (not shown).

Particularly in conjunction with the embodiment of a delivery system 03 that has two delivery stations I; II, each including a non-stop pile changing system 53;54, the lateral user interfaces 66; 67 assigned to the two delivery stations I; II each comprise control means 223; 224; 226; 227 (see, e.g. FIG. 39), hereinafter also referred to as switching elements 223; 224; 226; 227 or, e.g. as pushbuttons 223;

224; 226; 227, which are in signal communication with control means for a press controller, which can be used for controlling and/or regulating one or more drives of substrate conveying systems of the press with respect to a set value for the press speed or transport speed. For example, at least one control means 223; 226, in particular one switching element or pushbutton 223; 226, for varying the machine speed is provided per delivery station I; II, the actuation of which causes a decrease in the setpoint value for the transport speed or machine speed, and one switching element or pushbutton 224; 227, the actuation of which causes a decrease in the setpoint value for the transport speed or machine speed.

Each of the control means or switching elements 196; 197; 198; 199; 211; 212; 213; 214; 216; 217; 218; 219; 221; 222; 223; 224; 226; 227 and/or user interfaces 66; 67 provided on the longitudinal side of delivery device 03 is disposed closer to the delivery station I; II to which it is assigned than to the other delivery station. In addition, each control field 66; 67 is located closer to the lateral input into the pile space 44; 46 of the delivery station I; II whose drive means or control means S48; S49; S53; S53; S103 are actuable by the switching element(s) 196; 197; 198; 199; 211; 212; 213; 214; 216; 217; 218; 219; 221; 222; 223; 224; 226; 227 that are included in the user interface in question than to the lateral input of the other.

Not all of the aforementioned switching elements 196; 197; 198; 199; 211; 212; 213; 214; 216; 217; 218; 219; 221; 222; 223; 224; 226; 227 are required to be provided on each lateral control field; however, other switching elements, or additional switching elements not described here, may also be added.

In principle, the aforementioned switching elements 196; 197; 198; 199; 211; 212; 213; 214; 216; 217; 218; 219; 221; 222; 223; 224; 226; 227 assigned to the delivery stations I; II on the longitudinal sides thereof may be implemented as any type of mechanical or electronic switching elements. For instance, as already mentioned, they may be embodied, for example, as mechanical pushbuttons 196; 197; 198; 199; 211; 212; 213; 214; 216; 217; 218; 219; 221; 222; 223; 224; 226; 227, in which case two switching elements 196; 197; 198; 199; 211; 212; 213; 214; 216; 217; 218; 219; 221; 222; 223; 224; 226; 227 that act in opposite ways on the same drive may be embodied either as separate or as combined, in the form of a double pushbutton, e.g. a rocker switch. In another embodiment, the or some of the aforementioned switching elements 196; 197; 198; 199; 211; 212; 213; 214; 216; 217; 218; 219; 221; 222; 223; 224; 226; 227 may be embodied as touch-sensitive buttons, or as fields, generated permanently or only temporarily, representing touch-sensitive buttons 196; 197; 198; 199; 211; 212; 213; 214; 216; 217; 218; 219; 221; 222; 223; 224; 226; 227 on a touch-sensitive display device. A combination of different embodiments may also be provided.

Of particular advantage is an embodiment of delivery system 03, configured as a multi-pile, in particular a dual-pile delivery system, in which, at a level downstream of and behind the lateral input into the pile space 46 of the second delivery station I; II, as viewed in the longitudinal direction of delivery system 03, on the frame or on a control column provided specifically for this purpose, one or more switching elements 196'; 197'; 218'; 219' are provided, which are operatively connected via signal communication to drives 203, S203; 63, S63 of format-relevant systems 103; 48, i.e. systems that must be adjusted to each format, of the first delivery station I as viewed in transport direction T, more particularly to drive means 203 that moves stop means 202 of a lateral stop system 103 transversely, or to the control means S203 assigned thereto, and/or to drive means 63 that moves braking system 48 or its holding means 92 along transport direction T, or to the control means S63 assigned thereto, at least of the first delivery station I. Preferably, corresponding switching elements 198'; 199'; 221'; 222' for the relevant drives of the second or last delivery station II in transport direction T are likewise provided on the end face. A "level downstream of the second delivery station II" is understood here as a location behind a plane at the end of the second delivery station II that is perpendicular to the horizontally projected sheet transport direction.

In a particularly advantageous embodiment, switching elements 196'; 197'; 218'; 219' and/or 198'; 199'; 221'; 222' are provided in the area of an end face of delivery system 03 which is opposite the intake side for sheets B, directly on frame G or on an end-face control column provided specifically for this purpose.

Figure 40:
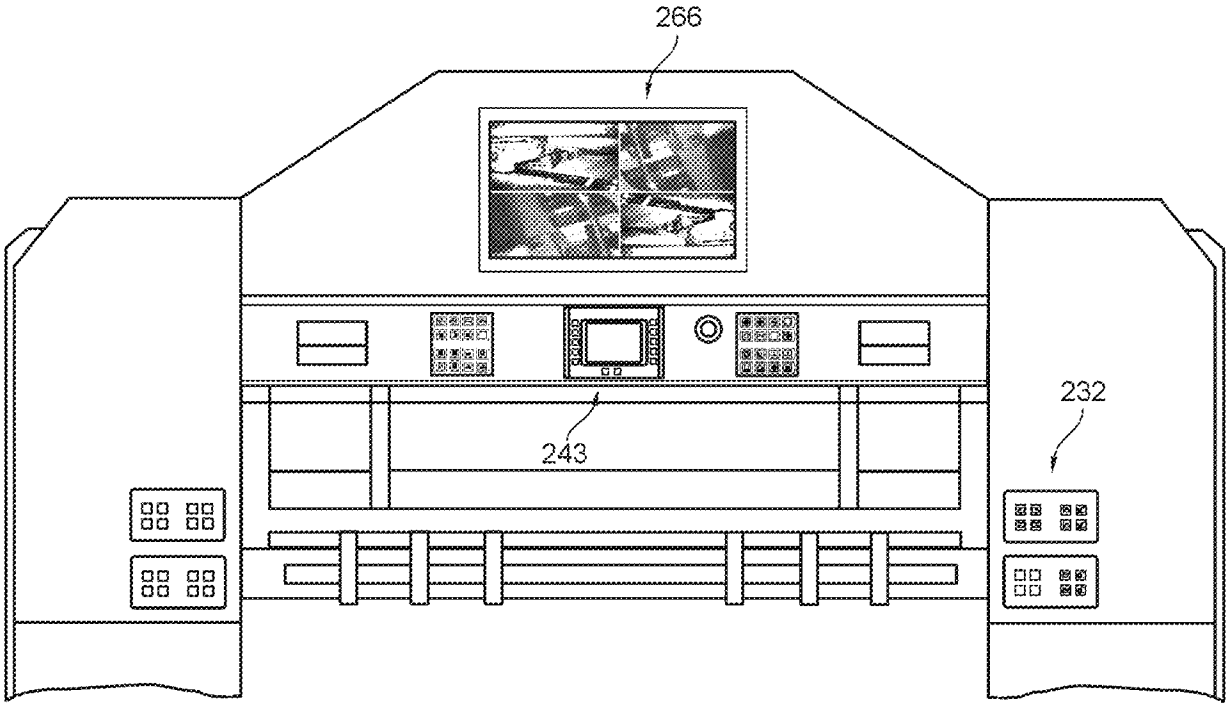
FIG. 40 a front-end view of the delivery device.

Of particular advantage in this case is an embodiment of delivery system 03, configured as a multi-pile, in particular a dual-pile delivery system, in which, in the area downstream of the second delivery station II and/or in particular in the area of an end face of delivery system 03 which is opposite the intake side for sheets B, directly on frame G or on an end-face control column provided specifically for this purpose, one or more switching elements 218'; 219'; 221'; 222', e.g. pushbuttons 218'; 219'; 221'; 222', to be actuated by press operators are provided (see, e.g. FIG. 40 or FIG. 42), which are in signal communication with a control means S172 for controlling the drive means 202 for moving stop means 201 laterally in the first delivery station I along the transport path, and/or which are in signal communication with a control means S172 for controlling the drive means 202 for moving stop means 201 laterally in the second delivery station II along the transport path. For example, the delivery station I; II in question, or more particularly each delivery station, is provided with a switching element 218'; 221', the actuation of which causes at least one of stop means 201 to move inward toward the center of the machine, according to positioning command $\sigma_{SA}$, and/or a switching element 219'; 222', the actuation of which causes at least one of stop means 201 to move outward, farther away from the center, according to positioning command $\sigma_{SA}$. If lateral stop systems 103 are provided on both sides of the delivery station I; II, the above description relating to the lateral disposition applies accordingly. The end-face disposition of the end-face switching element(s) 218'; 219'; 221'; 222' or pushbutton(s) 218'; 219'; 221'; 222' may be provided as an alternative to the laterally disposed switching elements 218; 219; 221; 222, e.g. pushbuttons 218; 219; 221; 222, but is preferably provided in addition thereto.

The lateral movement of lateral stop means 201, or the drive means 202 for displacing said stop means, is controlled in the manner described above in connection with the lateral disposition of switching elements 218; 219; 221; 222 or pushbuttons 218; 219; 221; 222, but via the control means S202 and/or drive means 202 that are in signal communication with the end-face switching element 218'; 219'; 221'; 222' or pushbutton 218'; 219'; 221'; 222' in question.

In principle independently of the aforementioned switching elements 218'; 219'; 221'; 222' relating to lateral stop system 103, but preferably in conjunction therewith, in an advantageous embodiment of delivery system 03, configured as a multi-pile, in particular as a dual-pile delivery system 03, on an end face in the area downstream of the second delivery station II and/or in particular in the area of the end face which is opposite the intake side for the sheets B, directly on frame G or on a control column provided specifically for this purpose, one or more switching elements 196'; 197'; 198'; 199', e.g. pushbuttons 196'; 197'; 198'; 199' to be actuated by press operators are provided (see, e.g. FIG. 40 or FIG. 42), which would be in signal communication with a control means S63 for controlling the drive means 63 for moving the braking system 48; 49 or holding means 92 in the first delivery station I along the transport path, and/or is in signal communication with a control means S63 for controlling the drive means 63 for moving the braking system 48; 49 or the holding means 92 in the second delivery station II along the transport path. For example, the delivery station I; II in question, or more particularly each delivery station, is provided with a switching element 196'; 198', the actuation of which causes braking system 48; 49 or holding means 92 to move downstream according to the issued positioning command $\sigma_{FP}$, and a switching element 197'; 199', the actuation of which causes braking system 48; 49 or holding means 92 to move upstream.

The end-face disposition of the end-face switching element(s) 196'; 197; 198'; 199', e.g. pushbuttons 196'; 197'; 198'; 199', may be provided as an alternative to the aforementioned laterally disposed switching elements 196; 197; 198; 199, e.g. pushbuttons 196; 197; 198; 199, but is preferably provided in addition thereto.

The movement of braking system 48; 49 or of holding means 92, or the drive means 63 for displacing said braking system or holding means, is controlled in the manner described above in connection with the lateral disposition of switching elements 196; 197; 198; 199 or pushbuttons 196; 197; 198; 199, but via the control means S202 and/or drive means 202 that are in signal communication with the end-face switching element 218'; 219'; 221'; 222' or pushbutton 218'; 219'; 221'; 222' in question.

One, some, or all of the end-face switching elements 218'; 219'; 221'; 222' or pushbuttons 218'; 219'; 221'; 222' relating to the lateral stops, and/or one, some, or all of the end-face switching elements 196'; 197'; 198'; 199' or pushbuttons 196'; 197'; 198'; 199' relating to the position of braking system 48; 49 or of holding means 92 may be included in one end-face user interface 232, with such a user interface 232 being configured, for example, as an integral or multi-part control field 232. The user interface 232 provided in the area of the end face of delivery device 03 may be disposed directly on frame G or on a control column provided specifically for this purpose.

In principle, the aforementioned switching elements 196'; 197'; 198'; 199'; 218'; 219'; 221'; 222' provided in the end-face area may be implemented as any type of mechanical or electronic switching element. For instance, as already mentioned, they may be embodied, for example, as mechanical pushbuttons 196'; 197'; 198'; 199'; 218'; 219'; 221'; 222', in which case two switching elements 196'; 197'; 198'; 199'; 218'; 219'; 221'; 222' that act in opposite ways on the same drive may be embodied either as separate or as combined, in the form of a double pushbutton, e.g. a rocker switch. In another embodiment, the or some of the aforementioned switching elements 196'; 197'; 198'; 199'; 218'; 219'; 221'; 222' may be embodied as touch-sensitive buttons, or as fields, generated permanently or only temporarily, representing touch-sensitive buttons 196'; 197'; 198'; 199'; 218'; 219'; 221'; 222' on a touch-sensitive display device. A combination of different embodiments may also be provided.

Independently of, but preferably in conjunction with the disposition of one or more switching elements 196'; 197'; 198'; 199;218'; 219'; 221'; 222' for the aforementioned adjustment of format-relevant systems 103; 48, in a likewise particularly advantageous embodiment of the delivery system 03 configured as a multi-pile, in particular a dual-pile delivery system 03, at a level downstream of and behind the lateral input into the pile space 46 of the second delivery station I; II as viewed in the longitudinal direction of the delivery system 03, and/or in particular in the aforementioned end-face region of delivery system 03, directly on frame G or on an end-face control column provided specifically for this purpose, one or more control means 228; 229; 231; 234; 233; 237; 238; 241, hereinafter also referred to as switching elements 228; 229; 231; 233; 234; 237; 238; 241 or pushbuttons 228; 229; 231; 233; 234; 237; 238; 241, are provided, which are in permanent or at least activatable signal communication with drives of transport-relevant systems 139; 48, i.e. systems that are relevant to the movement of sheets B, at least of the first delivery station I as viewed in transport direction T, in particular with drive means 147 of release system 139 or the control means 147 assigned thereto, for varying the location of gripper opening point $X_{139}$ as setting variable $X_{139}$ along transport direction T, and/or with drive means 106 for dynamically driving holding means 92 or the control means S106 assigned thereto. Preferably, corresponding switching elements 228; 229; 234; 236; 237; 238; 242 for the relevant drives of the second delivery station II in transport direction T are likewise provided on the end face.

Figure 43:
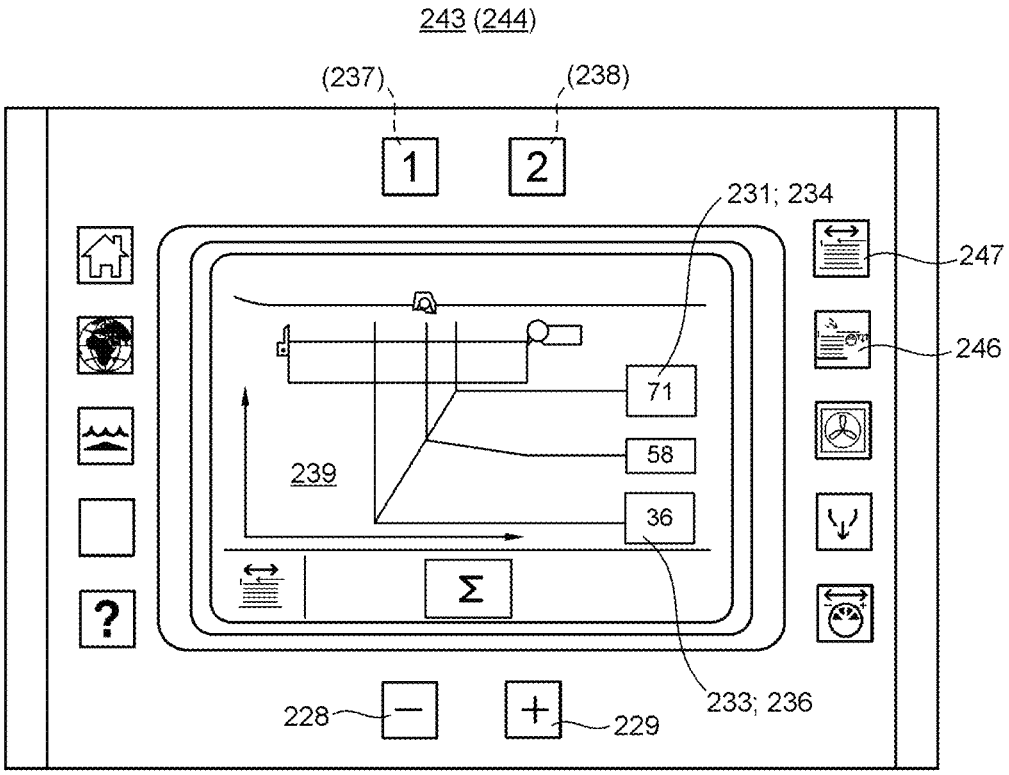
FIG. 43 an example of the embodiment of a user interface with control means for setting or adjusting a gripper opening point.

The point of sheet release, i.e. the aforementioned gripper opening point, for the release system 139 of the first and/or the second delivery station I; II can preferably be adjusted or varied by the press operator. For this purpose, for delivery station I and/or delivery station II, either on a longitudinal side of delivery device 03 and/or preferably in the area downstream of the second delivery station II, preferably on the end face, one or more switching elements 228; 229; 231; 233; 234; 236; 237; 238, e.g. pushbuttons 228; 229; 231; 233; 234; 236; 237; 238 to be actuated by the press operator are provided (see, e.g. FIG. 43), which is in permanent or at least activatable signal communication with the control means S147 for controlling drive means 147 for varying the transport path-based point of release, or the aforementioned contact point 151 for initial contact in the delivery station I; II in question.

In particular, actual switching elements 228; 229; 231; 233; 234; 236; 237; 238, for example, or virtual switching elements that can be activated, are provided, which are connected in terms of signals, permanently or at least in their active state, to control means S147 for controlling the drive means 147 for adjusting the gripper opening point of delivery stations I and/or delivery stations I; II, by the activation of which an opening time can be set for the delivery station I; II in question, according to a positioning command $\sigma_o p$ issued by said activation. Preferably, however, switching elements 228; 229; 231; 233; 234; 236; 237; 238 are provided, which are connected in terms of signals, permanently or at least in their active state, to the control means S147 for controlling the drive means 147 of delivery stations I; II, by means of which both the latest gripper opening point and the earliest gripper opening point with respect to transport direction T can be adjusted for each delivery station I; II. This applies particularly in conjunction with the aforementioned setting of drive means 147 or of the gripper opening point in correlation with the press speed or transport speed Φ.

Figure 44:
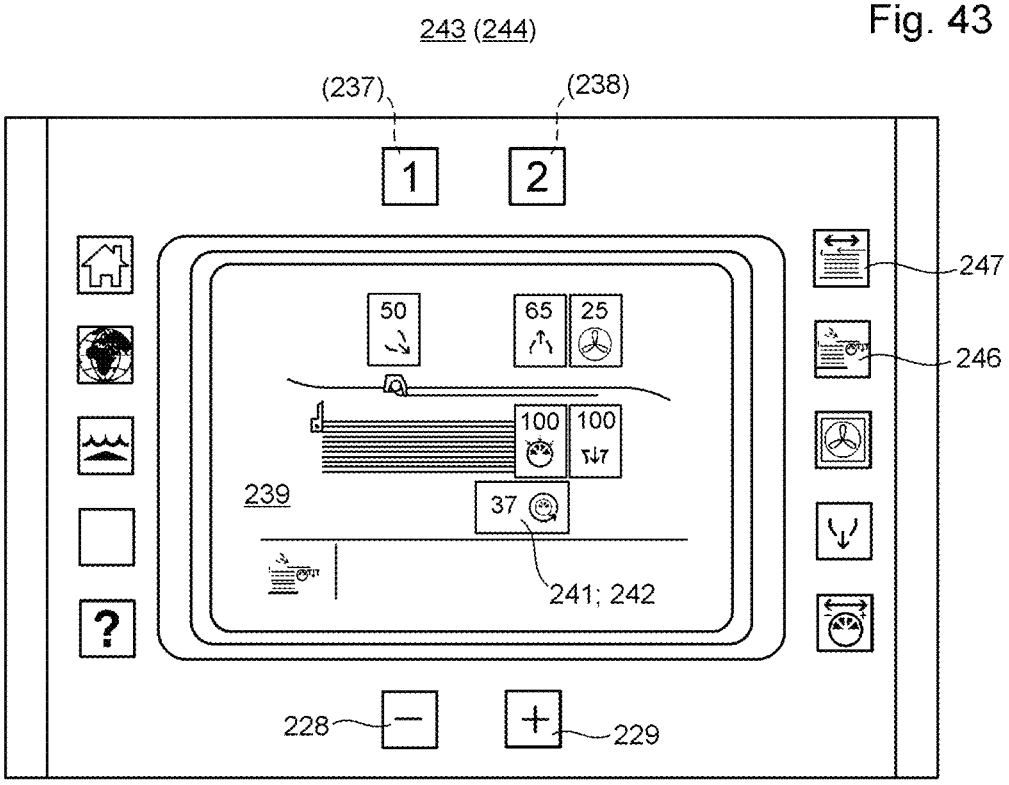
FIG. 44 an example of the embodiment of a user interface with control means for setting or adjusting a delivery speed.

Independently of the above description relating to the gripper opening point, but preferably in conjunction therewith, as a variable that may be set, e.g. a setting variable, at least the deposition speed $v_{dep}$, and where applicable other variables for the braking system 48; 49 of the first and/or the second delivery station I; II may be adjusted and/or varied by press operators. For this purpose, for delivery station I and/or for delivery station II, either on a longitudinal side of delivery device 03 and/or preferably in the area downstream of the second delivery station II, preferably on the end-face side, one or more switching elements 241; 242; 228; 229; 237; 238, e.g. pushbuttons 241; 242; 228; 229; 237; 238, to be actuated by press operators are preferably provided (see, e.g. FIG. 44), which are in permanent or at least activatable signal communication with control means S106 for controlling the drive means 106 for dynamically driving holding means 92 in the delivery station I; II in question.

In particular, switching elements 241; 242; 228; 229; 237; 238 are provided, which are connected in terms of signals, permanently or at least in their active state, to control means S106 for controlling the drive means 106 of delivery stations I and/or of delivery stations I; II; by actuating said control means, the deposition speed $v_{dep}$ may be set for the delivery station I; II in question, according to a control command $\sigma v_{dep}$ issued via the actuation.

In principle, switching elements 228; 229; 231; 233; 234; 236; 237; 238; 241; 242 for adjusting the gripper opening point and/or for adjusting the deposition speed $v_{dep}$ may be embodied in the form of pushbuttons 228; 229; 231; 233; 234; 236; 237; 238; 241; 242, and may be permanently connected as described above to the drive means, and/or to the control means assigned thereto.

In that case, to adjust the gripper opening point in a variant of this embodiment that is not shown, for example, one pushbutton for shifting the gripper opening point in a downstream direction and one pushbutton 228; 229; 231; 233; 234; 236; 237; 238 for shifting the gripper opening point in an upstream direction may be provided. In a further refinement of this variant, however, the earliest gripper opening point in transport direction T and the latest gripper opening point in transport direction T can be adjusted in each delivery station I; II, in each case by means of four pushbuttons 228; 229; 231; 233; 234; 236; 237; 238. For adjusting the deposition speed $v_{dep}$, in a variant of this embodiment that is not shown, for example, one pushbutton that increases the deposition speed $v_{dep}$ when actuated, and one pushbutton 241; 242; 228; 229; 237; 238 that decreases the deposition speed $v_{dep}$ when actuated may be provided in each case.

In an embodiment that is particularly preferred in this case, all or at least some of the switching elements 228; 229; 231; 233; 234; 236; 237; 238; 241; 242 for adjusting the gripper opening point and/or for adjusting the deposition speed $v_{dep}$ are embodied as touch-sensitive buttons 228; 229; 231; 233; 234; 236; 237; 238; 241; 242, in the form of fields 228; 229; 231; 233; 234; 236; 237; 238; 241; 242, generated permanently or only temporarily, of a touch-sensitive display device 239, e.g. a touch-sensitive display 239, also referred to as touch-enabled, or simply as a touch display. In principle, all or only some of the pushbuttons 228; 229; 231; 233; 234; 236; 237; 238; 241; 242 may be configured as virtual buttons in the form of touch-sensitive fields 228; 229; 231; 233; 234; 236; 237; 238; 241; 242.

In the embodiment shown, however, at least pushbuttons 231; 233; 234; 236; 241; 242, which concern the selection of a specific setting variable for the system 139 in question, can be embodied as fields 231; 233; 234; 236; 241; 242 which are generated at least temporarily on display 239 and are active in that state. Pushbuttons 228; 229 that affect the value of the variable itself and/or affect a change in the value of a selected variable, and/or pushbuttons 237; 238 that are used to select the delivery station I; II to be adjusted, may be embodied, e.g. as actual, mechanical, or touch-sensitive pushbuttons 228; 229; 228; 229; 237; 238.

In an embodiment in which all of the switching elements 228; 229; 231; 233; 234; 236; 237; 238; 241; 242 that involve the adjustment of the gripper opening point and/or the deposition speed $v_{dep}$ are embodied as fields 228; 229; 231; 233; 234; 236; 237; 238; 241; 242 in the form of virtual buttons, formed by display 239 itself in a control field 243; 244, e.g. control panel 243; 244, for adjusting the gripper opening point and/or the delivery speed $v_{dep}$. In a combined form, a control field or control panel 243; 244 for adjusting 243 the gripper opening point and/or the deposition speed $v_{dep}$ is formed by the display 239 that contains the fields 231; 233; 234; 236; 241; 242 and the other associated switching elements 228; 229; 228; 229; 237; 238.

If setting variables for a plurality of functionally different systems 48; 49; 139, for example a lateral stop system 103 and a braking system 48; 49, can be set via the same display 239 and/or the same control panel 423; 244, then control panel 243 preferably additionally comprises at least one control means 246, hereinafter also a switching element 246 or, e.g. pushbutton 246, but preferably comprises a control means 246; 247, hereinafter also a switching element 246; 247 or, e.g. a pushbutton 246; 247, for each of the functionally different systems 48; 49; 139 to be set, which can be actuated to select the functional system 48; 49; 139 that will be set. This pushbutton 246; 247 can again be in the form of a field 246; 247 integrated into display 239, or in the form of an actual mechanical or touch-sensitive pushbutton 246; 247.

In a particularly advantageous embodiment in terms of equipment costs, the delivery system 03 configured as a multi-pile, in particular as a dual-pile delivery system 03 comprises a common, e.g. integral or multi-part control field 243, preferably a control panel 243 having only one display 239, embodied, e.g. as a modular unit, which press operators can use to adjust quality-relevant systems 139; 48; 49, e.g. of the gripper opening point and/or of the deposition speed $v_{dep}$, of both the first and the second delivery stations I; II. Although in principle, control field 243 may be provided on the longitudinal side, it is advantageously located in the area downstream of the second delivery station II, preferably on the end face of delivery system 03 opposite the sheet intake.

For this purpose, control field 243 comprises first switching elements 228; 229, which can be actuated to input and/or modify the value of a variable to be set. These may be keys of a keypad for entering the value or, as shown here, for example, plus and minus keys for gradually increasing and decreasing the current value. Control field 243 additionally comprises at least one switching element 228; 229 that can be actuated to select the delivery station I; II that will be affected by the manipulation to be carried out using the first switching elements 228; 229. Control field 243 further comprises at least one switching element 246; 247 that can be actuated for a selected delivery station I; II to produce or activate a signal connection between the first switching elements 228; 229 and the drive of a system 48; 49 of the delivery station I; II in question. For a plurality of functionally different systems 48; 49; 139 to be adjusted per delivery station I; II, control panel 243 comprises one such switching element, or more particularly a plurality of such switching elements 246; 247, the actuation of which for the selected delivery station I; II produces or activates a signal connection between the first switching elements 228; 229 that relate to the value of the variable to be set and either the drive of a first system 48; 49; of the delivery station I; II in question or the drive of a second system 139.

With appropriate activation, the switching elements 228; 229 that relate to the value of the respective correcting variable can thus be placed either in operative signal communication with drives of the aforementioned quality-relevant systems 139; 48 of the first delivery station I; II or in operative signal communication with drives of the aforementioned quality-relevant systems 139; 48; 49 of the second delivery station I; II. For activation, switching elements 237; 238; 246; 247 are provided, which can be actuated to select the delivery station I; II that will be affected by the adjustment, and/or the systems 139; 48; 49 that will be adjusted.

To facilitate the assignment of the common control display 11 to the currently selected delivery station I; II to be adjusted, means for visualizing the delivery station I; II that will currently be impacted by the selection of an aforementioned variable are assigned to control display 11, i.e. means for visualizing the delivery station I; II, or the drive means thereof, that is currently active on the control display 11, i.e. the delivery station that is in signal communication with the control means that may be actuated in making adjustments.

In principle, this may be a numerical representation on display 239, or control panel 243 on another display device. However, switching elements 228; 229 provided for selecting the delivery station I; II may also be embodied as illuminated buttons that light up when activated, for example, until the selection is changed. It is also possible for symbols or markings associated with the two delivery stations I; II to be provided, to which spatially corresponding signal elements, e.g. lights, are assigned.

Figure 3:
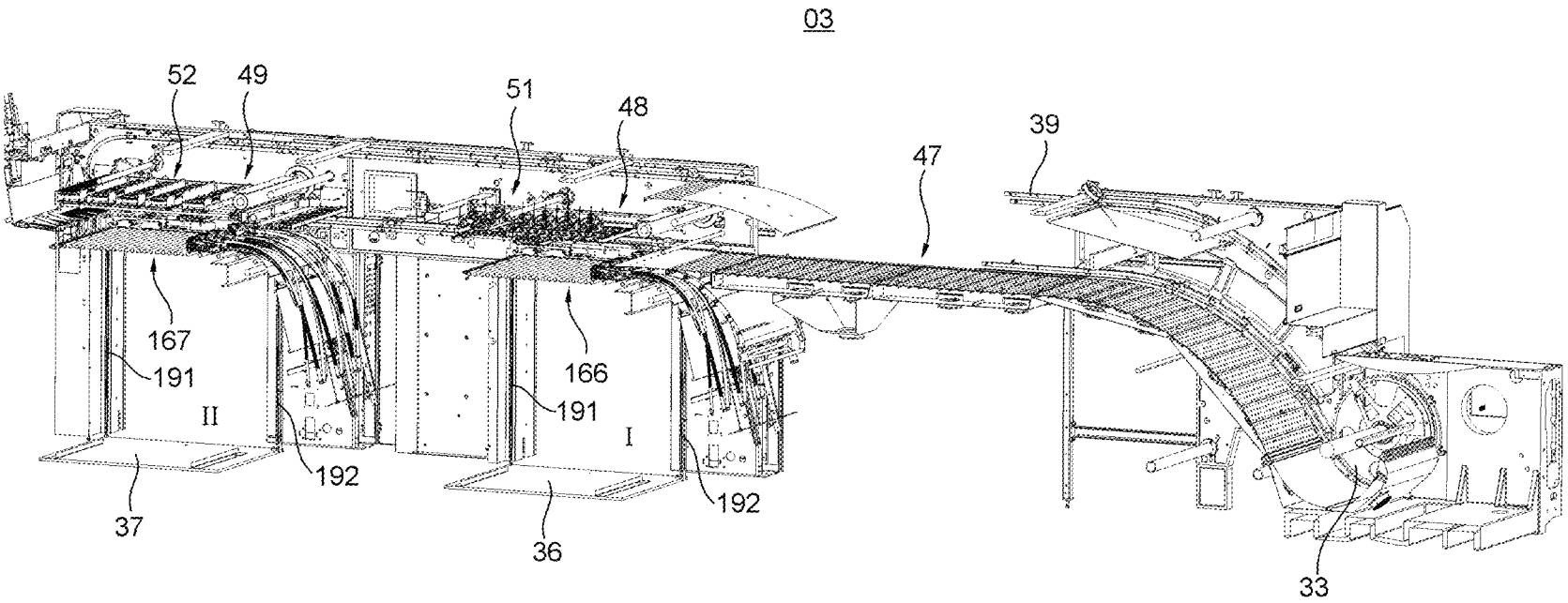
FIG. 3 an open view from the side of the delivery device which is part of the machine.
Figure 45:
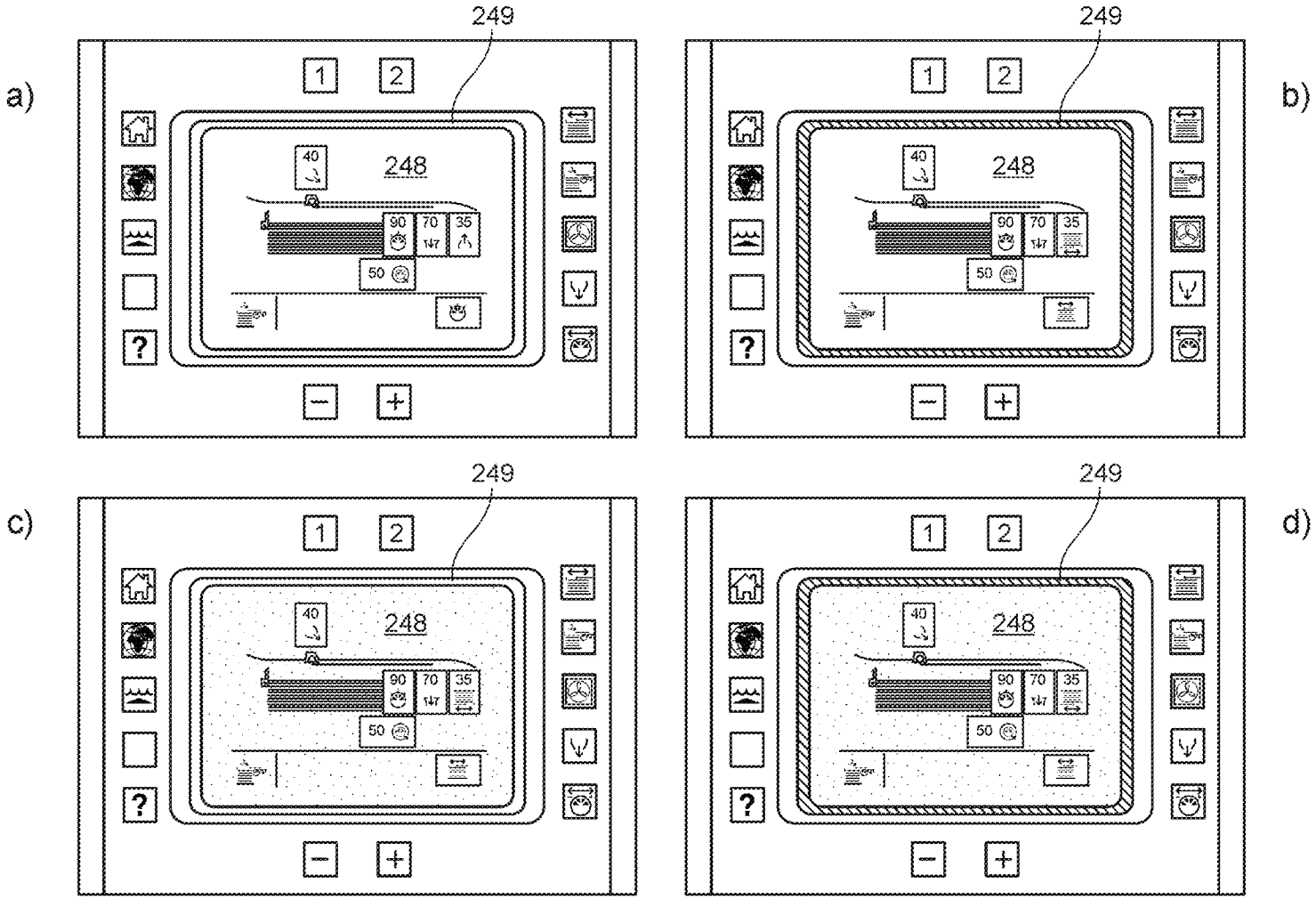
FIG. 45 an example of the embodiment of a user interface having a control field that comprises a display for adjusting devices of either the first or the second delivery station.

In a particularly advantageous, particularly eye-catching embodiment, as the means for visualizing the delivery station I; II that is currently active on display 239 and/or is currently in signal communication with the first switching elements 228; 229, software means are provided, which change the image background on display 239 depending upon which delivery station I; II is selected or active, within an area 248 of the display surface that may be formed by the entire delivery station or by a defined portion thereof. For the two display modes, this may involve a change in the brightness of the background and/or a change in color. In a particularly advantageous variant of this embodiment, the two color points of the display background are spaced sufficiently from one another in the color space, e.g. by at least $\Delta E_{ab}>10$, advantageously $\Delta E_{ab}>20$. By way of example, FIG. 45 shows a change in the image background in an area 248 that occupies almost the entire area here, in which the different coloring of the background is symbolized by different infill. For example, a first background (e.g. gray) is active (e.g. FIGS. 3*a*) and *b*)) when control display 11 or the display device 12 for setting a device of the first delivery station I; II is activated, and a second background is activated (e.g. green) (e.g. FIGS. 3*c*) and *d*)) when the control display 11 or display 12 for setting a device of the second delivery station II; I is activated. Display device 12 is switched accordingly when the delivery station II; I that is active for setting is changed.

As an alternative or preferably in addition to this, means for visualizing the currently active delivery station I; II, i.e. the delivery station currently delivering sheets B, e.g. means for visualizing the currently active delivery station I; II, may be assigned to control field 11.

This may again, in principle, be an alphanumeric representation, e.g. a numeral indicating the delivery station I; II, in display 239 or on another display device in control field 243. It is also possible for symbols or markings associated with the two delivery stations I; II to be provided, to which spatially corresponding signal elements, e.g. lights, are assigned.

In a particularly advantageous and particularly eye-catching embodiment, software means are provided as means for visualizing the currently active delivery station I; II, which change the image background on display 239 according to which delivery station I; II is currently active in terms of sheet delivery, within an area 249 of the display surface that may be formed by the entire delivery station or by a defined portion thereof. For the two display modes of display 239, this may involve a change in the brightness of the background and/or a change in the color. In a particularly advantageous variant of this embodiment, the two color points of the display background are spaced sufficiently from one another in the color space, e.g. by at least $\Delta E_{ab}>10$, advantageously $\Delta E_{ab}>20$. By way of example, FIG. 45 shows a change in the image background in an area 249 shown here in the form of a frame encompassing the edges of the display area, in which the different coloring of the background is symbolized by different infill. For example, a first background (e.g. blue), shown by way of example without infill in FIGS. 3*a*) and *c*), is active when the first delivery station I; II is active, and a second background (e.g. red), shown by way of example with a slanted-line infill in FIGS. 3*b*) and *d*), is active when the second delivery station II is active. Display device 12 is switched accordingly when the active delivery station II; I is changed.

If both means for visualizing the delivery station I; II currently active on display 239 and means for visualizing the currently active delivery station I; II are provided, then the two means may be embodied as any combination of the aforementioned embodiments, with the exception of identical means. However, an image background composed of a combination of changing regions 248; 249 is preferred.

In a preferred embodiment, control field 243; 244 or control panel 243; 244 can be used both for adjusting the drives of systems of a plurality of delivery stations I; II, in particular two, and for displaying information about the delivery station that is currently active in terms of sheet delivery.

The control field 243 comprising display 239 represents a user interface 253, in particular disposed on an end face, or is included as part of such a user interface, along with additional control means that may be located adjacent or in close proximity thereto.

Figure 46:
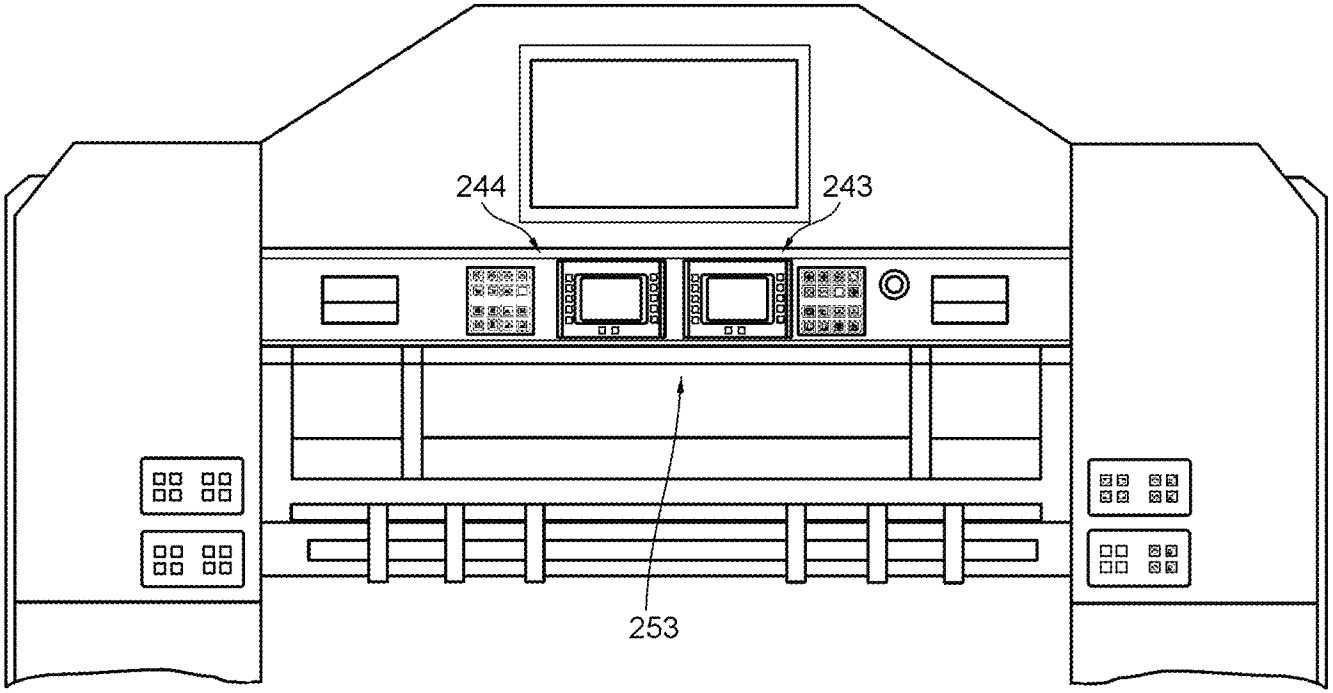
FIG. 46 an example of the embodiment of a user interface having two control fields comprising one display each for adjusting systems of the first and the second delivery station.

In an embodiment which is particularly advantageous in terms of a particularly low risk of operator error, delivery system 03, configured as a multi-pile, in particular a dual-pile delivery system 03, comprises a dedicated control field 244, e.g. an integral or multi-part control field 243; 244, preferably embodied, e.g. as a modular unit, for each of the delivery stations I; II, with each such control panel including a display 239, via which press operators can adjust quality-relevant systems 139; 48; 49, e.g. of the gripper opening point and/or the deposition speed $v_{dep}$, in the delivery station I; II to which said display is functionally assigned (see, e.g. FIG. 46). Although control fields 243; 244 may, in principle, be provided on the longitudinal side, they are advantageously provided in the area downstream of the second delivery station II, preferably at the end face of delivery system 03 opposite the sheet intake point.

For this purpose, each control field 243; 244, e.g. control panel 243; 244, comprises first switching elements 228; 229, which can be actuated to input and/or modify the value of a variable to be set. These may be keys of a keypad for entering the value or, as shown here, for example, plus and minus keys for gradually increasing and decreasing the current value. Control fields 243; 244 further each comprise at least one switching element 246; 247, which can be actuated for the delivery station I; II assigned to the control field 243; 244 to produce or activate a signal connection between the first switching elements 228; 229 and the drive of a system 48; 49 of the delivery station I; II in question. In cases in which a plurality of functionally different systems 48; 49; 139 are to be adjusted in one or in all of delivery stations I; II, the associated control field 243; 244 comprises one, or more particularly a plurality of such switching elements 246; 247, the actuation of which for the associated delivery station I; II produces or activates a signal connection between the first switching elements 228; 229 that relate to the value of the variable to be set and either the drive of a first system 48; 49 of the associated delivery station I; II or the drive of a second system 139.

Thus, in this case, the switching elements 228; 229 that relate to the value of the respective control variable, when activated appropriately on the associated control field 243; 244, can be placed in operative signal connection by this appropriate activation with drives of the aforementioned different quality-relevant systems 139; 48 of the first or the second delivery station I; II. For this activation, switching elements 246; 247 are provided, which can be activated to select the system 139; 48; 49 that will be adjusted.

Figure 47:
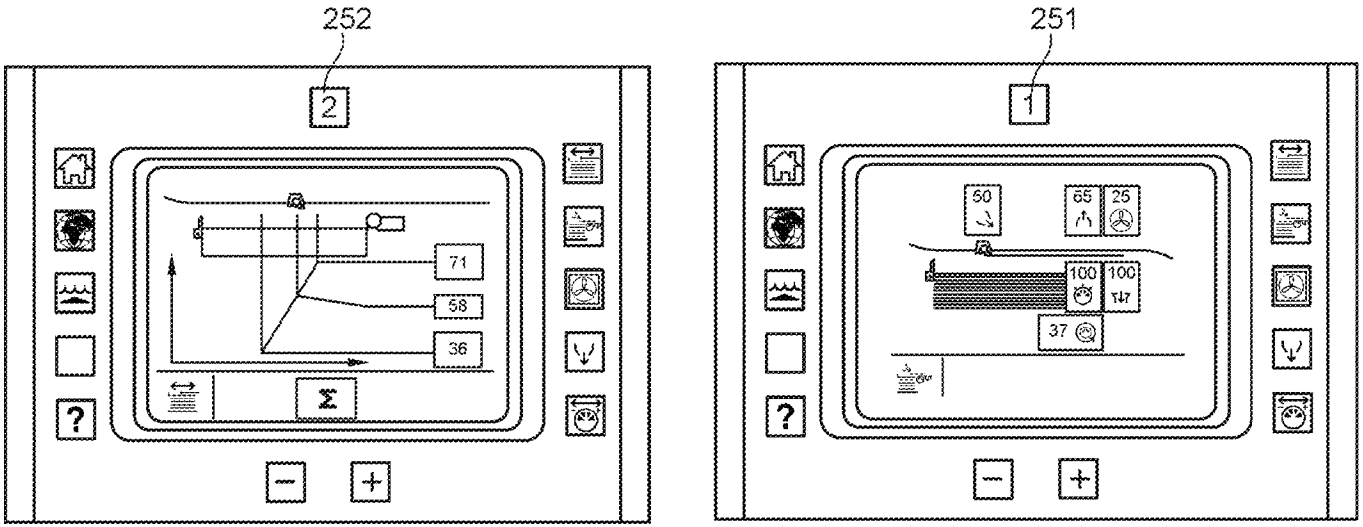
FIG. 47 a detailed view of the two control fields from FIG. 46, each in a mode for adjusting or setting a system of the respective delivery station.

To facilitate a clearly recognizable assignment of control fields 243; 244 to the delivery station I; II, each control field 243; 244 can include an identifier 251; 252 indicating its assignment. In principle, this identifier may be of any embodiment, however in this case it is embodied as a numerical identifier, for example, indicating the downstream position in the series of delivery stations I; II provided (see, e.g. FIG. 47).

The two control fields 243; 244, each comprising a display 239, make up a user interface 253, in particular disposed at an end face, or are included as part of such a user interface 253, along with additional control means that may be located adjacent or in close proximity thereto.

Figure 48:
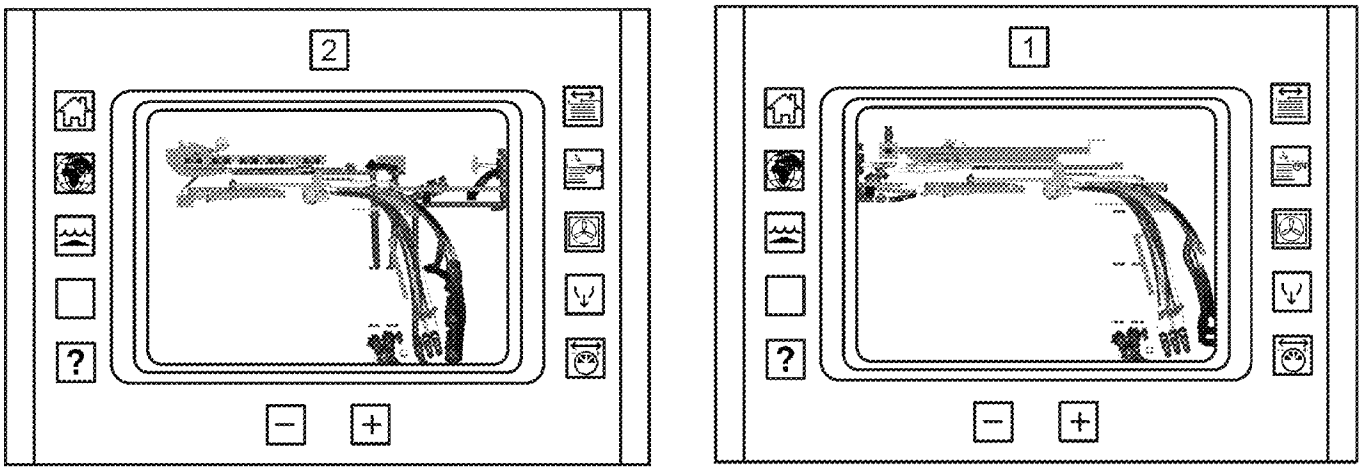
FIG. 48 a detailed view of the two control fields from FIG. 46, each in a mode for displaying systems of the respective delivery station.

As is illustrated by way of example, e.g. in FIG. 48, in a display mode of control fields 243; 244 that is different from the above adjustment mode, schematic representations or preferably even the actual geometric relationships of the essential functional units of the two delivery stations I; II may be displayed in each case.

Independently, in principle, of the specific embodiment of the aforementioned control and adjustment of delivery device 03, but preferably in conjunction with the aforementioned disposition downstream of the second delivery station I; II, or in particular on the end face of display device 03, in which each of the delivery stations I; II is assigned at least one, e.g. aforementioned system 48; 49; 103; 139, each of the delivery stations I; II is assigned at least one system (48; 49; 103; 139) that can be adjusted by means of drives that comprise drive means 63; 106; 147; 202 in terms of an adjustment or correction of the guidance and/or delivery of sheets, at least one user interface 232; 253 having at least one first control means 196'; 197'; 198'; 199'; 211'; 212'; 213'; 214'; 216; 217; 218; 219; 221; 222; 223; 224; 226; 227; 228; 229; 231; 233; 234; 236; 237; 238; 241; 242 is provided, by the actuation of which, via a first signal connection 257; 261, a drive means 63; 106; 147; 202 of a system 49; 103; 139 to be adjusted in the second delivery station II; I, and via a second signal connection 258; 262, a drive means 63; 106; 147; 202 of a system 48; 103; 139 of the first delivery station I; II, which corresponds functionally to the related system 49; 103; 139 of the second delivery station II; I, can be adjusted or set, in particular are or can be adjusted simultaneously.

In the adjustment of the delivery device 03 for delivering substrate sheets B, comprising at least a first delivery station I; II and a second delivery station II; I disposed downstream of the first delivery station I; II in the transport path, in order to adjust or correct sheet guidance and/or sheet delivery in the second delivery station II; I, at least one system 48; 49; 103; 139 that can be adjusted with respect to an adjustment or correction of sheet guidance and/or sheet deposition in the second delivery station II is set or adjusted, and as a result of and/or in conjunction with the setting or adjustment of this system 49; 139 of the second delivery station II, a system 48; 103; 139 of the first delivery station I; II that corresponds functionally to the related system 49; 103; 139 of the second delivery station II is also set or adjusted.

With the setting and/or adjustment of a system 48; 103; 139 which is allocated to the second delivery station II, a correlated setting and/or adjustment of the corresponding system 49; 103; 139 of the first delivery station II is carried out.

This allows adjustments to be made in the first delivery station I; II, which is less visible than the second or last of the delivery stations I; II, at the same time adjustments are made to the second.

In principle, the systems 48; 49; 103; 139 that are impacted by this in pairs may be differently configured and/or may be in a different geometric arrangement, in which case the specific configuration is taken into account in adjusting the associated variable. Preferably, however, the systems 48; 49; 103; 139 to be adjusted together are of the same embodiment, at least in terms of the mechanism of the setting variable $X_{91}$; $v_{dep}$; $X_{139}$; $Y_{201}$ to be adjusted together. Therefore, it is not necessary for complex relationships to be taken into consideration during adjustments, but at most, if desired, an absolute offset and/or an offset proportional to the level of the adjustment variable.

In one advantageous refinement, with the setting of one or more of the adjustable systems 48; 49; 103; 139 of the rear or second delivery station I; II, a setting or adjustment of the corresponding system 48; 49; 103; 139 of the first delivery station I; II is carried out, applying stored rules and/or functions, which is referred to here, e.g. generally as stored correlation 256. This correlation 254 is stored, for example in switching and/or data processing means 254 and may be embodied as a tabular or functional rule 256.

Figure 49:
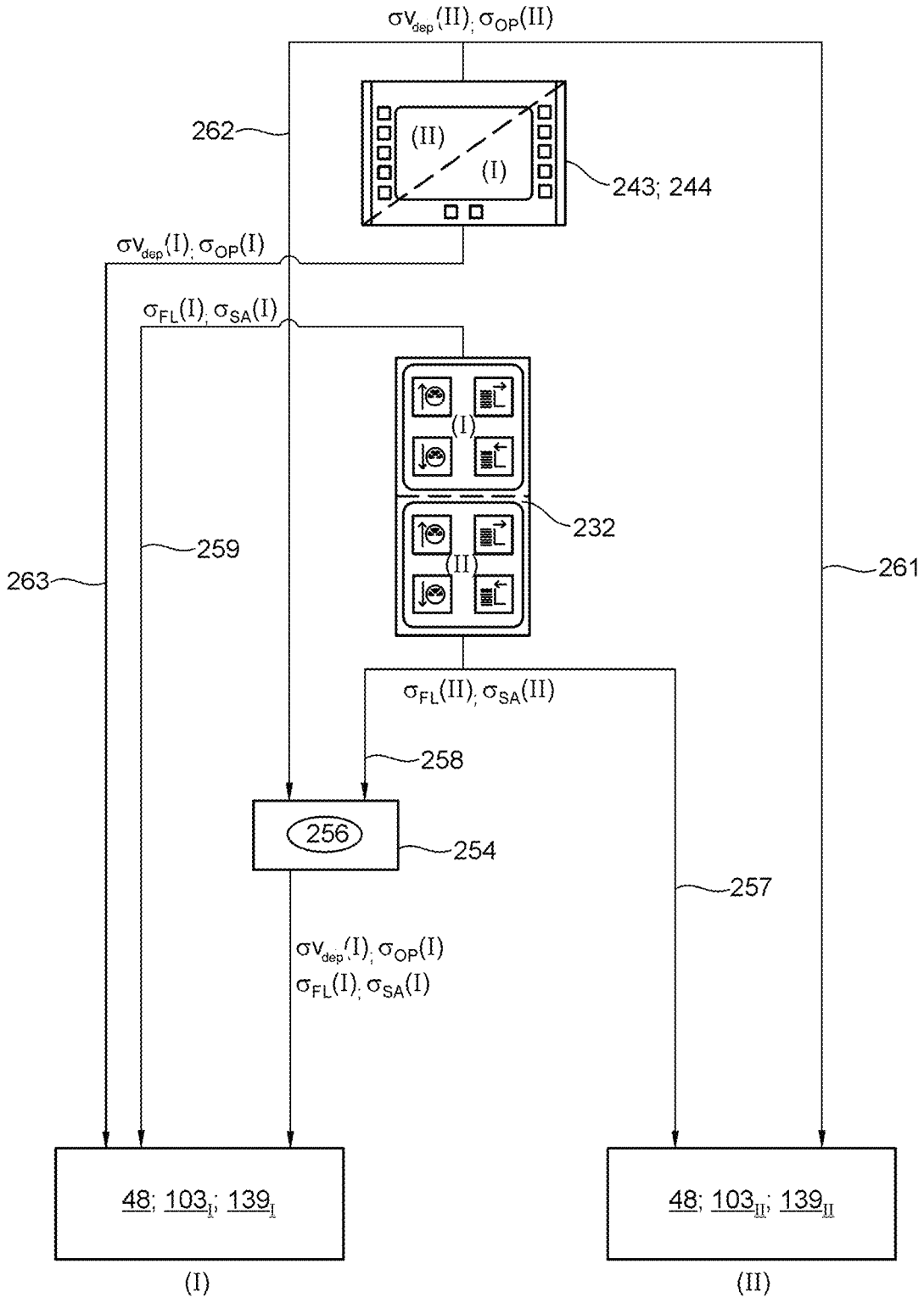
FIG. 49 a schematic representation of an embodiment of the control process involving an induced "co-adjustment" or alignment of the setting at the first delivery station with the adjustment or setting of a system of the second delivery station.

More particularly, the correlation 256 or the rule 256 is configured and programmed to calculate, using the stored correlation 256, an amount for the adjustment or setting of the system 48; 103; 139 assigned to the first delivery station I, from the amount to be adjusted in the system 49; 103; 139 of the second delivery station II, and to apply this amount to the drive of the system 48; 49; 103; 139 related to the first delivery station I; II, i.e. directly to drive means 63; 106; 147; 202 or to the control means S63; S106; S147; S202 assigned thereto (see, e.g. FIG. 49).

Such a modification of the value using a correlation 256 other than a 1:1 application, e.g. using an absolute offset and/or an offset proportional to the height of the adjustment value, is preferably carried out during the adjustment or setting of format-relevant systems 103; 48; 49, i.e. systems that are to be adjusted to the respective format, e.g. in the lateral positioning of the lateral stop system 103 and in the positioning of the at least one brake device 91 in transport direction T. It is particularly advantageous for the adjustment of the system 103; 48 in question of the first delivery station I; II to be implemented such that the setting creates an excess in the format as compared with the setting of the first delivery station I; II for the format actually present. Although this may decrease pile quality somewhat, it reduces the risk of delivery malfunctions.

In contrast, for predominantly transport-relevant systems 48; 49; 139, i.e. systems relating to the movement of sheets B, e.g. for the setting of deposition speed $v_{dep}$ on the braking system 48; 49, and/or for adjusting the release point of release system 139, can be in a 1:1 relationship, at least as far as the adjustment result to be achieved is concerned. In this case, the correlation 256 may reflect the 1:1 relationship directly or may be factored into any correction that may be necessary due to different proportions in the configurations.

It is particularly advantageous for this procedure that includes a modification to be used when the delivery stations I; II that are co-adjusted with the second or rear delivery stations II; I is used only for the delivery of waste sheets. In this case, for example, the requirements in terms of pile quality are less stringent, and systems 48; 103 that determine the positioning of individual sheets can be adjusted more liberally. Adjusting the format for the first delivery station I; II as larger than the actual format and/or the format that is set for the second delivery station I; II reduces the risk of stoppers and ensures that the sheet will drop onto pile 11 with greater certainty, without getting stuck.

By actuating a first control means 228; 229; 231; 233; 234; 236; 228; 229; 231; 233; 234; 236; 218'; 219'; 221'; 222'; 196'; 197'; 198'; 199', for example, the aforementioned deposition speed $v_{dep}$ of a system 48; 49 configured as a braking system 48; 49, and/or the aforementioned release point of a system 139 configured as a release system 139, and/or the lateral aforementioned position of a stop means 202 of a system 103 configured as a lateral stop system 103, and/or the aforementioned position of a brake device 91 of a system 48; 49 configured as a brake system 48; 49 of both the second and the first delivery station I; II is or can be modified or altered simultaneously.

In an advantageous embodiment, at least one second control means 196'; 197'; 198'; 199'; 211'; 212'; 213'; 214'; 216; 217; 218; 219; 221; 222; 223; 224; 226; 227 228; 229; 231; 233; 234; 236; 237; 238; 241; 242 is provided, which is different from the at least one first control means 196'; 197; 198'; 199'; 211'; 212'; 213'; 214'; 216; 217; 218; 219; 221; 222; 223; 224; 226; 227 228; 229; 231; 233; 234; 236; 237; 238; 241; 242, and which can be activated to adjust or set a drive means 63; 106; 147; 202 of a system 48; 139 of the first delivery station I; II to be adjusted, via a third signal connection 259; 263, which is different from the second signal connection, in particular avoiding the use of correlation 256.

The above specifications in this regard also apply to delivery devices 03 that have more than two delivery stations I; II, provided that the second delivery station II forms, e.g. a last delivery station II, and the first delivery station I is a delivery station I disposed upstream of the last delivery station II.

In connection with the above statements relating to the first and the second delivery station I; II, the first and the second delivery station I; II may be the actually numerically first and second delivery stations I; II, or may be, mutatis mutandis, a first-mentioned delivery station and a second-mentioned delivery station, provided downstream of the first, of a plurality of successive delivery stations I; II. In that case, the second-mentioned delivery station can preferably also be the last delivery station I; II downstream.

In principle independently of, but preferably in conjunction with one or more of the features relating to the aforementioned control, in a particularly advantageous embodiment of a delivery system 03 comprising two delivery stations I; II, at least one camera 264.*i* (with i∈N ) is provided in the area of the first delivery station I; II and is or can be directed into the pile space 44 of the pile 11; 168 to be formed in the first delivery station I; II. This camera is preferably in signal communication 269.*i* with an aforementioned display device 266, e.g. monitor 266, in particular TFT monitor, which in particular is likewise disposed on the end face (see, e.g. FIG. 4 and FIG. 40). This camera 264.*i* can be embodied at least as a camera 264.*i* that takes periodic snapshots which it transmits as still images, but preferably as a camera 264.*i* that supplies moving images 267.*i*.

Figure 50:
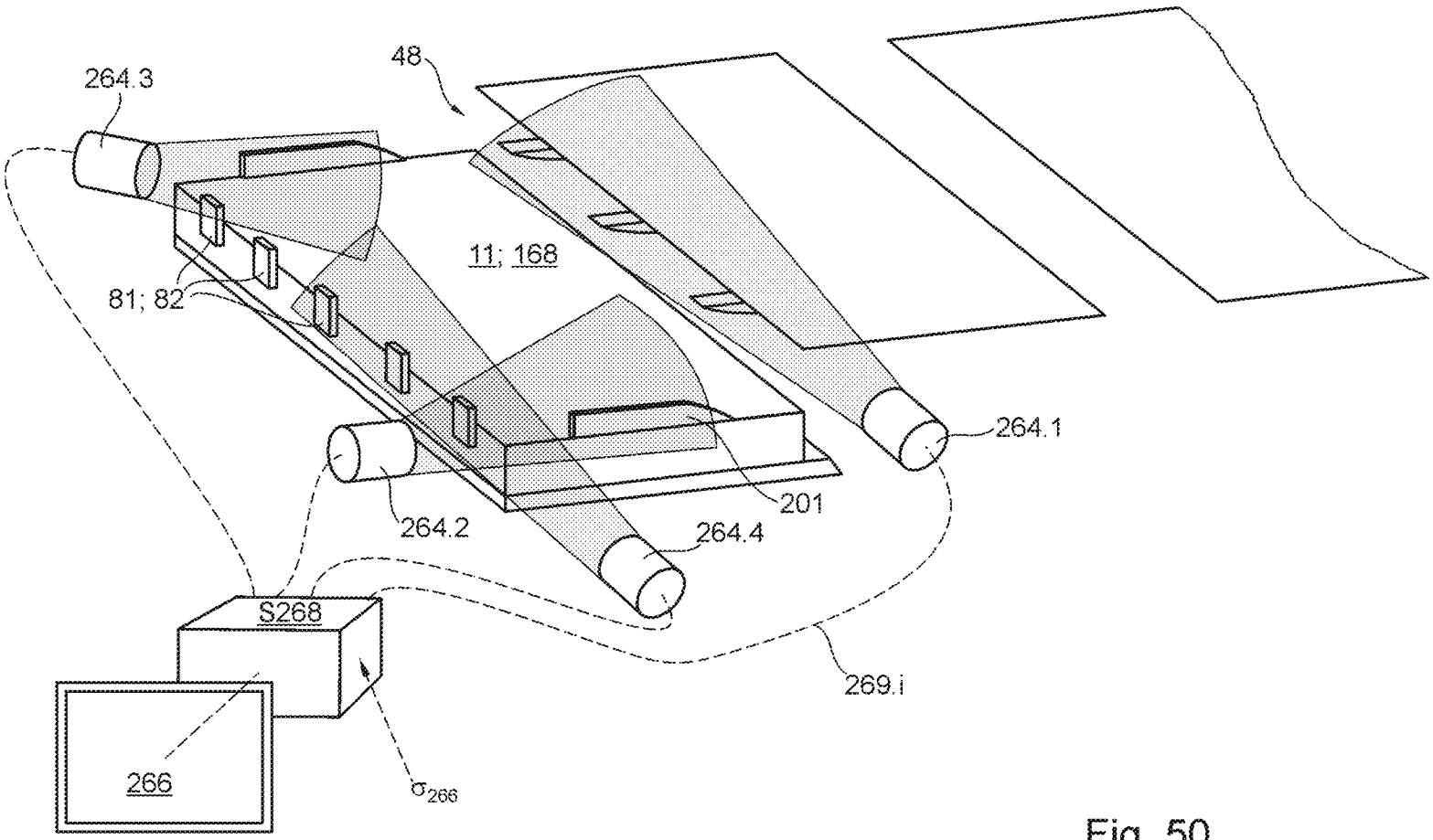
FIG. 50 a perspective view of the positioning of cameras and their connection to a display device.

In one advantageous embodiment, at least one camera 264.*i* is positioned such that its field of view is directed toward the area of at least one pile edge of a pile 11; 168 to be formed in the delivery station I. Preferably, a plurality of cameras 264.*i*, e.g. at least two, are provided. For example, a camera 264.1 is provided, the field of view of which is directed toward the area of sheet brake 48 and/or toward the area of an upper trailing side or leading edge of a pile to be formed, and/or a camera 264.2; 264.3 is provided, the field of view of which is directed, inter alia, toward the area of a lateral stop for sheets B on a lateral stop means 201, and/or a camera 264.4 is provided, the field of view of which is aligned at the level of the upper leading side or leading edge of a pile to be formed along the transversely extending leading edge (see, e.g. FIG. 50). Preferably, two cameras 264.2; 264.3 are provided, each recording one of the bilateral stops on the lateral stop means 201.

If a plurality of cameras 264.*i* are provided, these are preferably in signal connection 269.*i* via control means S266 with display device 266, such that a plurality, e.g. some or all, of the images 267.*i* transmitted by the cameras 264.*i* can be displayed. Control means S266 may be integrated into the controller of display device 266 or provided separately and connected to the controller of display device 266.

Figure 41:
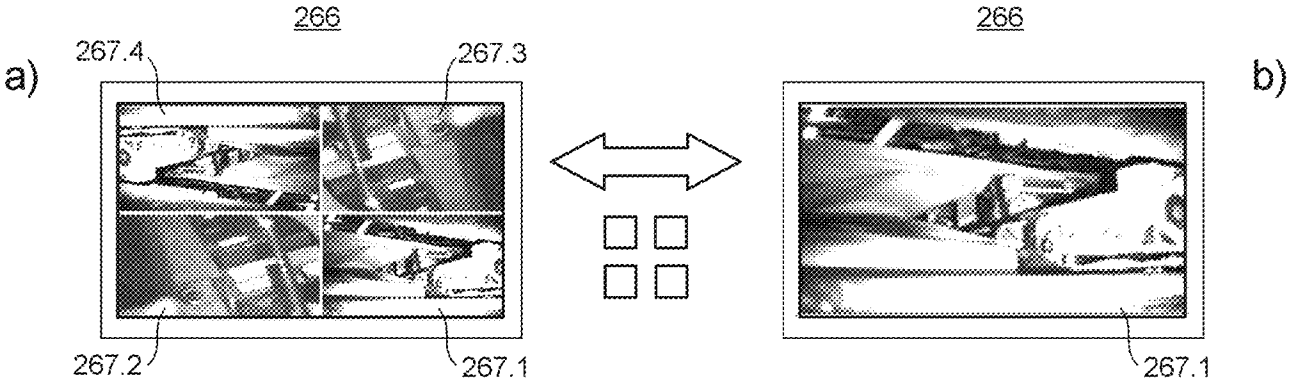
FIG. 41 an illustration of a monitor in two operating modes with a) a plurality of camera images and b) only one enlarged camera image.

In a preferred embodiment, control means S266 can be configured and/or programmed, dependent upon control commands $\sigma_{266}$, e.g. signals $\sigma_{266}$, that are received on the input side, either in a first operating mode to display simultaneously, on display device 266, the images 267.*i* from a plurality of cameras 264.*i*, preferably all of said cameras, that are monitoring the delivery in the first delivery station I (see, e.g. FIG. 41*a*)), or in a second operating mode to display the image 267.*i* from only one selected camera 264.*i* (see, e.g. FIG. 41*a*)).

Figure 42:
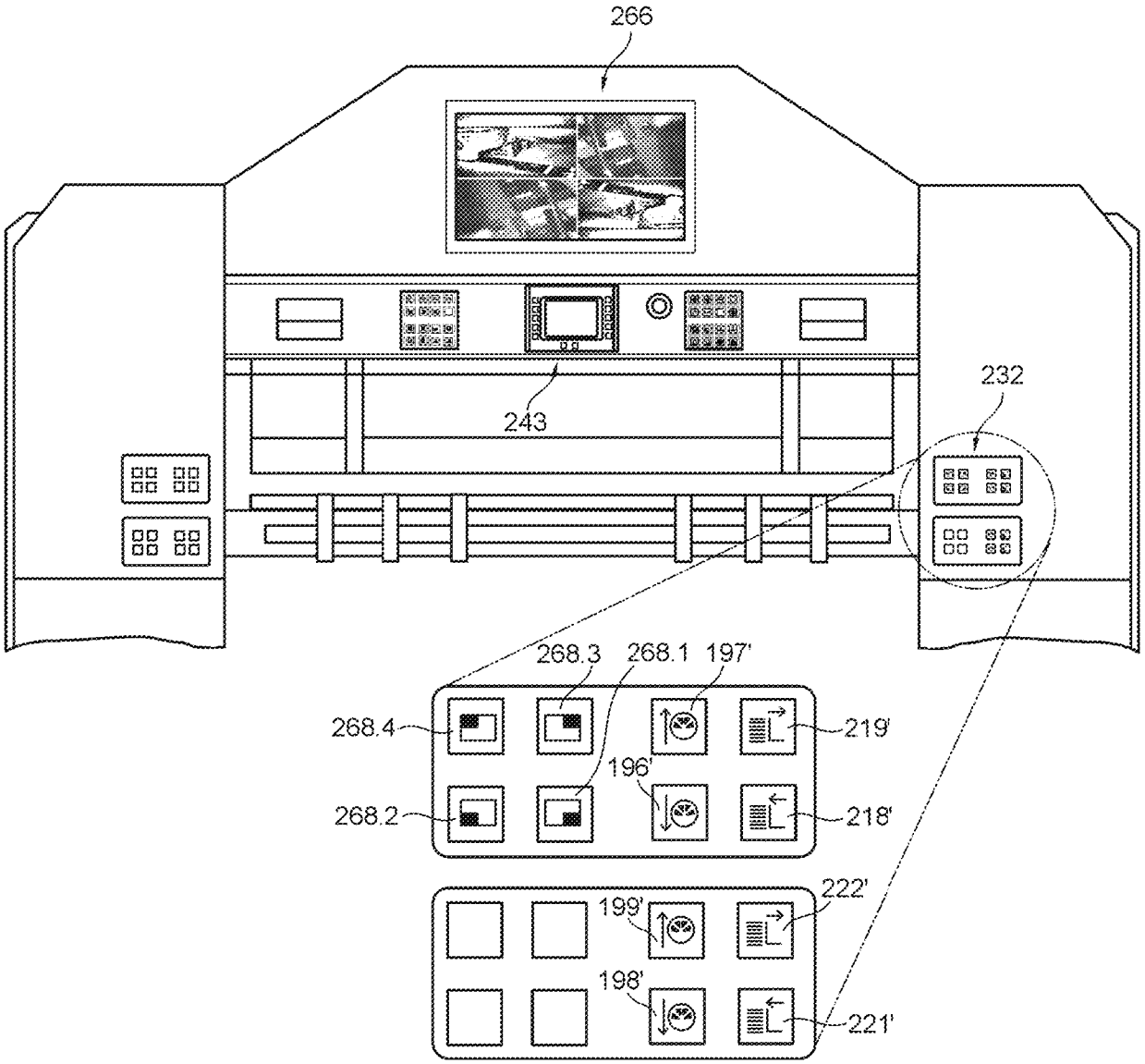
FIG. 42 an enlarged view of the end face from FIG. 40.

The signals $\sigma_{266}$ that trigger the switching of monitor 266 in terms of its operating mode and/or the choice of the sole image 267.*i* to be displayed can be carried out by actuating one or more control means 268.*i*, e.g. pushbuttons 268.*i*, which may be included as part of an aforementioned user interface 232 or optionally as part of a user interface provided specifically for this purpose (see, e.g. FIG. 42). For example, each camera 264.*i* can be provided with a button 268.*i* that, when pressed one time, causes or can cause the enlarged image 268.*i* from the associated camera 264.*i* to be displayed on the monitor 266. When this button 268.*i* is pressed a second time, e.g. the display will switch back to the multi-image view, and when a different button 268.*i* is pressed, the display will switch to the enlarged image from the camera 264.*i* associated with said button 268.*i*.

Of particular advantage is the disposition of the monitor 266 that is connected in terms of signals to the at least one camera 264.*i* combined with the aforementioned disposition downstream of the second or last delivery station I, in particular the end-face disposition, of at least some or all of the aforementioned control means 196'; 197'; 198'; 199'; 211'; 212'; 213'; 214'; 216; 217; 218; 219; 221; 222; 223; 224; 226; 227-228; 229; 231; 233; 234; 236; 237; 238; 241; 242 for adjusting or setting the deposition speed $v_{dep}$ of braking system 48; 49 and/or the release point of a release system 139 and/or the lateral position of a stop means 202 and/or the position of a brake device 91 of both the second or last and the first or an upstream delivery station I; II, or combined with the disposition downstream of the second or last delivery station I, in particular the end-face disposition, of one or more user interfaces 232; 243 comprising the relevant control means 196'; 197'; 198'; 199'; 211'; 212'; 213'; 214'; 216; 217; 218; 219; 221; 222; 223; 224; 226; 227-228; 229; 231; 233; 234; 236; 237; 238; 241; 242.

Together with monitor 266, the at least one user interface 232; 243 forms a control and monitoring console, particularly disposed on the end face, where press operators can observe the delivery process at the first delivery station I through camera 264.*i* and at the second delivery station I; II through a direct view and can also adjust or set systems 48; 49; 193; 139 of the first and second delivery stations I; II that require adjustment or setting.

In a particularly preferred refinement, adjacent to the control and monitoring station, which includes at least one user interface 232; 243 that is also used to control systems 48; 49; 103; 139 of the first delivery station I, and display device 266, which is in signal communication 269.*i* with at least one camera 264.*i* which is directed into the pile space 44 of the first delivery station I for displaying a camera image 267.*i* from the at least one delivery station I, an operating console 271, in particular also referred to as control console 271, is provided, on which press operators can adjust and/or set, inter alia for example, variables that influence processing quality in the at least one processing stage 04; 06 upstream of delivery device 03. For example, control console 271 is embodied and signal connected to corresponding actuators in such a way that at least the inking volume and/or the color profile in inking units 24 of the printing unit(s) 04; 06 can be adjusted, and/or at least the longitudinal and/or transverse register can be adjusted on said console.

Control console 271 is advantageously provided downstream of the lateral intake into pile space 46 of the second delivery station II; I, more particularly at a location on the end face of delivery device 03, as viewed in the longitudinal direction of delivery system 03.

Control console 271 preferably comprises a sampling tray 272, in which test sheets taken for sampling purposes can be deposited and inspected by press operators and/or by means of a measuring device.

The pile 11; 12 of substrate sheets B that is formed in each delivery station I; II and is formed directly or indirectly on the support device 36; 37 can be removed, for example upon completion or when otherwise initiated, and can be transported, e.g. to a further processing stage or to a warehouse.

Figure 51:
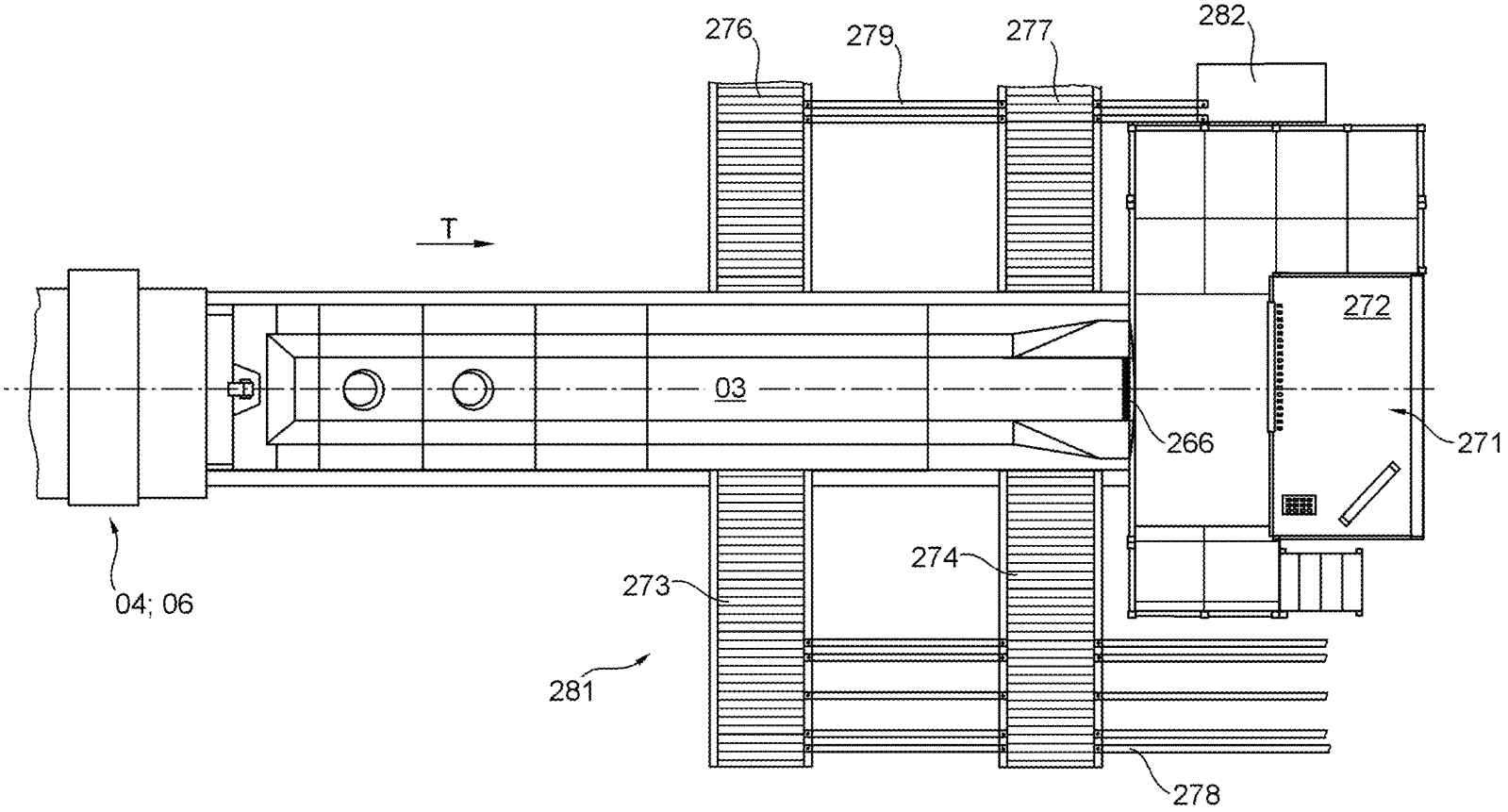
FIG. 51 a schematic plan view of a part of the delivery device and the connection thereof to a transport network of a logistics system in a plant that comprises the machine.

On its own, in principle, for the embodiment as a multi-pile delivery device 03, but particularly advantageously in conjunction with non-stop pile changing systems 52; 53 (see above) provided for both or for the plurality of delivery stations I; II, and/or in conjunction with the disposition downstream of the last delivery station I; II, in particular the end-face disposition, of one or more of the aforementioned user interfaces 232; 243, and/or in conjunction with the aforementioned disposition downstream of the last delivery station I; II, in particular the end-face disposition, of a control console 271, in a particularly advantageous embodiment of delivery system 03 or of the machine 01 comprising the delivery system 03, the transport away from each output of the pile spaces 44; 46 of the or of the plurality of delivery stations I; II, and the transport of empty transport means 61; 62 up to each input into the pile spaces 44; 46 of the or the plurality of delivery stations I; II are carried out via automatically operated and/or operable conveyor lines 273; 274; 276; 277 of a transport network 281 comprising an automated or at least partially automated logistics system (see, e.g. FIG. 51).

The output-side conveyor lines 273; 274 of the multi-pile delivery device 03 are preferably in transport connection with the same conveyor line 278, e.g. in the form of removal line 278, and/or the output-side conveyor lines 276; 277 of multi-pile delivery device 03 are preferably in transport connection with the same conveyor line 279, e.g. in the form of infeed line 279. Removal line 278 leads, for example, away from the multi-pile delivery device 03 in question, e.g. to a collection and/or pick-up station for waste sheets, and to intermediate storage, to final storage, or for further processing of the good sheets.

The output side and/or input side conveyor lines 273; 274; 276; 278 are embodied, for example, as motor-driven and/or motor-drivable roller conveyors 273; 274; 276; 278. The output-side removal path 278 can likewise be embodied as a roller conveyor 278 but is preferably embodied as a conveyor system comprising a transport cart.

In principle, the input-side feed path 279 can likewise be designed as a roller conveyor 279 or preferably as a rail-mounted conveyor, which conveys individual transport means 61; 62 from a transport means dispenser 282, e.g. a pallet storage unit 182, to the respective input-side conveyor line 276; 277.

Thus, in a preferred embodiment, a plurality of delivery stations I; II of the multi-pile delivery device 03 are integrated at least on the output side, but advantageously also on the input side, into a transport network 281 of a logistics system, which is and/or can be operated automatically or at least semi-automatically. In semi-automatic operation, for example, press operators may initiate a transport order and select the destination, but the transport process itself is organized and performed autonomously by a controller. In automatic operation, planning and implementation are performed entirely by a controller, although for safety reasons, initiation of the transport process may require confirmation by a press operator.

While preferred embodiments of a delivery device and method for operating a delivery device, in accordance with the present invention, have been set forth fully and completely hereinabove, it will be apparent to one of skill in the art that changes could be made thereto, without departing from the true spirit and scope of the present invention, which is accordingly to be limited only by the appended claims.

The invention claimed is:

1. A delivery device for a sheet-processing machine comprising:

a first delivery station and a conveyor system, by means of which conveyor system substrate sheets that are processed upstream, in a direction of sheet conveyance in the sheet-processing machine, can be received at a transfer point and conveyed, via a first conveyor section of the conveyor system, to the first delivery station and delivered to one of a first pile to be formed at a first pile space in the first delivery station down-stream, in the direction of sheet conveyance, and conveyed further beyond said first pile, via a second conveyor section of the conveyor system, to a second delivery station comprising a second pile space, where the substrate sheets can be delivered by the conveyor system to a second pile to be formed; and one of a holding device having one or more holding means, which one or more holding means are spaced from one another transversely to the direction of sheet conveyance and which one or more holding means, in a holding position, are placed in physical contact with a topmost layer of one of the first and second piles for holding a topmost sheet of the pile one of the first and second piles down, thereby preventing it from one of being carried away and lifted off when a substrate sheet to be conveyed beyond the one of the first and second piles is being conveyed past, and a sheet guiding element, which sheet guiding element adjoins the first delivery station and at least an upstream end of which sheet guiding element can be varied, in terms of a vertical position by, an actuating drive, via which sheet guiding element a substrate sheet to be conveyed further downstream beyond the first delivery station by the conveyor system can be guided and transported.

2. The delivery device according to claim 1, wherein, in an area of a downstream end of the first delivery station, a stop device, having stop means spaced from one another transversely to the direction of sheet conveyance, is provided, which stop device can be moved, with a stop surface pointing in a direction of approaching substrate sheets, by at least one drive means, one of into an active position, in which active position the stop device is moved into a movement path of the approaching substrate sheets and acts as a stop for leading sheet edges in a region of the stop surface directed upstream, and into an inactive position, in which inactive position the stop device is located outside of the movement path of the substrate sheets and is not active, and wherein a holding means, which is moved along with the movement of the stop means, and which protrudes one of upstream beyond the stop surface and beyond a downstream pile edge of the pile to be formed, in at least one inactive position of the stop means, is associated with one of the movable stop means and with a plurality of the movable stop means, and when the stop means is in the inactive position, the holding means holds a topmost substrate sheet back along its downstream edge, to one of prevent and inhibit said topmost substrate sheet from being lifted off and carried away by substrate sheets to be conveyed beyond said pile.

3. The delivery device according to claim 2, wherein, when the stop means is in the active position, the holding means comes to rest one of downstream ands above the movement path of the substrate sheet to be deposited on the first pile, and when the stop means is in the inactive position, the holding means comes to rest below the movement path of the substrate sheet to be conveyed further beyond the first pile and above the topmost substrate sheet on the first pile, whereby the holding means one of overlaps a pile footprint, at a downstream end thereof, and, at least in the inactive position of the stop means, the holding means extends upstream beyond the pile edge.

4. The delivery device according to claim 2, wherein the stop means is configured as a stop which, in an active position, serves as a forward stop for an approaching substrate sheet, and which stop comprises, at a stop end that is an upper stop end in the inactive position, a stop holding means for holding down the topmost layer of the pile, which stop holding means is a projection in the form of a holding finger, which projection is bent downward in the upstream direction, which is raised upstream over the stop surface, and which projection at least overlaps with a pile footprint at a downstream end thereof, and further wherein the stop means is one of located and positioned such that the movement of the stop means is one of guided and is rectilinear one of overall and in at least one point which is fixed in relation to the stop means.

5. The delivery device according to claim 2, wherein the drive is carried out by the at least one drive means on the stop means via a transmission, such as a transmission that translates a short drive means stroke into a long positioning movement.

6. The delivery device according to claim 2, one of wherein one of the stop means and the holding means is arranged one of in and on the sheet guiding element, which sheet guiding element is mounted such that a vertical position of at least its upstream end is variable, and wherein one of the stop device comprising the stop means and the holding device comprising the holding means can be moved vertically as a complete unit together with the upstream end of the sheet guiding element.

7. The delivery device according to claim 1, one of wherein the sheet guiding element adjoining the first delivery station is part of the second conveyor section, via which a substrate sheet to be conveyed further downstream of the first delivery station by the conveyor system can be further guided and transported, and wherein the sheet guiding element is one of located and positioned in the delivery device such that, for different vertical positions of an upstream end of the sheet guiding element, a vertical position of a guide surface, that supports the substrate sheet at its downstream end, is maintained.

8. The delivery device according to claim 1, wherein the sheet guiding element is one of located and positioned in the delivery device so that when the vertical position of the upstream end of the sheet guiding element is varied within an operationally specified adjustment range, an end face of the sheet guiding element facing the upstream pile space, perpendicular to the direction of sheet conveyance, comes to rest on a substantially vertically extending line, with a deviation of no more than 5° from vertical, and extending along one of a straight line of and along a curved line with one of a constant curvature and a varying curvature with a minimum radius of curvature that is equal to twice a length of the sheet guiding element extending in the direction of sheet conveyance.

9. The delivery device according to claim 1, one of wherein the actuating drive, that effects the vertical change in position of the sheet guiding element, acts on the sheet guiding element one of in the region of and at least close to the upstream end thereof, within a first one-tenth of a length of the sheet guiding element length in the transport direction, and wherein the sheet guiding element is movable linearly in a vertically extending direction, at a point of engagement of the actuating drive.

10. The delivery device according to claim 1, wherein a drive means, which is part of the actuating drive, is connected, in terms of signal communication, with a control means for adjusting the vertical position of the end of the sheet guiding element one of based upon and in correlation with a pile level of the first pile.

11. The delivery device according to claim 1, wherein, in a region of a downstream end of the first delivery station, a stop device having at least one stop means is provided, which stop device, with a stop surface pointing in a direction of approaching substrate sheets, can be moved into one of an active position, in which active position the stop device is moved into a movement path of the approaching substrate sheets and acts as a stop for leading edges thereof, and into an inactive position, in which inactive position the stop device is located outside of the movement path of the substrate sheets and is not active.

12. A method for operating a delivery device including:

providing a conveyor system, by means of which conveyor system a substrate sheet is conveyed downstream, in a sheet transport direction, to a first delivery station, where the substrate sheet one of is delivered by the conveyor system to a pile to be formed at the first delivery station and is conveyed further downstream beyond the pile to be formed at the first delivery station by the conveyor system, via a sheet guiding element adjoining the first delivery station, downstream, to a second delivery station comprising a second pile space;

holding down a topmost sheet of the pile formed at the first delivery station from the top, during a transfer of a sheet to be conveyed further, using an optionally activatable and deactivatable holding device having a holding means; and one of placing the holding means in a holding position, in which holding position, the holding means, are placed in physical contact with a topmost layer of the pile, and having at least an upstream end of the sheet guiding element adjoining the delivery station downstream, in the conveyance path, varied in terms of its vertical position by using an actuating drive.

13. The method according to claim 12, further including providing a stop device in a region of the downstream end of the first delivery station, the stop device having stop means spaced transversely to the sheet transport direction, moving the stop means, using at least one drive means, with a stop surface pointing in a direction of the approaching substrate sheets, into one of an active position, in which active position the stop surface is moved into a movement path of the approaching substrate sheets and acts, in the region of the stop surface, as a stop, and into an inactive position, in which inactive position the stop surface is located outside of a movement path of the substrate sheets and is not active.

14. The method according to claim 13, further including with the moving of the stop means from its active position to its inactive position, moving a holding means from a holding means inactive position to a holding means holding position, in which holding means holding position, the holding means projects beyond the stop surface in the upstream direction, comes to rest above the downstream end of the topmost sheet of the pile, and one of holds the topmost sheet back and inhibits it from being lifted off and carried away by substrate sheets to be conveyed beyond the pile.

15. The method according to claim 14, further including providing the stop means comprising the holding means and being movable from its active position to its inactive position at least at one point along a rectilinear movement path.

16. The method according to claim 12, further including varying a vertical position of the upstream end of the sheet guiding element one of based upon a pile level of a topmost substrate sheet of the pile, and automatically within at least one operationally specified adjustment range.

* * * * *